US011732704B2

(12) United States Patent
Tsutsui et al.

(10) Patent No.: US 11,732,704 B2
(45) Date of Patent: Aug. 22, 2023

(54) AIR COMPRESSOR

(71) Applicant: MAX CO., LTD., Tokyo (JP)

(72) Inventors: Tomohide Tsutsui, Tokyo (JP); Teruaki Ando, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/208,003

(22) Filed: Mar. 22, 2021

(65) Prior Publication Data

US 2021/0293231 A1 Sep. 23, 2021

(30) Foreign Application Priority Data

Mar. 23, 2020 (JP) ..... 2020-050714

(51) Int. Cl.
*F04B 41/02* (2006.01)
*F04B 49/02* (2006.01)

(52) U.S. Cl.
CPC ..... *F04B 41/02* (2013.01); *F04B 49/022* (2013.01); *F04B 2205/05* (2013.01); *F04B 2205/063* (2013.01)

(58) Field of Classification Search
CPC ..... F04B 49/022; F04B 2205/05; F04B 2205/063; F04B 41/02
See application file for complete search history.

(56) References Cited

U.S. PATENT DOCUMENTS 4,863,355 A * 9/1989 Odagiri ..... F04B 41/02 417/44.1
7,326,038 B2 * 2/2008 Iimura ..... F04B 41/02 417/20
7,722,331 B2 * 5/2010 Hirasawa ..... F04B 41/06 417/5
8,784,070 B2 * 7/2014 Yokota ..... F04B 49/065 417/44.2

(Continued)

FOREIGN PATENT DOCUMENTS

EP 3128172 A1 2/2017
JP 2005163553 A * 6/2005

(Continued)

OTHER PUBLICATIONS

Machine Translation of JP-2005163553.*

(Continued)

*Primary Examiner* — Christopher S Bobish
(74) *Attorney, Agent, or Firm* — Weihrouch IP

(57) ABSTRACT

An air compressor includes: a motor actuating a mechanism to generate compressed air; a tank part in which the compressed air is stored; a pressure detector detecting a pressure value in the tank part; and a controller driving the motor when the pressure value is equal to or smaller than an ON pressure value and to stop drive of the motor when the pressure value is equal to or greater than an OFF pressure value. The controller executes processing for detecting a continuous drive time or a continuous stop time of the motor and changing at least one of the ON pressure value, the OFF (Continued)

pressure value and an output of the motor, and the controller detects a change amount of the pressure value, and to determine an execution cycle of the processing or a change amount of a value in the processing, based on the detected change amount.

13 Claims, 32 Drawing Sheets

(56) References Cited

U.S. PATENT DOCUMENTS

| | | | | |
|---|---|---|---|---|
| 9,518,587 | B2 * | 12/2016 | Yokota | F04B 41/02 |
| 9,556,865 | B2 * | 1/2017 | Gourves | F04B 49/022 |
| 2006/0110258 | A1 * | 5/2006 | Iimura | F04B 49/08 417/18 |
| 2009/0210294 | A1 | 8/2009 | Sakamoto et al. | |
| 2010/0223947 | A1 | 9/2010 | Shibuya | |
| 2017/0037842 | A1 | 2/2017 | Ohkubo et al. | |
| 2020/0173434 | A1 | 6/2020 | Ohkubo et al. | |

FOREIGN PATENT DOCUMENTS

| | | | | |
|---|---|---|---|---|
| JP | 2006-226238 | A | | 8/2006 |
| JP | 2007-198341 | A | | 8/2007 |
| JP | 2013155718 | A | * | 8/2013 |
| JP | 2017-036676 | A | | 2/2017 |
| WO | 2010041774 | A1 | | 4/2010 |

OTHER PUBLICATIONS

Extended European Search Report for EP Application No. 21164173.3 dated Jun. 29, 2021. (7 pp).

Japanese Office Action for JP Application No. 2020-050714 dated Jun. 27, 2023, with English Translation. (7 pp.).

* cited by examiner

FIG. 10

| PRESSURE CHANGE RATE | FIRST ELAPSED TIME | SECOND ELAPSED TIME | THIRD ELAPSED TIME |
|---|---|---|---|
| LOW | 2. 0s | 20s | 20s |
| MIDDLE | 1. 0s | 10s | 10s |
| HIGH | 0. 75s | 7. 5s | 7. 5s |
| HIGHEST | 0. 5s | 5s | 5s |

FIG. 14

| PRESSURE CHANGE RATE | CHANGE AMOUNT OF CONTROL CURRENT VALUE | CHANGE AMOUNT OF ON PRESSURE VALUE | CHANGE AMOUNT OF OFF PRESSURE VALUE |
|---|---|---|---|
| LOW | 0. 05A | 0. 05MPa | 0. 05MPa |
| MIDDLE | 0. 1A | 0. 1MPa | 0. 1MPa |
| HIGH | 0. 2A | 0. 2MPa | 0. 2MPa |
| HIGHEST | 0. 3A | 0. 3MPa | 0. 3MPa |

FIG. 18

| CHANGE RATE OF CHANGE RATE | ON PRESSURE VALUE, OFF PRESSURE VALUE, AND CONTROL CURRENT VALUE |
|---|---|
| LOW | NO CHANGE |
| HIGH | CURRENT VALUE < INITIAL VALUE: SET INITIAL VALUE<br>CURRENT VALUE ≥ INITIAL VALUE: NO CHANGE |

AIR COMPRESSOR

CROSS-REFERENCE TO RELATED APPLICATIONS

This application is based on and claims priority under 35 USC 119 from Japanese Patent Application No. 2020-050714 filed on Mar. 23, 2020, the contents of which are incorporated herein by reference.

TECHNICAL FIELD

The present disclosure relates to an air compressor capable of performing control according to consumption of compressed air.

BACKGROUND ART

An air compressor is used so as to drive a nailing machine and the like on construction sites, for example. As the air compressor, known is an air compressor whose operating mode can be changed depending on using situations. For example, known is an air compressor having a mode in which a pressure in a tank part is kept slightly high and a mode in which the pressure in the tank part is kept slightly low. Since each of the modes has a merit and a demerit, an appropriate mode is used, considering surrounding environments, operating time, and the like.

For example, when the mode in which the pressure in the tank part is kept slightly high is set, there is a merit that it is difficult for the compressed air to be deficient. On the other hand, however, a drive time of a motor increases and a load of a compression mechanism also increases. For this reason, there are demerits that a noise continues for a long time, the power consumption increases and a component is faster consumed.

In contrast, when the mode in which the pressure in the tank part is kept slightly low is set, there are merits in terms of quietness, power saving, long service life of components and the like. However, when the pressure in the tank part is rapidly lowered due to use of a nailing machine and the like, the compressed air for driving a tool is likely to be deficient. When the compressed air becomes deficient, an operation should be interrupted, which lowers operation efficiency of an operator.

In order to solve the above problems, JP-A-2017-036676 (hereinafter, referred to as PTL 1) discloses an air compressor configured to perform a setting of changing a value of at least one of a pressure value for motor activation and a pressure value for motor stop each time a predetermined time period elapses. According to the air compressor, since control can be performed according to consumption of the compressed air, it is possible to implement a mode ("AI mode" disclosed in PTL 1) where only merits of the plurality of modes as described above are extracted.

Specifically, when an internal pressure in the tank part is lowered during an operation of the motor, it is determined that the air consumption is large, and an output of the motor and a pressure in the tank part are increased stepwise every predetermined time, thereby making it difficult for the compressed air to be deficient.

In contrast, when the motor is stopped for a predetermined time or longer, it is determined that the air consumption is small, the output of the motor and the pressure in the tank part are reduced stepwise every predetermined time, thereby suppressing the noise, the power consumption and the consumption of the component.

However, according to the "AI mode" disclosed in PTL 1, it is not possible to obtain sufficient followability, depending on operation contents, so that the output of the motor and the pressure in the tank part may be excessively increased or the output of the motor and the pressure in the tank part may be excessively reduced.

Therefore an object of the present disclosure is to provide an air compressor capable of automatically setting an output of a motor and a pressure in a tank part according to a change in pressure in the tank part with higher followability than the related art.

SUMMARY OF INVENTION

An air compressor of a first aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to calculate a change rate of the pressure value in the tank part, and to determine an execution cycle of the setting change processing or a change amount of a value in the setting change processing, based on the change rate.

An air compressor of a second aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to calculate a change rate of the pressure value in the tank part, to compare the change rate with a previously calculated change rate of the pressure value in the tank part, and to change at least one of the ON pressure value, the OFF pressure value and the output of the motor when a comparison result satisfies a predetermined condition.

An air compressor of a third aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to change at least one of the ON pressure value, the OFF pressure value and the output of the motor when the motor is again driven after the motor is continuously stopped longer than a predetermined time.

An air compressor of a fourth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and n output of the motor, based on the continuous drive time or the continuous stop time, and The controller is configured to periodically detect a change amount of the pressure value in the tank part during stop of the motor and to execute control (temporary drive control) of, when the change amount exceeds a reference value, driving the motor even before the pressure value in the tank part reaches the ON pressure value.

An air compressor of a fifth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to periodically detect a change amount of the pressure value in the tank part during stop of the motor, and to change at least one of the ON pressure value and the OFF pressure value when the change amount exceeds a reference value.

An air compressor of a sixth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to execute control (temporary drive control) of driving the motor when a stop time of the motor exceeds a predetermined time, even before the pressure value in the tank part reaches the ON pressure value.

An air compressor of a seventh aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, the air compressor further comprises a break end receiver for receiving an input of information indicating that a break is over, and the controller is configured to change at least one of the ON pressure value, the OFF pressure value and the output of the motor when an end of the break is detected by the break end receiver.

An air compressor of a eighth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, the air compressor further comprises a break start receiver for receiving an input of information indicating that a break has started and a break end receiver for receiving an input of information indicating that the break is over, and the controller is configured not to execute control of reducing at least one of the ON pressure value, the OFF pressure value and the output of the motor after a start of the break is detected by the break start receiver until an end of the break is detected by the break end receiver.

An air compressor of a ninth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, the air compressor further comprises a break start receiver for receiving an input of information indicating that a break has started and a break end receiver for receiving an input of information indicating that the break is over, and the controller is configured to store at least one of the ON pressure value, the OFF pressure value and the output of the motor when a start of the break is detected by the break start receiver, and to restore the stored value when an end of the break is detected by the break end receiver.

BRIEF DESCRIPTION OF DRAWINGS

Exemplary embodiments of the present disclosure will be described in detail based on the following figures, wherein:

FIG. 10 depicts a cycle designation table that is used in the pressure change detection processing of the first embodiment;

FIG. 1C depicts a relation between an ON pressure value or an OFF pressure value and a time when a change rate in pressure is large in the first embodiment;

FIG. 14 depicts a change amount designation table that is used in the pressure change detection processing of the modified embodiment of the first embodiment;

FIG. 18 depicts a changed content designation table that is used in the change rate variation detection processing of the second embodiment;

DESCRIPTION OF EMBODIMENTS

First Embodiment

A first embodiment of the present disclosure will be described with reference to FIGS. 1 to 12.

Figure 1:
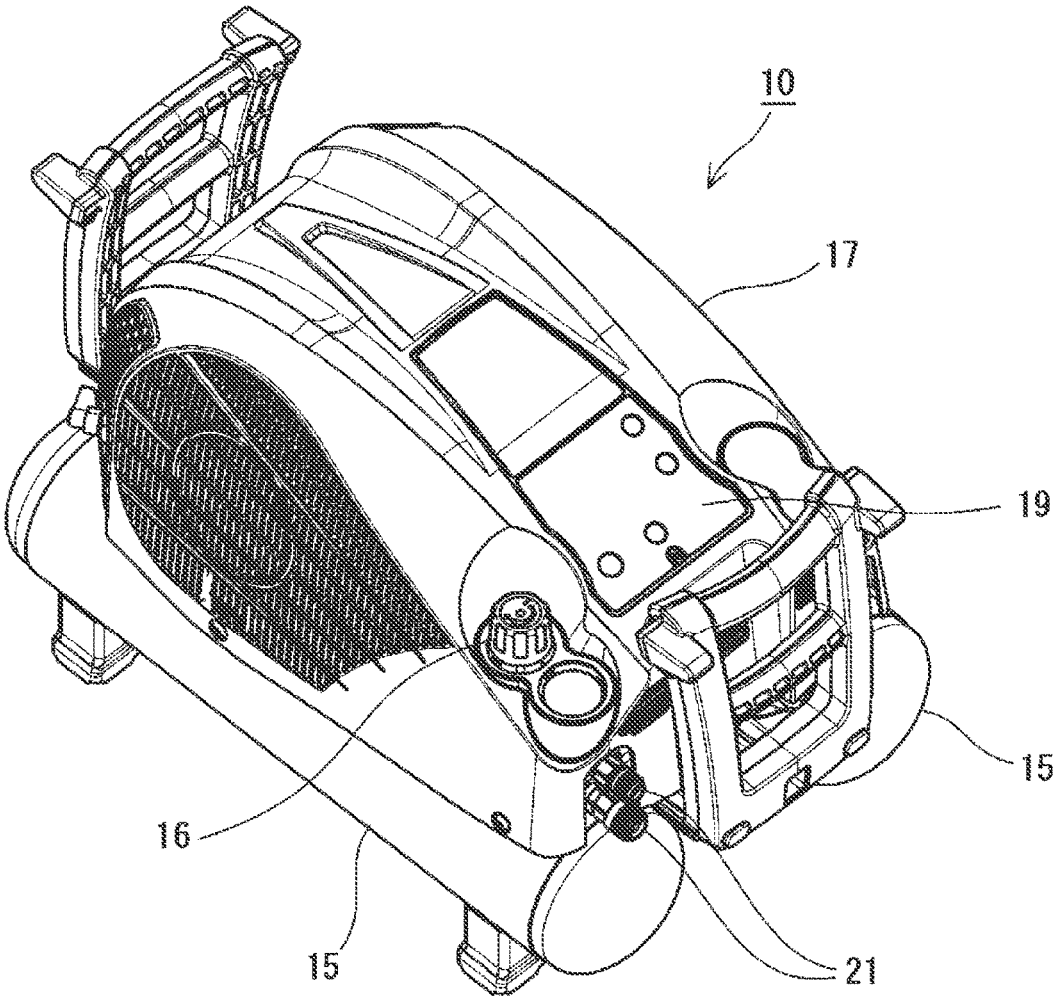
FIG. 1 depicts an outer shape of an air compressor of a first embodiment.

An air compressor 10 of the present embodiment is a portable compressor, and includes a mechanism unit covered by a body cover 17, and two tank parts 15 arranged below the mechanism unit, as shown in FIG. 1.

The mechanism unit is not particularly shown because it is well-known, but is constituted by a motor 11, a compression mechanism, a control substrate (controller 30) and the like.

The motor 11 is a drive source for actuating the compression mechanism. In the present embodiment, a three-phase brushless DC motor is used. Rotation of the motor 11 is controlled by a PWM signal output from the controller 30, which will be described later.

Note that, the output of the motor 11 of the present embodiment can be dynamically changed according to using situations of compressed air. When the output of the motor 11 is set high, a charging speed of the compressed air can be increased by driving the motor 11 at high speed. On the other hand, when the output of the motor 11 is set low, the motor 11 is driven at low speed. Thereby, the charging speed of the compressed air is lowered but the power consumption is lowered to improve quietness.

Examples of a method of changing the output of the motor 11 include a method of changing a target rotation number of the motor 11, a method of changing a control current value of the motor 11, a method of changing a duty ratio of the motor 11, and the like. In the present embodiment, an example where the output of the motor 11 is changed by changing the control current value of the motor 11 is described. However, the present disclosure is not limited thereto. For example, the output of the motor 11 may also be changed by other methods.

The compression mechanism is to drive and to generate the compressed air by the motor 11, and a well-known structure configured to compress air introduced in a cylinder by reciprocally moving a piston may be used. The air compressor 10 of the present embodiment is a multi-stage compressor having two compression mechanisms of a primary compression mechanism and a secondary compression mechanism. That is, the air supplied from an outside is first compressed by the primary compression mechanism. The air compressed by the primary compression mechanism is introduced into the secondary compression mechanism and is further compressed by the secondary compression mechanism. The air compressed in two-stage manner in this way is sent and stored in the tank parts 15.

The compressed air stored in the tank parts 15 is decompressed to any pressure as it passes through a decompression valve 16, and can be extracted to an outside from an air outlet 21. For example, the compressed air in the tank part 15 can be supplied to a tool by connecting an air hose of the tool such as a nailing machine, a spray gun, an air duster and the like to the air outlet 21.

The controller 30 is to control operations of the air compressor 10, is mainly constituted by a CPU, and has a ROM, a RAM and the like, which are not particularly shown. The controller is configured to control diverse input devices and output devices by the CPU reading a program stored in the ROM. In the present embodiment, the controller 30 is constituted by a control substrate arranged in the body cover 17 (above the tank parts 15).

Figure 2:
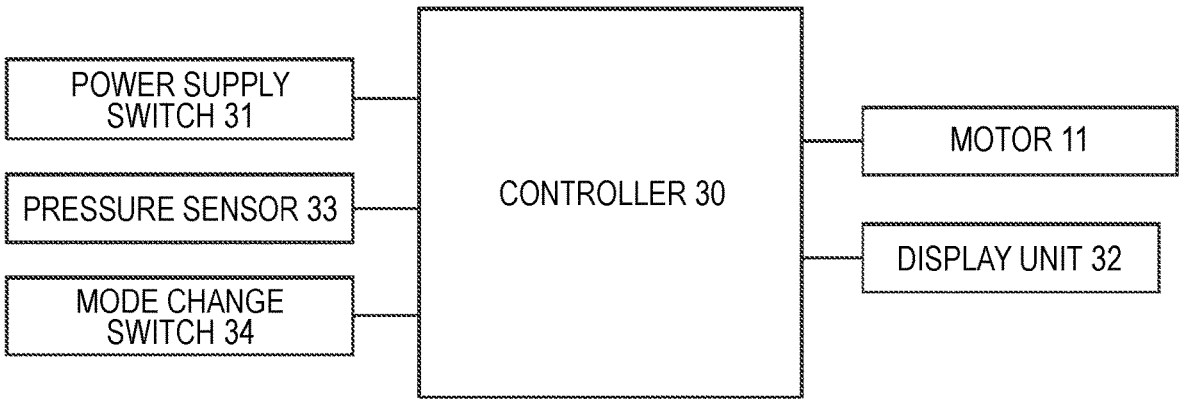
FIG. 2 is a block diagram schematically depicting a configuration of the air compressor of the first embodiment.

As shown in FIG. 2, examples of the input device of the controller 30 include a power supply switch 31, a pressure sensor 33, a mode change switch 34, and the like. Note that, the examples of the input device are not limited to the input devices and may also include other input devices. In addition, an external operation means such as a smart phone may be used as the input device.

The power supply switch 31 is a switch for turning on and off a power supply of the air compressor 10. The power supply switch 31 is operably arranged on an operation panel 19 (refer to FIG. 1) provided on a surface of the body cover 17.

The pressure sensor 33 is to measure an internal pressure in the tank part 15, and constitutes the pressure detector of the present embodiment. A pressure value detected by the pressure sensor 33 is transmitted to the controller 30. The controller 30 is configured to control drive start or drive stop of the motor 11, based on the pressure value acquired from the pressure sensor 33. Specifically, an ON pressure value that is a pressure value for starting drive of the compression mechanism and an OFF pressure value that is a pressure value for stopping drive of the compression mechanism are preset so as to meet a relation of the ON pressure value<the OFF pressure value. The controller 30 is configured to perform control of, when the pressure value in the tank part 15 detected by the pressure sensor 33 is equal to or smaller than the ON pressure value, driving the motor 11, and when the pressure value in the tank part 15 detected by the pressure sensor 33 is equal to or larger than the OFF pressure value, stopping the drive of the motor 11. Thereby, when the internal pressure in the tank part 15 does not reach the preset ON pressure value, the motor 11 is driven to charge the compressed air, and when the internal pressure in the tank part 15 reaches the preset OFF pressure value during the drive of the motor 11, the drive of the motor 11 is stopped.

Note that, the ON pressure value and the OFF pressure value of the air compressor 10 of the present embodiment are set to be different values, according to operating modes, which will be described later. For example, when the ON pressure value and the OFF pressure value are set large, control of keeping the internal pressure in the tank part 15 at a high level is executed. In contrast, when the ON pressure value and the OFF pressure value are set small, the internal pressure in the tank part 15 does not increase so much but the drive of the motor 11 is suppressed to improve the quietness and to reduce the power consumption.

The mode change switch 34 is a switch for switching the operating mode of the air compressor 10. The mode change switch 34 is operably arranged on the operation panel 19 (refer to FIG. 1) provided on the surface of the body cover 17.

Examples of the output device of the controller 30 include the motor 11, a display unit 32, and the like, as shown in FIG. 2. Note that, the examples of the output device are not limited to the output devices, and may also include other output devices.

As described above, the motor 11 is a power source for actuating the compression mechanism. The controller 30 is configured to control the rotation of the motor 11 under control of PWM control.

The display unit 32 is to display a variety of information toward a user, and includes a display device such as a 7-segment display, a liquid crystal screen, an LED, and the like. The display unit 32 of the present embodiment can display on and off states of a power supply, a current operating mode, a value of the internal pressure in the tank part 15, presence or absence of an error, and the like. The display unit 32 is provided to the operation panel 19 provided on the surface of the body cover 17.

The air compressor 10 of the present embodiment has a plurality of operating modes. Examples of the plurality of operating modes include a "quiet mode", a "usual mode", a "rapid charging mode" and a "follow-up control mode".

The "quiet mode", the "usual mode" and the "rapid charging mode" are operating modes in which the ON pressure value, the OFF pressure value and the output of the motor 11 are always kept constant. The ON pressure value, the OFF pressure value and the output of the motor 11 are set to be larger in order of the "quiet mode"<the "usual mode"<the "rapid charging mode". For this reason, when the operator wants to suppress noises, which are generated during driving, by reducing the rotation number of the motor 11, the operator may select the "quiet mode". When the operator wants to increase an amount of the compressed air, which is generated with the compression mechanism, by increasing the rotation number of the motor 11, the operator may select the "rapid charging mode". In neither cases, the operator may select the "usual mode".

The "follow-up control mode" is a mode in which setting change processing for detecting a continuous drive time or a continuous stop time of the motor 11 and changing at least any one of the ON pressure value, the OFF pressure value and the output of the motor 11, based on the continuous drive time or the continuous stop time, is executed. For example, when the continuous drive time of the motor 11 is long, it is determined that air consumption is large, and the output of the motor 11 and the pressure in the tank part 15 (the ON pressure value or the OFF pressure value) may be increased stepwise every predetermined time, thereby making it difficult for the compressed air to be deficient. In contrast, when the continuous stop time of the motor 11 is long, it is determined that the air consumption is small, and the output of the motor 11 and the pressure in the tank part 15 (the ON pressure value or the OFF pressure value) may be decreased stepwise every predetermined time, thereby suppressing the noise, the power consumption and the consumption of the component. In this way, in the follow-up control mode, the controller 30 dynamically changes the ON pressure value, the OFF pressure value and the output of the motor 11, according to the use situations of the compressed air, thereby executing the control following the consumption of compressed air.

Note that, in the follow-up control mode of the present embodiment, the example where the ON pressure value, the OFF pressure value and the output of the motor 11 are all changed is described. However, the present disclosure is not limited thereto. That is, at least one of the ON pressure value, the OFF pressure value and the output of the motor 11 may be changed. For example, a follow-up control mode in which only the output of the motor 11 is changed and the ON pressure value and the OFF pressure value are not changed, and a follow-up control mode in which the output of the motor 11 is not changed and the ON pressure value and the OFF pressure value are changed may be provided.

Figure 8:
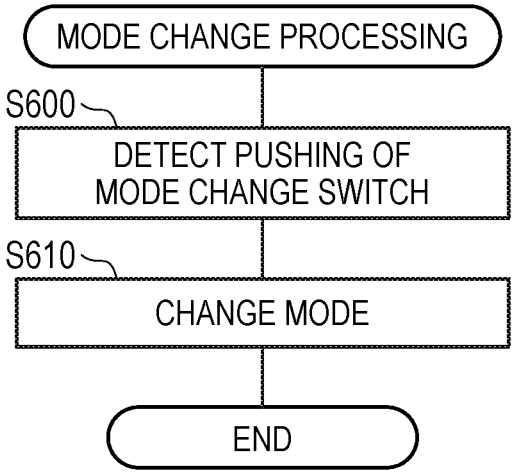
FIG. 8 is a flowchart of mode change processing of the first embodiment.

The operating modes are executed by mode change processing shown in FIG. 8.

That is, as shown in step S600 of FIG. 8, when the mode change switch 34 is operated by a user, an external interrupt due to a switch input occurs. By the external interrupt, the controller 30 detects that the mode change switch 34 is pushed.

The controller 30 detecting that the mode change switch 34 is pushed changes the operating mode, as shown in step S610. Note that, a variety of processing for changing the operating mode may be considered, and the present disclosure is not limited to one processing method. For example, the operating mode may be sequentially switched (for example, in order of the "quiet mode"→the "usual mode"→the "rapid charging mode"→the "follow-up control mode") each time the mode change switch 34 is pushed. Alternatively, different switches may be provided for each of the operating modes, and the operating mode may be switched to an operating mode corresponding to the pushed switch.

In this way, the user can select any operating mode and use the air compressor 10.

Figure 3:
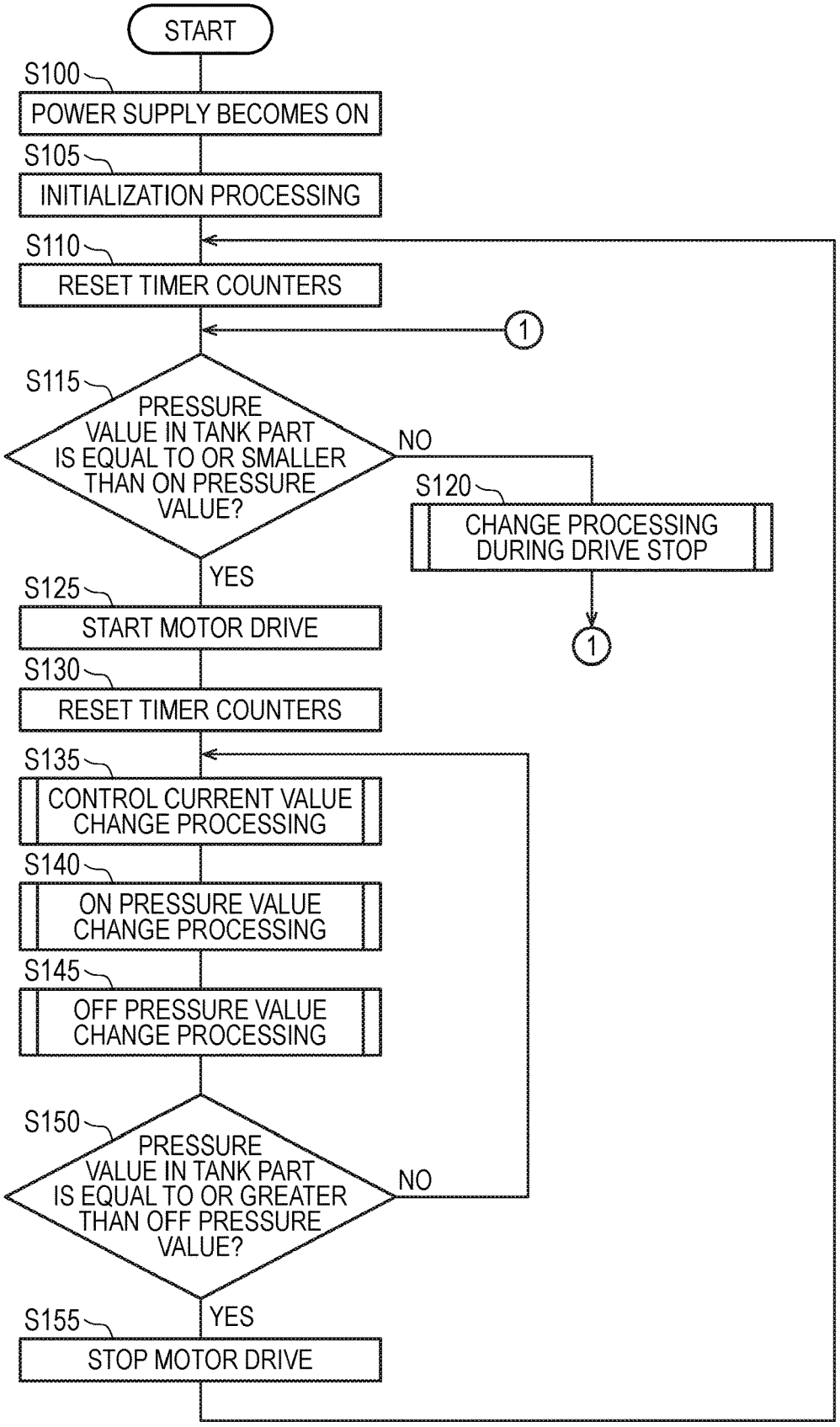
FIG. 3 is a main flowchart of the air compressor of the first embodiment.

The air compressor 10 is actuated according to a main flow shown in FIG. 3. Note that, the above-described mode change processing and pressure change detection processing, which will be described later, are executed in parallel at the same time, independently of the main flow. The mode change processing is processing that is executed when the external interrupt occurs, as described above. The pressure change detection processing is processing that is executed when a timer interrupt occurs, and is processing that is periodically called and executed by a timer interrupt that occurs every predetermined time (for example, 200 milliseconds).

First, the main flow is described with reference to FIG. 3. The main flow is processing that is executed after the power supply becomes on until the power supply becomes off. Note that, when the power supply becomes off, the external interrupt occurs any timing, so that the main flow is interrupted and end processing (not shown) is executed.

In the main flow, in step S100 of FIG. 3, the power supply switch 31 is operated and the power supply becomes on. The main flow proceeds to step S105.

In step S105, a variety of parameters are initialized by the controller 30. The air compressor 10 of the present embodiment is configured to store a current operating mode in a non-volatile memory during previous end processing when the power supply becomes off. In step S105, the operating mode stored in the non-volatile memory is read out, and the diverse parameters are initialized based on the information of the operating mode. For example, the operating mode may be restored, and the ON pressure value and the OFF pressure value and the control current value may be set based on the initial values of the operating mode. In addition, the display unit 32 may be initialized and the display using an LED, liquid crystals and the like may be performed.

Note that, when the restored operating mode is the follow-up control mode, the diverse parameters that are used in the follow-up control mode are also initialized. In the present embodiment, examples of variable parameters that are used in the follow-up control mode include a "first elapsed time", a "second elapsed time", a "third elapsed time", a "fourth elapsed time", a "change amount of the control current value", a "change amount of the ON pressure value", and a "change amount of the OFF pressure value". When the power supply becomes on or when a mode is changed, the parameters are initialized and preset initial values are set.

The "first elapsed time" is to prescribe an execution cycle of processing for changing a control current value with reference to the continuous drive time of the motor 11. The controller 30 of the present embodiment is configured to stepwise increase the control current value each time the continuous drive time of the motor 11 runs beyond a time prescribed by the first elapsed time (however, there is an upper limit). For this reason, when the first elapsed time is short, the output of the motor 11 is rapidly increased, and when the first elapsed time is long, the output of the motor 11 is gently increased.

The "second elapsed time" is to prescribe an execution cycle of processing for changing the ON pressure value with reference to the continuous drive time of the motor 11. The controller 30 of the present embodiment is configured to stepwise increase the ON pressure value each time the continuous drive time of the motor 11 runs beyond a time prescribed by the second elapsed time (however, there is an upper limit). For this reason, when the second elapsed time is short, the pressure in the tank part 15 is rapidly increased, and when the second elapsed time is long, the pressure in the tank part 15 is gently increased.

The "third elapsed time" is to prescribe an execution cycle of processing for changing the OFF pressure value with reference to the continuous drive time of the motor 11. The controller 30 of the present embodiment is configured to stepwise increase the OFF pressure value each time the continuous drive time of the motor 11 runs beyond a time prescribed by the third elapsed time (however, there is an upper limit). For this reason, when the third elapsed time is short, the pressure in the tank part 15 is rapidly increased, and when the third elapsed time is long, the pressure in the tank part 15 is gently increased.

The "fourth elapsed time" is to prescribe an execution cycle of processing for changing the control current value, the ON pressure value and the OFF pressure value with reference to the continuous stop time of the motor 11. The controller 30 of the present embodiment is configured to stepwise decrease the control current value, the ON pressure value and the OFF pressure value each time the continuous stop time of the motor 11 runs beyond a time prescribed by the fourth elapsed time (however, there is a lower limit). For this reason, when the fourth elapsed time is short, the pressure in the tank part 15 is rapidly decreased, and when the fourth elapsed time is long, the pressure in the tank part 15 is gently decreased. In the present embodiment, however, the fourth elapsed time is set as a fixed value (for example, 30 seconds).

The "change amount of the control current value" is to prescribe a change amount of a value when changing the control current value with reference to the continuous drive time or the continuous stop time of the motor 11. For this reason, when the change amount of the control current value is large, the output of the motor 11 is rapidly increased (or decreased), and when the change amount of the control current value is small, the output of the motor 11 is gently increased (or decreased).

The "change amount of the ON pressure value" is to prescribe a change amount of a value when changing the ON pressure value with reference to the continuous drive time or the continuous stop time of the motor 11. For this reason, when the change amount of the ON pressure value is large, the pressure in the tank part 15 is rapidly increased (or decreased), and when the change amount of the ON pressure value is small, the pressure in the tank part 15 is gently increased (or decreased).

The "change amount of the OFF pressure value" is to prescribe a change amount of a value when changing the OFF pressure value with reference to the continuous drive time or the continuous stop time of the motor 11. For this reason, when the change amount of the OFF pressure value is large, the pressure in the tank part 15 is rapidly increased (or decreased), and when the change amount of the OFF pressure value is small, the pressure in the tank part 15 is gently increased (or decreased).

When the initialization is completed, the main flow proceeds to step S110.

In step S110, the controller 30 resets timer counters. In the present embodiment, four timer counters are provided. The timer counters are to acquire elapsed time since a reset timing. That is, by referring to the timer counters, elapsed time since last reset can be acquired. Note that, in the present embodiment, the elapsed time is measured with the four timer counters. However, the present disclosure is not limited thereto and any number of the timer counters capable of measuring the elapsed time can be used. For example, four elapsed times may also be measured with one timer counter. In addition, it is not necessarily required to use the timer counters. For example, the elapsed time may be measured by directly referring to a value of a timer embedded in the CPU or the elapsed time may be detected by a timer interrupt.

Note that, the timer counters of the present embodiment are used in the follow-up control mode. Specifically, a first timer counter is to manage an execution cycle of the processing for changing the control current value with reference to the continuous drive time of the motor 11. A second timer counter is to manage an execution cycle of the processing for changing the ON pressure value with reference to the continuous drive time of the motor 11. A third timer counter is to manage an execution cycle of the processing for changing the OFF pressure value with reference to the continuous drive time of the motor 11. A fourth timer counter is to manage an execution cycle of the processing for changing the control current value, the ON pressure value and the OFF pressure value with reference to the continuous stop time of the motor 11.

When all the timer counters are reset, the main flow proceeds to step S115.

In step S115, the controller 30 acquires the pressure value in the tank part 15 detected by the pressure sensor 33, and checks whether the pressure value is equal to or smaller than the ON pressure value. When it is checked that the pressure value is equal to or smaller than the ON pressure value, the main flow proceeds to step S125. On the other hand, when it is checked that the pressure value is not equal to or smaller than the ON pressure value, the main flow proceeds to step S120.

When the main flow proceeds to step S120, the motor 11 is still in the stop state because the motor 11 is under stop and the pressure value in the tank part 15 is not equal to or smaller than the ON pressure value (the pressure in the tank part 15 is sufficient). In this case, change processing during drive stop, which will be described later, is executed. Thereafter, the main flow returns to step S115.

On the other hand, when the main flow proceeds to step S125, the controller 30 performs control of starting the drive of the motor 11 because the motor 11 is under stop and the pressure value in the tank part 15 is equal to or smaller than the ON pressure value (the pressure in the tank part 15 is insufficient). At this time, the output of the motor 11 is controlled by the set control current value. Then, the main flow proceeds to step S130.

In step S130, all the timer counters are reset. Then, the main flow proceeds to step S135.

In step S135, control current value change processing that will be described later is executed. Then, the main flow proceeds to step S140.

In step S140, ON pressure value change processing that will be described later is executed. Then, the main flow proceeds to step S145.

In step S145, OFF pressure value change processing that will be described later is executed. Then, the main flow proceeds to step S150.

In step S150, the controller 30 acquires the pressure value in the tank part 15 detected by the pressure sensor 33, and checks whether the pressure value is equal to or greater than the OFF pressure value. When it is checked that the pressure value is equal to or greater than the OFF pressure value, the main flow proceeds to step S155. On the other hand, when the pressure value is not equal to or greater than the OFF pressure value, the main flow returns to step S135.

When the main flow proceeds to step S155, the controller 30 stops the drive of the motor 11 because the pressure value in the tank part 15 has reached a stop pressure of the motor 11 due to the drive of the motor 11. Then, the main flow returns to step S110.

Subsequently, the control current value change processing is described with reference to FIG. 4. The control current value change processing is processing for stepwise increasing the control current value each time the continuous drive time of the motor 11 exceeds a predetermined time.

Figure 4:
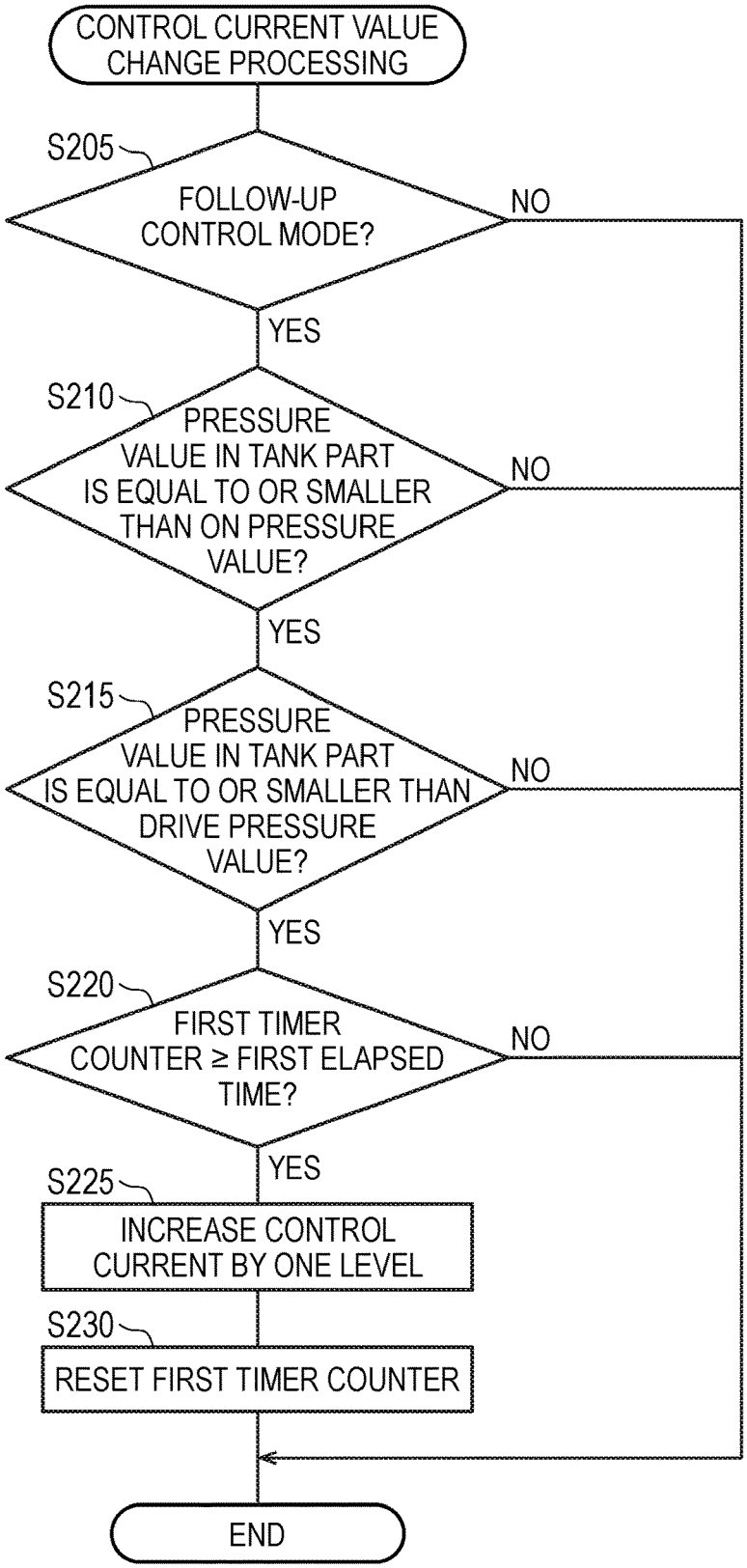
FIG. 4 is a flowchart of control current value change processing of the first embodiment.

In the control current value change processing, in step S205 shown in FIG. 4, it is checked whether a current operating mode is the follow-up control mode. When it is checked that the current operating mode is not the follow-up control mode, the control current value change processing is over. On the other hand, when it is checked that the current operating mode is the follow-up control mode, the flow proceeds to step S210.

In step S210, the controller 30 acquires the pressure value in the tank part 15 detected by the pressure sensor 33, and checks whether the pressure value is equal to or smaller than the ON pressure value. When it is checked that the pressure value is not equal to or smaller than the ON pressure value, the control current value change processing is over. On the other hand, when it is checked that the pressure value is equal to or smaller than the ON pressure value, the flow proceeds to step S215.

In step S215, the controller 30 acquires the pressure value in the tank part 15 detected by the pressure sensor 33, and checks whether the pressure value is equal to or smaller than a drive pressure value. The drive pressure value is a pressure value that is assumed as being required so as to drive the tool. The pressure value may be a fixed value or may be arbitrarily set by the operator. In the present embodiment, for example, 2.8 MPa is set as the drive pressure value. When it is checked that the pressure value is not equal to or smaller than the drive pressure value, the control current value change processing is over. On the other hand, when it is checked that the pressure value is equal to or smaller than the drive pressure value, the flow proceeds to step S220.

In step S220, the controller 30 refers to the first timer counter, and checks whether a value of the first timer counter is equal to or greater than the first elapsed time. When it is checked that the value of the first timer counter is not equal to or greater than the first elapsed time, the control current value change processing is over. On the other hand, when it is checked that the value of the first timer counter is equal to or greater than the first elapsed time, it means that a time of a predetermined cycle (first elapsed time) has elapsed since the first timer counter was reset at last, and thus the flow proceeds to step S225.

When the flow proceeds to step S225, the controller 30 increases the control current value by one level, according to a predetermined "change amount of the control current value". Thereby, the output of the motor 11 is increased by one level (however, when the output of the motor has reached the preset upper limit value, it is not increased beyond the upper limit value). Then, the flow proceeds to step S230.

In step S230, the controller 30 resets the first timer counter. Then, the control current value change processing is over.

Subsequently, the ON pressure value change processing is described with reference to FIG. 5. The ON pressure value change processing is processing for stepwise increasing the ON pressure value each time the continuous drive time of the motor 11 exceeds a predetermined time.

Figure 5:
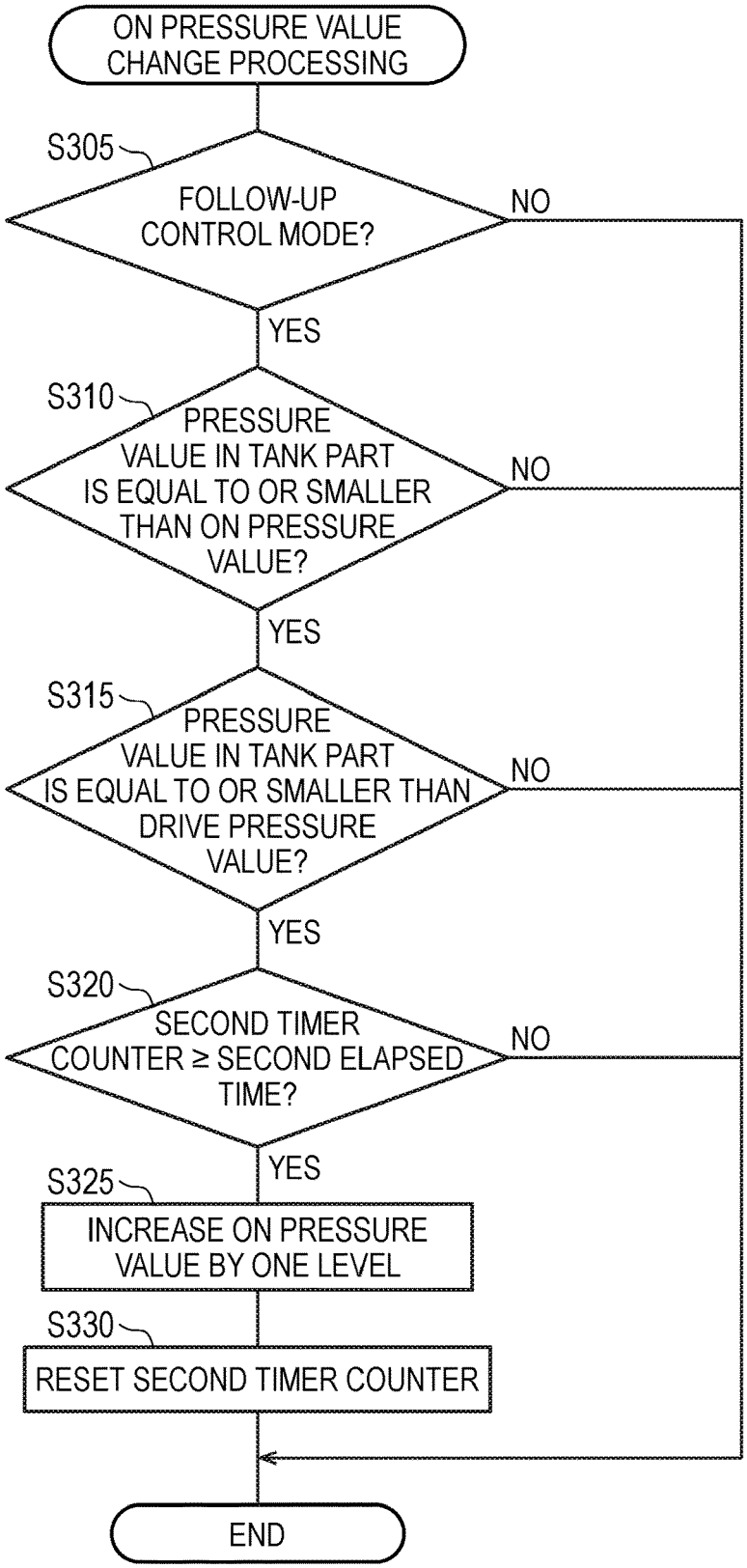
FIG. 5 is a flowchart of ON pressure value change processing of the first embodiment.

In the ON pressure value change processing, in step S305 shown in FIG. 5, it is checked whether the current operating mode is the follow-up control mode. When it is checked that the current operating mode is not the follow-up control mode, the ON pressure value change processing is over. On the other hand, when it is checked that the current operating mode is the follow-up control mode, the flow proceeds to step S310.

In step S310, the controller 30 acquires the pressure value in the tank part 15 detected by the pressure sensor 33, and checks whether the pressure value is equal to or smaller than the ON pressure value. When it is checked that the pressure value is not equal to or smaller than the ON pressure value, the ON pressure value change processing is over. On the other hand, when it is checked that the pressure value is equal to or smaller than the ON pressure value, the flow proceeds to step S315.

In step S315, the controller 30 acquires the pressure value in the tank part 15 detected by the pressure sensor 33, and checks whether the pressure value is equal to or smaller than the drive pressure value. When it is checked that the pressure value is not equal to or smaller than the drive pressure value, the ON pressure value change processing is over. On the other hand, when it is checked that the pressure value is equal to or smaller than the drive pressure value, the flow proceeds to step S320.

In step S320, the controller 30 refers to the second timer counter, and checks whether a value of the second timer counter is equal to or greater than the second elapsed time. When it is checked that the value of the second timer counter is not equal to or greater than the second elapsed time, the ON pressure value change processing is over. On the other hand, when it is checked that the value of the second timer counter is equal to or greater than the second elapsed time, it means that a time of a predetermined cycle (second elapsed time) has elapsed since the second timer counter was reset at last, and thus the flow proceeds to step S325.

When the flow proceeds to step S325, the controller 30 increases the ON pressure value by one level, according to a predetermined "change amount of the ON pressure value" (however, when the ON pressure value has reached the preset upper limit value, it is not increased beyond the upper limit value). Thereby, the level of the lowest pressure in the tank part 15 is increased by one level. Then, the flow proceeds to step S330.

In step S330, the controller 30 resets the second timer counter. Then, the ON pressure value change processing is over.

Subsequently, the OFF pressure value change processing is described with reference to FIG. 6. The OFF pressure value change processing is processing for stepwise increasing the OFF pressure value each time the continuous drive time of the motor 11 exceeds a predetermined time.

Figure 6:
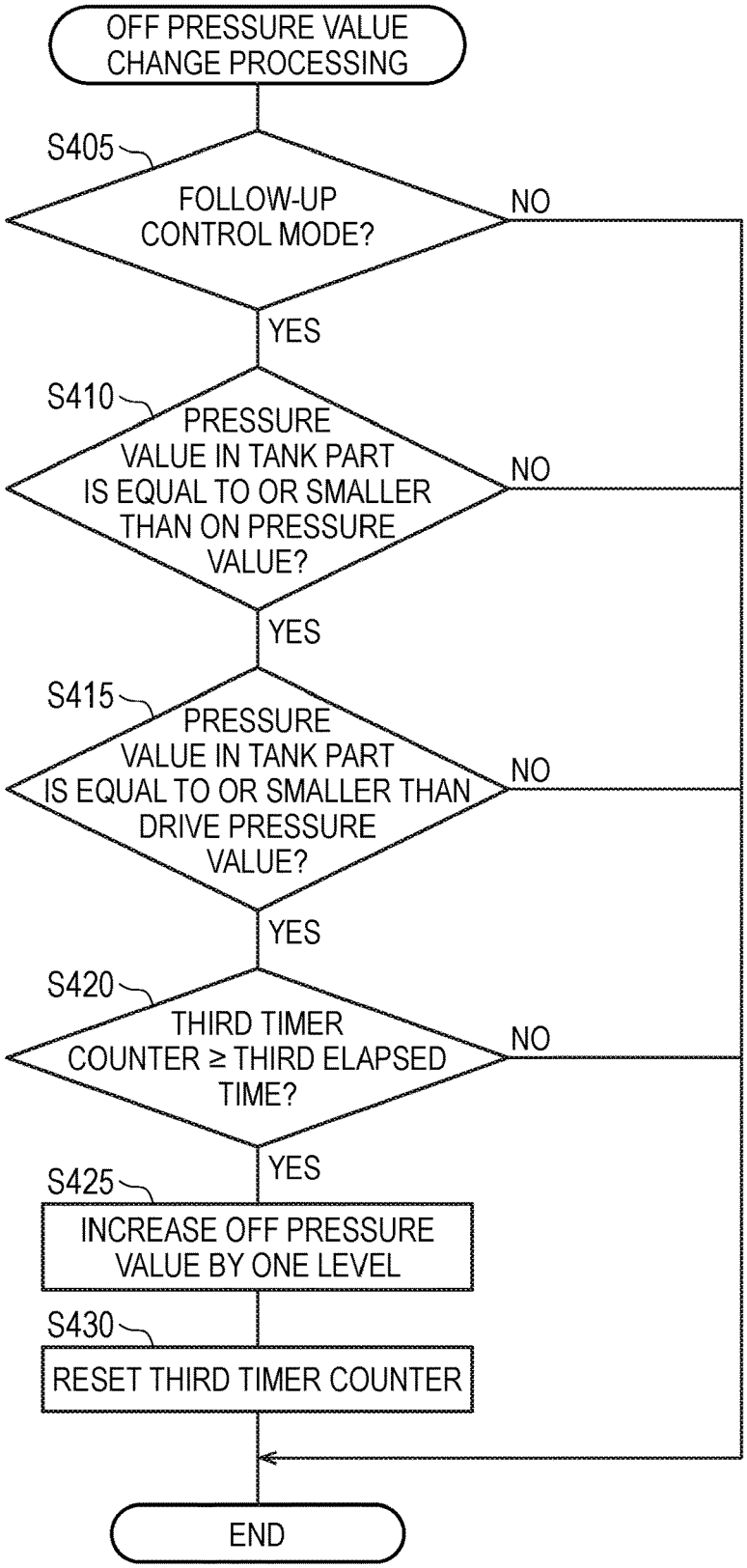
FIG. 6 is a flowchart of OFF pressure value change processing of the first embodiment.

In the OFF pressure value change processing, in step S405 shown in FIG. 6, it is checked whether the current operating mode is the follow-up control mode. When it is checked that the current operating mode is not the follow-up control mode, the OFF pressure value change processing is over. On the other hand, when it is checked that the current operating mode is the follow-up control mode, the flow proceeds to step S410.

In step S410, the controller 30 acquires the pressure value in the tank part 15 detected by the pressure sensor 33, and checks whether the pressure value is equal to or smaller than the ON pressure value. When it is checked that the pressure value is not equal to or smaller than the ON pressure value, the OFF pressure value change processing is over. On the other hand, when it is checked that the pressure value is equal to or smaller than the ON pressure value, the flow proceeds to step S415.

In step S415, the controller 30 acquires the pressure value in the tank part 15 detected by the pressure sensor 33, and checks whether the pressure value is equal to or smaller than the drive pressure value. When it is checked that the pressure value is not equal to or smaller than the drive pressure value, the OFF pressure value change processing is over. On the other hand, when it is checked that the pressure value is equal to or smaller than the drive pressure value, the flow proceeds to step S420.

In step S420, the controller 30 refers to the third timer counter, and checks whether a value of the third timer counter is equal to or greater than the third elapsed time. When it is checked that the value of the third timer counter is not equal to or greater than the third elapsed time, the OFF pressure value change processing is over. On the other hand, when it is checked that the value of the third timer counter is equal to or greater than the third elapsed time, it means that a time of a predetermined cycle (third elapsed time) has elapsed since the third timer counter was reset at last, and thus the flow proceeds to step S425.

When the flow proceeds to step S425, the controller 30 increases the OFF pressure value by one level, according to a predetermined "change amount of the OFF pressure value" (however, when the pressure value has reached the preset upper limit value, it is not increased beyond the upper limit value). Thereby, the level of the highest pressure in the tank part 15 is increased by one level. Then, the flow proceeds to step S430.

In step S430, the controller 30 resets the third timer counter. Then, the OFF pressure value change processing is over.

Subsequently, the change processing during drive stop is described with reference to FIG. 7. The change processing during drive stop is processing for stepwise decreasing the control current value, the ON pressure value and the OFF pressure value each time the continuous stop time of the motor 11 exceeds a predetermined time.

Figure 7:
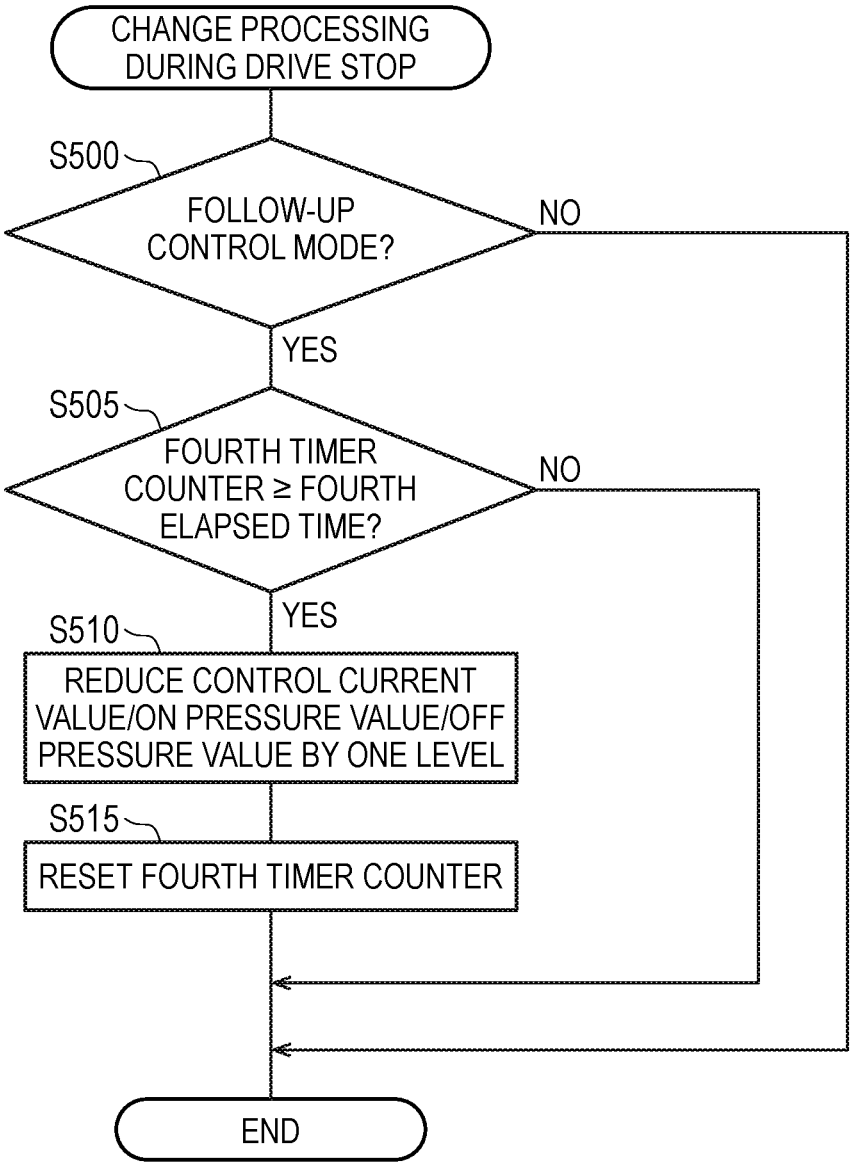
FIG. 7 is a flowchart of change processing during drive stop of the first embodiment.

In the change processing during drive stop, in step S500 of FIG. 7, it is checked whether the current operating mode is the follow-up control mode. When it is checked that the current operating mode is not the follow-up control mode, the change processing during drive stop is over. On the other hand, when it is checked that the current operating mode is the follow-up control mode the follow-up control mode, the flow proceeds to step S505.

In step S505, the controller 30 refers to the fourth timer counter, and checks whether a value of the fourth timer counter is equal to or greater than the fourth elapsed time. When it is checked that the value of the fourth timer counter is not equal to or greater than the fourth elapsed time, the change processing during drive stop is over. On the other hand, when it is checked that the value of the fourth timer counter is equal to or greater than the fourth elapsed time, it means that a time of a predetermined cycle (fourth elapsed time) has elapsed since the fourth timer counter was reset at last, and thus the flow proceeds to step S510.

When the flow proceeds to step S510, the controller 30 decreases the control current value, the ON pressure value and the OFF pressure value by one level, according to the predetermined "change amount of the control current value", "change amount of the ON pressure value" and "change amount of the OFF pressure value (however, when the values have reached the preset lower limit values, they are not decreased beyond the lower limit values). Then, the flow proceeds to step S515.

Note that, in step S510 of the present embodiment, the control current value, the ON pressure value and the OFF pressure value are decreased at the same time by one level. However, the present disclosure is not limited thereto. For example, the control current value, the ON pressure value and the OFF pressure value may also be changed at different time intervals.

In step S515, the controller 30 resets the fourth timer counter. Then, the change processing during drive stop is over.

By the main flow as described above, in the follow-up control mode, the controller 30 of the present embodiment is configured to execute the setting change processing for detecting the continuous drive time or the continuous stop time of the motor 11 and changing the ON pressure value and the OFF pressure value, and the output of the motor 11, based on the detected continuous drive time or the continuous stop time of the motor 11.

The controller 30 of the present embodiment can set the output of the motor 11 and the pressure in the tank part 15 with higher followability than the related art by automatically changing the execution cycle of the setting change processing. Specifically, the controller 30 is configured to calculate the change rate of the pressure value in the tank part 15, and to determine the execution cycle of the setting change processing, based on the change rate.

Figure 9:
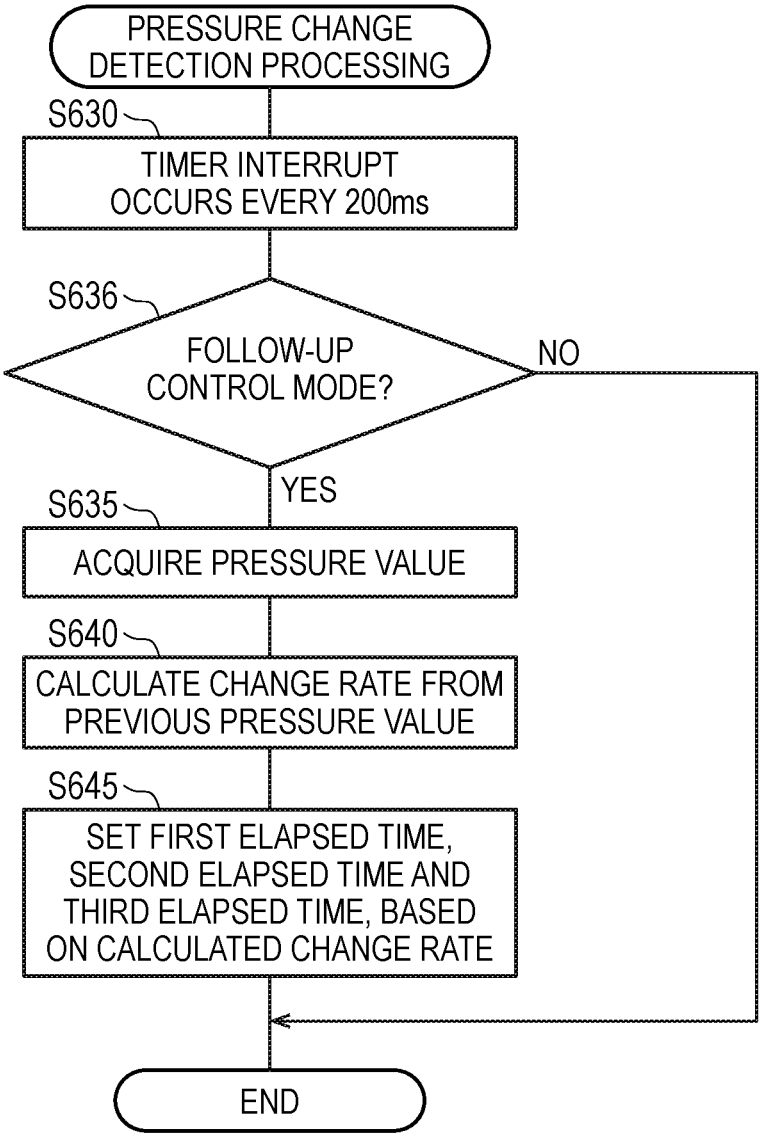
FIG. 9 is a flowchart of pressure change detection processing of the first embodiment.

The pressure change detection processing shown in FIG. 9 is processing for changing the execution cycle of the setting change processing. The pressure change detection processing is processing that is periodically called and executed by a timer interrupt that occurs every predetermined time (for example, 200 milliseconds).

The pressure change detection processing is started as the timer interrupt occurs with a preset cycle (for example, 200 milliseconds), as shown in step S630 of FIG. 9. Then, the flow proceeds to step S636.

In step S636, it is checked whether the current operating mode is the follow-up control mode. When it is checked that the current operating mode is not the follow-up control mode, the pressure change detection processing is over. On the other hand, when it is checked that the current operating mode is the follow-up control mode, the flow proceeds to step S635.

In step S635, the controller 30 acquires the pressure value in the tank part 15 detected by the pressure sensor 33. Note that, the acquired pressure value is stored in the memory so that it can be referred to in at least next pressure change detection processing. Then, the flow proceeds to step S640.

In step S640, the pressure value acquired in step S635 and the pressure value (the pressure value stored in the memory) acquired in the previous change detection processing are compared, and a change rate of the pressure value in the tank part 15 is calculated. Note that, in the present embodiment, the change rate is calculated by the pressure values of the two pressure change detection processing. However, the method of calculating the change rate is not limited thereto, and any method may be selected. Then, the flow proceeds to step S645.

In step S645, the first elapsed time, the second elapsed time and the third elapsed time are set based on the pressure change rate calculated in step S640. For example, a cycle designation table as shown in FIG. 10 is stored in advance in the storage device of the air compressor 10, and the first elapsed time, the second elapsed time and the third elapsed time are set using the cycle designation table.

In the cycle designation table of FIG. 10, the pressure change rate is divided into four levels of "low", "middle", "high" and "highest", and the pressure change rate is greater in order of "low"<"middle"<"high"<"highest" (this division is exemplary, and the number of divisions can be arbitrarily set).

When the pressure change rate calculated in step S640 belongs to the division "low" (i.e., belongs to the division in which the pressure change rate is smallest), the first elapsed time, the second elapsed time and the third elapsed time are set so that the execution cycle of the setting change processing is longest. Specifically, the first elapsed time is set to 2 seconds, the second elapsed time is set to 20 seconds, and the third elapsed time is set to 20 seconds. Thereby, a setting by which the output of the motor 11 and the pressure in the tank part 15 gradually increase is made.

When the pressure change rate calculated in step S640 belongs to the division "middle" (i.e., belongs to the division in which the pressure change rate is second smallest), the first elapsed time, the second elapsed time and the third elapsed time are set so that the execution cycle of the setting change processing is shorter than the division "low". Specifically, the first elapsed time is set to 1 second, the second elapsed time is set to 10 seconds, and the third elapsed time is set to 10 seconds. Thereby, a setting by which the output of the motor 11 and the pressure in the tank part 15 increase further rapidly than the division "low" is made.

When the pressure change rate calculated in step S640 belongs to the division "high" (i.e., belongs to the division in which the pressure change rate is third smallest), the first elapsed time, the second elapsed time and the third elapsed time are set so that the execution cycle of the setting change processing is shorter than the division "middle". Specifically, the first elapsed time is set to 0.75 second, the second elapsed time is set to 7.5 seconds, and the third elapsed time is set to 7.5 seconds. Thereby, a setting by which the output of the motor 11 and the pressure in the tank part 15 increase further rapidly than the division "middle" is made.

When the pressure change rate calculated in step S640 belongs to the division "highest" (i.e., belongs to the division in which the pressure change rate is largest), the first elapsed time, the second elapsed time and the third elapsed time are set so that the execution cycle of the setting change processing is shorter than the division "high". Specifically, the first elapsed time is set to 0.5 second, the second elapsed time is set to 5 seconds, and the third elapsed time is set to 5 seconds. Thereby, a setting by which the output of the motor 11 and the pressure in the tank part 15 increase most rapidly is made.

In this way, the execution cycle of the setting change processing is set so that it becomes shorter as the pressure change rate becomes greater. Thereby, it is possible to improve the followability of the compression mechanism actuation with respect to the air consumption.

Figure 11A:
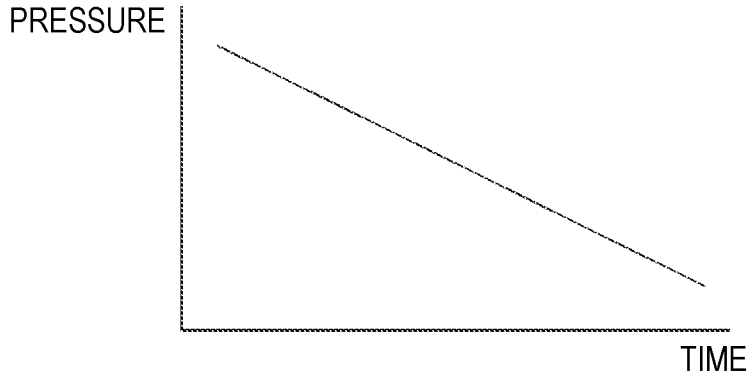
FIG. 11A depicts a relation between a pressure and a time in the first embodiment.
Figure 11B:
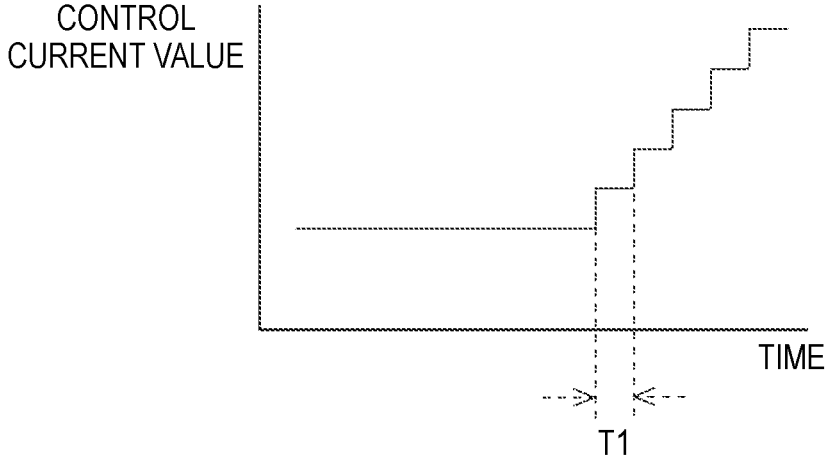
FIG. 11B depicts a relation between a control current value and a time in the first embodiment.
Figure 11C:
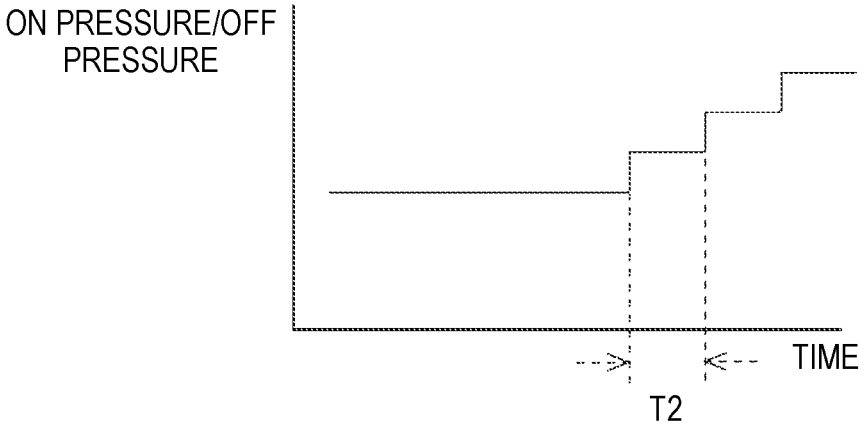

For example, as shown in FIG. 11A, when the pressure value in the tank part 15 is reduced relatively rapidly (the air consumption is large), the pressure change rate becomes large. In this case, since the execution cycle of the setting change processing becomes short, the control current value and the ON pressure value and OFF pressure value are increased at fast paces, as shown in FIGS. 11B and 11C (a timing interval in which the value is increased is relatively short, as shown with T1 and T2). Therefore, even when the air consumption increases rapidly, the output of the motor 11 is correspondingly increased at the fast pace and the level of the internal pressure in the tank is also increased at the fast pace.

Figure 12A:
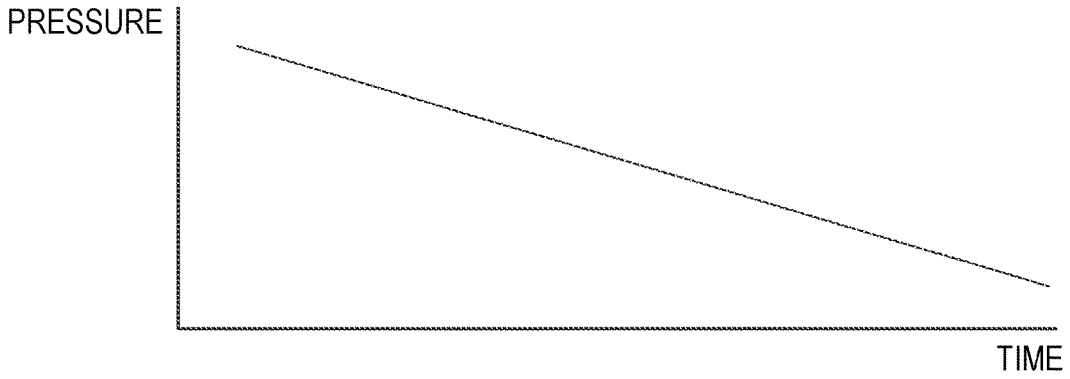
FIG. 12A depicts a relation between the pressure and the time in the first embodiment.
Figure 12B:
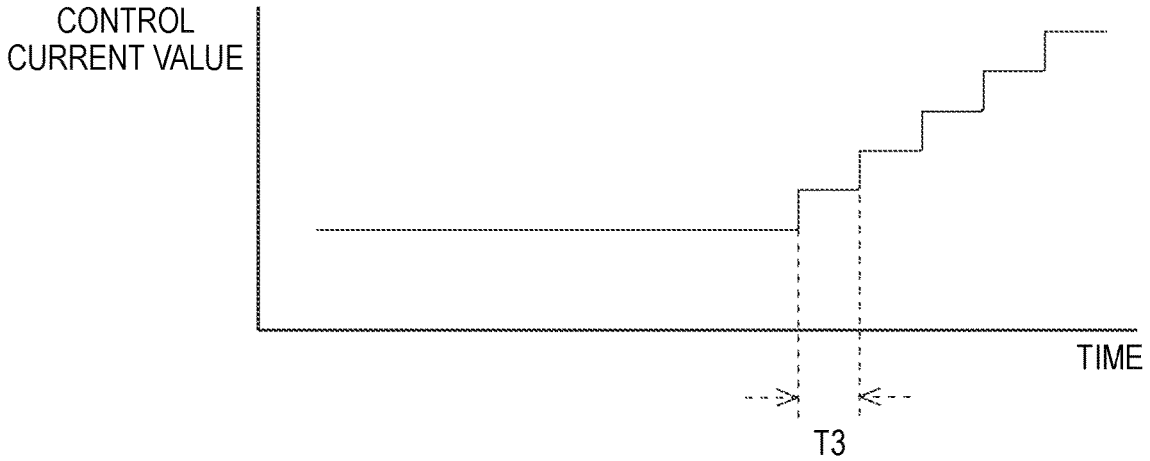
FIG. 12B depicts a relation between the control current value and the time in the first embodiment.
Figure 12C:
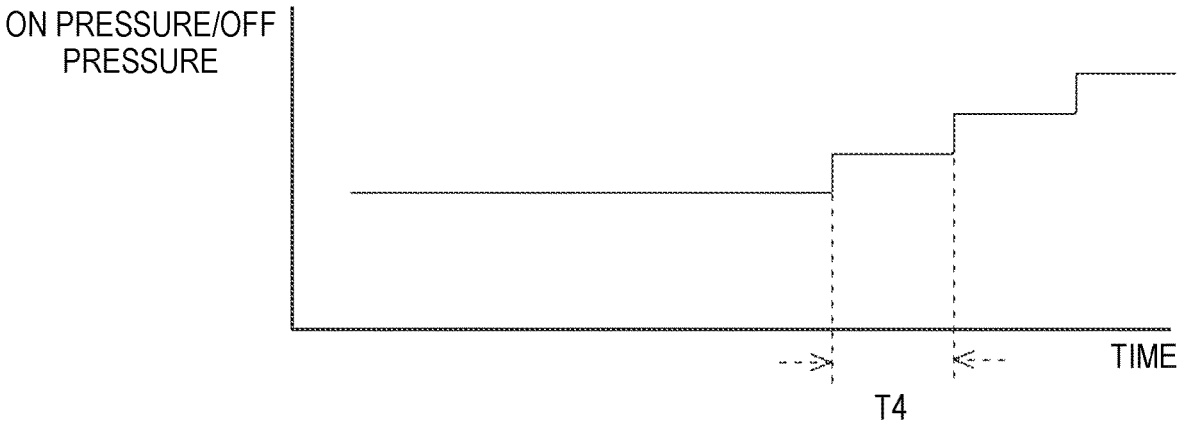
FIG. 12C depicts a relation between the ON pressure value or OFF pressure value and the time when the change rate in pressure is small in the first embodiment.

In contrast, as shown in FIG. 12A, when the pressure value in the tank part 15 is reduced relatively gently (the air consumption is small), the pressure change rate becomes small. In this case, since the execution cycle of the setting change processing becomes long, the control current value and the ON pressure value and OFF pressure value are increased at slow paces, as shown in FIGS. 12B and 12C (a timing interval in which the value is increased is relatively long, as shown with T3 and T4). Therefore, even when the air consumption increases slowly, the output of the motor 11 is correspondingly gently increased and the level of the internal pressure in the tank is also gently increased.

As described above, according to the present embodiment, the controller 30 can execute the setting change processing for detecting the continuous drive time or the continuous stop time of the motor 11, and changing the ON pressure value, the OFF pressure value and the output of the motor 11, based on the continuous drive time or the continuous stop time. The controller 30 also calculates the change rate of the pressure value in the tank part 15, and determines the execution cycle of the setting change processing, based on the change rate.

According to the above configuration, since it is possible to change the execution cycle of the setting change processing by the consumption of compressed air, it is possible to automatically set the output of the motor 11 and the pressure in the tank part 15 with higher followability than the related art.

For example, when the change in pressure in the tank part 15 is large, it is possible to change the output of the motor 11 and the pressure in the tank part 15, in sensitive response to the change in pressure in the tank part 15. In contrast, when the change in pressure in the tank part 15 is small, it is possible to change the output of the motor 11 and the pressure in the tank part 15, in gentle response to the change in pressure in the tank part 15.

Specifically, when the air compressor 10 is used for a large-sized nailing machine in which the compressed air is instantaneously used or an impact wrench in which the compressed air is continuously used, for example, the pressure in the tank part 15 is largely dropped. When a change rate of the pressure value in the tank part 15 is high, it is possible to rapidly increase the output of the motor 11 and the pressure in the tank part 15 by shortening the execution cycle of the setting change processing. That is, it is possible to prevent deficiency of compressed air by higher followability than the related art.

In contrast, when the air compressor 10 is used for a tool such as an air tacker in which the compressed air is not consumed so much, the lowering in pressure in the tank part 15 is small. When the change rate of the pressure value in the tank part 15 is small, it is possible to gently increase the output of the motor 11 and the pressure in the tank part 15 by prolonging the execution cycle of the setting change processing. The increases in the output of the motor 11 and the pressure in the tank part 15 are suppressed, so that it is possible to suppress the load from increasing. That is, it is possible to suppress the noise, the power consumption and the consumption of a component by the higher followability than the related art.

Note that, in the present embodiment, the pressure change rate is calculated with reference to the pressure value in the tank part 15. However, the present disclosure is not limited thereto. For example, the pressure change rate may also be estimated using the air consumption or a valve flow rate.

(Modified Embodiments of First Embodiment)

In the first embodiment, the execution cycle of the setting change processing is changed by the consumption of compressed air. However, the present disclosure is not limited thereto. For example, the change amount of the value in the setting change processing may also be determined by the consumption of compressed air.

In the below, a modified embodiment of the first embodiment, in which the change amount of the value in the setting change processing is determined by the consumption of compressed air is described with reference to FIGS. 13 to 16. Note that, since the basic configuration of the present modified embodiment is not different from the first embodiment, the overlapping descriptions are omitted and only differences are described.

Figure 13:
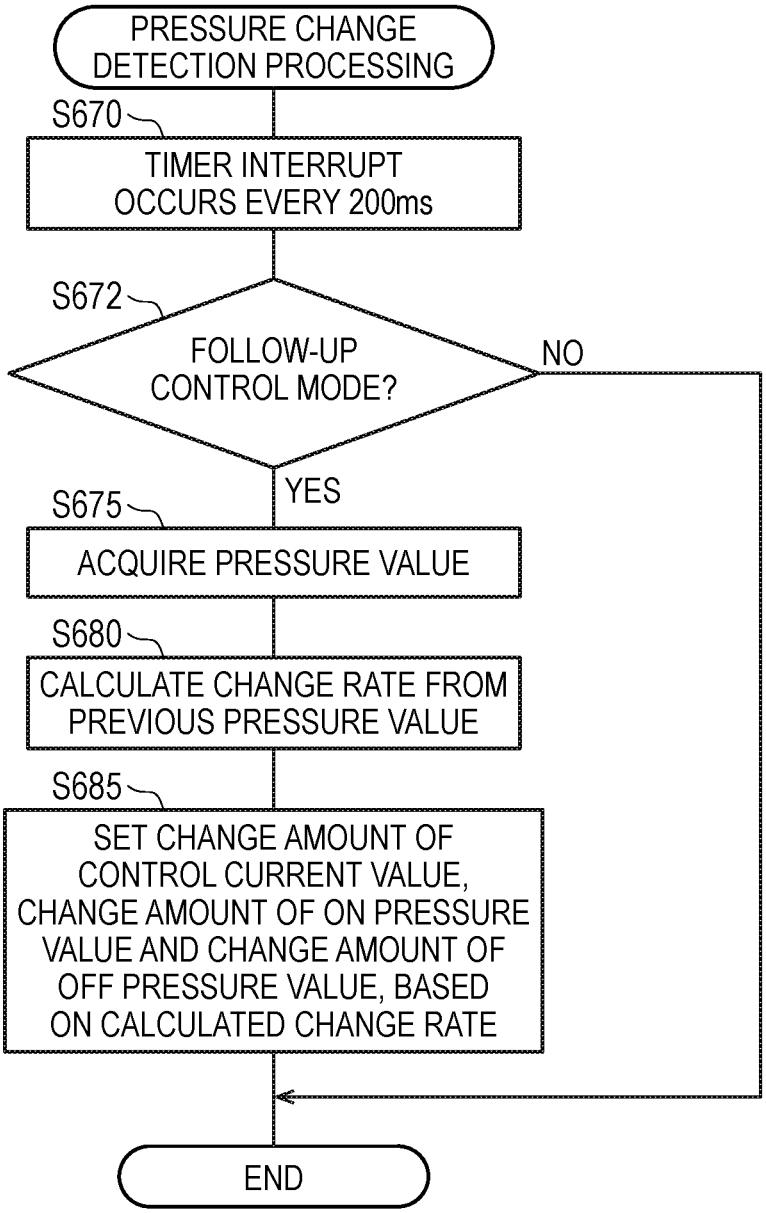
FIG. 13 is a flowchart of pressure change detection processing of a modified embodiment of the first embodiment.

In the present modified embodiment, instead of the pressure change detection processing FIG. 9, pressure change detection processing shown in FIG. 13 is executed. The pressure change detection processing shown in FIG. 13 is processing that is periodically called and executed by the timer interrupt that occurs with a predetermined cycle (for example, every 200 milliseconds), similarly to the pressure change detection processing shown in FIG. 9.

The pressure change detection processing is started as the timer interrupt occurs every predetermined time (for example 200 milliseconds), as shown in step S670 of FIG. 13. Then, the flow proceeds to step S672.

In step S672, it is checked whether the current operating mode is the follow-up control mode. When it is checked that the current operating mode is not the follow-up control mode, the pressure change detection processing is over. On the other hand, when it is checked that the current operating mode is the follow-up control mode, the flow proceeds to step S675.

In step S675, the controller 30 acquires the pressure value in the tank part 15 detected by the pressure sensor 33. Note that, the acquired pressure value is stored in the memory so that it can be referred to in at least next pressure change detection processing. Then, the flow proceeds to step S680.

In step S680, the pressure value acquired in step S675 and the pressure value (the pressure value stored in the memory) acquired in the previous change detection processing are compared, and a change rate of the pressure value in the tank part 15 is calculated. Note that, in the present modified embodiment, the change rate is calculated by the pressure values of the two pressure change detection processing. However, the method of calculating the change rate is not limited thereto, and any method may be selected. Then, the flow proceeds to step S685.

In step S685, the change amount of the control current value, the change amount of the ON pressure value and the change amount of the OFF pressure value are set based on the pressure change rate calculated in step S680. For example, a change amount designation table as shown in FIG. 14 is stored in advance in the storage device of the air compressor 10, and the change amount of the control current value, the change amount of the ON pressure value and the change amount of the OFF pressure value are set using the change amount designation table. The change amounts set here are each used as a unit of variation (a change amount of one level) in processing (control current value change processing, ON pressure value change processing, OFF pressure value change processing and change processing during drive stop) of varying stepwise the control current value, the ON pressure value and the OFF pressure value.

In the change amount designation table of FIG. 14, the pressure change rate is divided into four levels of "low", "middle", "high" and "highest", and the pressure change rate is greater in order of "low"<"middle"<"high"<"highest" (this division is exemplary, and the number of divisions can be arbitrarily set).

When the pressure change rate calculated in step S680 belongs to the division "low" (i.e., belongs to the division in which the pressure change rate is smallest), the change amount of the control current value, the change amount of the ON pressure value and the change amount of the OFF pressure value are set so that the change amount of the value in the setting change processing is smallest. Specifically, the change amount of the control current value is set to 0.05 A, the change amount of the ON pressure value is set to 0.05 MPa, and the change amount of the OFF pressure value is set to 0.05 MPa. Thereby, a setting by which the output of the motor 11 and the pressure in the tank part 15 gradually increase is made.

When the pressure change rate calculated in step S680 belongs to the division "middle" (i.e., belongs to the division in which the pressure change rate is second smallest), the change amount of the control current value, the change amount of the ON pressure value and the change amount of the OFF pressure value are set so that the change amount of the value in the setting change processing is larger than the division "low". Specifically, the change amount of the control current value is set to 0.1 A, the change amount of the ON pressure value is set to 0.1 MPa, and the change amount of the OFF pressure value is set to 0.1 MPa. Thereby, a setting by which the output of the motor 11 and the pressure in the tank part 15 increase further rapidly than the division "low" is made.

When the pressure change rate calculated in step S680 belongs to the division "high" (i.e., belongs to the division in which the pressure change rate is third smallest), the change amount of the control current value, the change amount of the ON pressure value and the change amount of the OFF pressure value are set so that the change amount of the value in the setting change processing is larger than the division "middle". Specifically, the change amount of the control current value is set to 0.2 A, the change amount of the ON pressure value is set to 0.2 MPa, and the change amount of the OFF pressure value is set to 0.2 MPa. Thereby, a setting by which the output of the motor 11 and the pressure in the tank part 15 increase further rapidly than the division "middle" is made.

When the pressure change rate calculated in step S680 belongs to the division "highest" (i.e., belongs to the division in which the pressure change rate is largest), the change amount of the control current value, the change amount of the ON pressure value and the change amount of the OFF pressure value are set so that the change amount of the value in the setting change processing is larger than the division "high". Specifically, the change amount of the control current value is set to 0.3 A, the change amount of the ON pressure value is set to 0.3 MPa, and the change amount of the OFF pressure value is set to 0.3 MPa. Thereby, a setting by which the output of the motor 11 and the pressure in the tank part 15 increase most rapidly is made.

In this way, the change amount of the value in the setting change processing is set so that it becomes larger as the pressure change rate becomes greater. Thereby, it is possible to improve the followability of the compression mechanism actuation with respect to the air consumption.

Figure 15A:
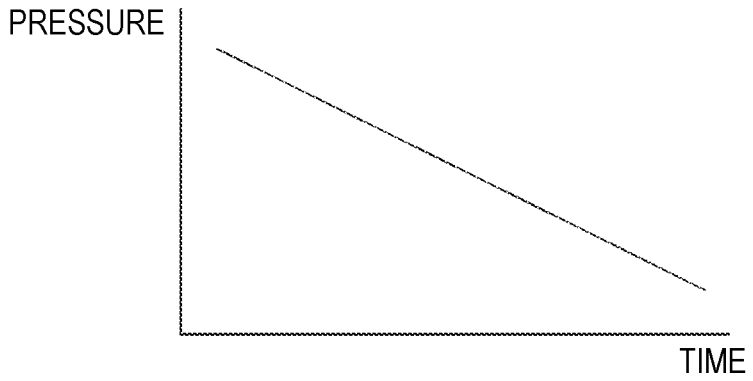
FIG. 15A depicts a relation between a pressure and a time in the modified embodiment of the first embodiment.
Figure 15B:
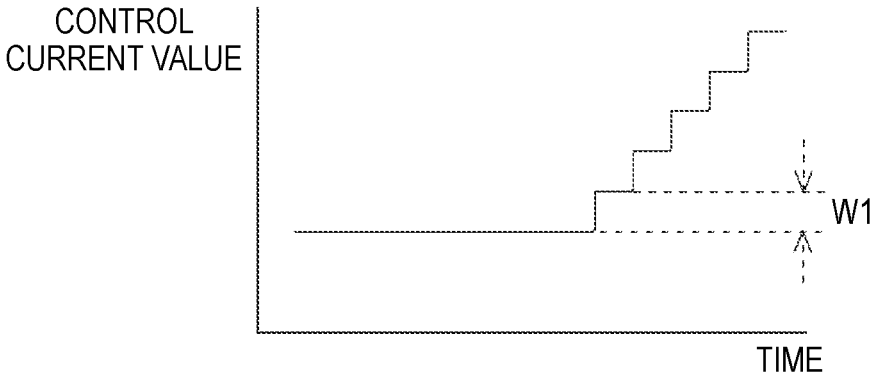
FIG. 15B depicts a relation between a control current value and a time in the modified embodiment of the first embodiment.
Figure 15C:
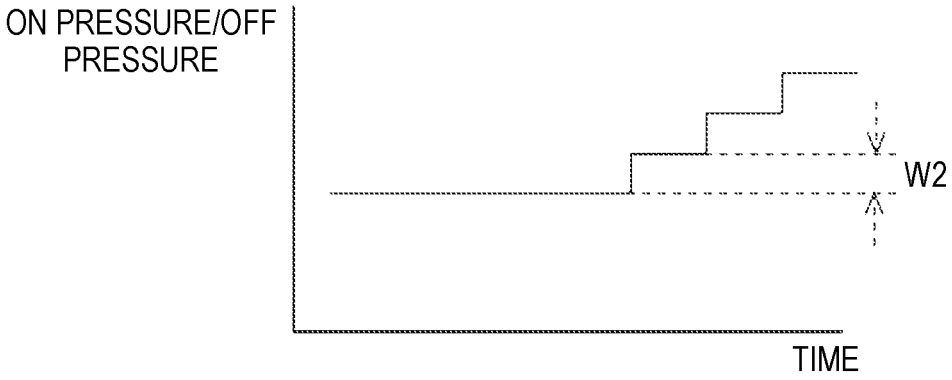
FIG. 15C depicts a relation between an ON pressure value or an OFF pressure value and a time when a change rate in pressure is large in the modified embodiment of the first embodiment.

For example, as shown in FIG. 15A, when the pressure value in the tank part 15 is reduced relatively rapidly (the air consumption is large), the pressure change rate becomes large. In this case, since the change amount (refer to W1 and W2) of the value in the setting change processing becomes large, the control current value and the ON pressure value and OFF pressure value are increased at fast paces, as shown in FIGS. 15B and 15C. Therefore, even when the air consumption increases rapidly, the output of the motor 11 is correspondingly increased at the fast pace and the level of the internal pressure in the tank is also increased at the fast pace.

Figure 16A:
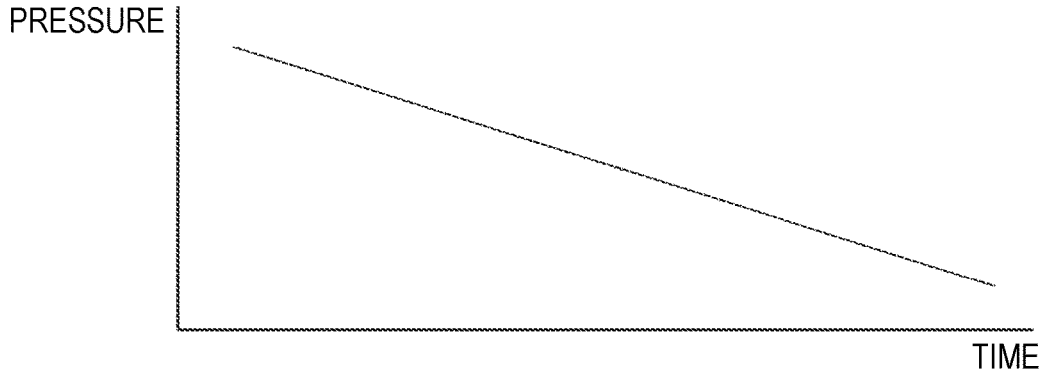
FIG. 16A depicts a relation between the pressure and the time in the modified embodiment of the first embodiment.
Figure 16B:
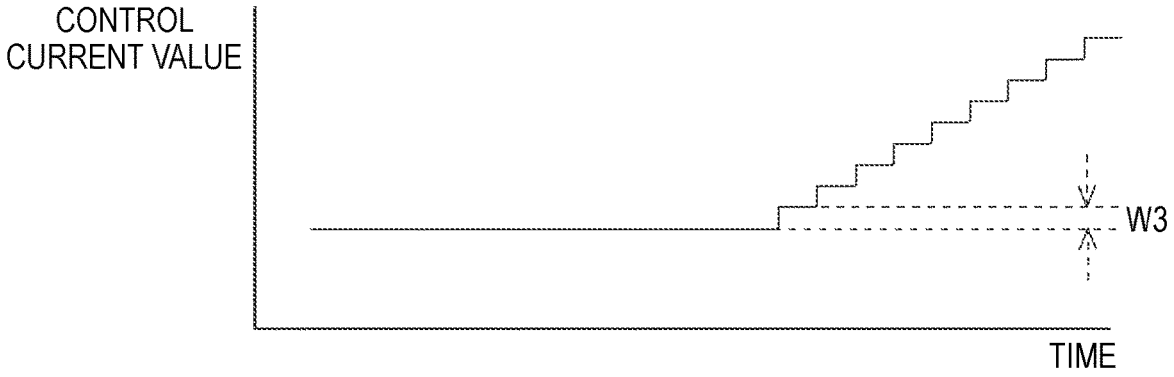
FIG. 16B depicts a relation between the control current value and the time in the modified embodiment of the first embodiment.
Figure 16C:
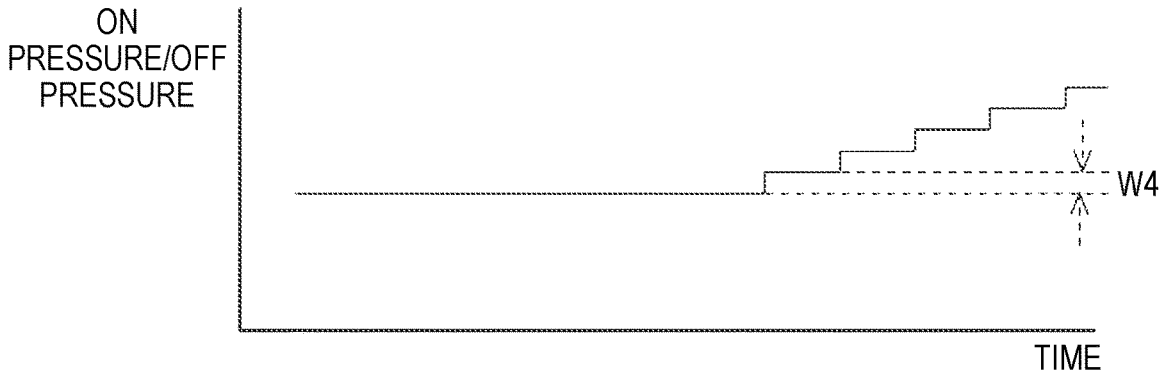
FIG. 16C depicts a relation between the ON pressure value or OFF pressure value and the time when the change rate in pressure is small in the modified embodiment of the first embodiment.

In contrast, as shown in FIG. 16A, when the pressure value in the tank part 15 is reduced relatively gently (the air consumption is small), the pressure change rate becomes small. In this case, since the change amount (refer to W1 and W2) of the value in the setting change processing is small, the control current value and the ON pressure value and OFF pressure value are increased at slow paces, as shown in FIGS. 16B and 16C. Therefore, when the air consumption increases slowly, the output of the motor 11 is correspondingly gently increased and the level of the internal pressure in the tank is also gently increased.

As described above, according to the present modified embodiment, the controller 30 calculates the change rate of the pressure value in the tank part 15, and determines the change amount of the value in the setting change processing, based on the change rate.

According to the above configuration, since it is possible to change the change amount of the value in the setting change processing by the consumption of compressed air, it is possible to implement the higher followability than the related art.

For example, when the change in pressure in the tank part 15 is large, it is possible to change the output of the motor 11 and the pressure in the tank part 15, in sensitive response to the change in pressure in the tank part 15. In contrast, when the change in pressure in the tank part 15 is small, it is possible to change the output of the motor 11 and the pressure in the tank part 15, in gentle response to the change in pressure in the tank part 15.

(Other Modified Embodiments of First Embodiment)

In the first embodiment, the change rate of the pressure value in the tank part 15 is calculated, and the execution cycle of the setting change processing with respect to the three parameters (the ON pressure value, the OFF pressure value and the output of the motor 11) is determined based on the change rate. In the modified embodiment of the first embodiment, the change rate of the pressure value in the tank part 15 is calculated, and the change amount of the value in the setting change processing with respect to the three parameters (the ON pressure value, the OFF pressure value and the output of the motor 11) is determined based on the change rate. However, the present disclosure is not limited thereto. For example, the execution cycle of the setting change processing or the change amount of the value in the setting change processing may be determined so that only two or one of the three parameters is affected.

In the first embodiment and the modified embodiment, the change rate of the pressure value in the tank part 15 is calculated, and any one of the execution cycle of the setting change processing or the change amount of the value in the setting change processing is determined based on the change rate. However, the present disclosure is not limited thereto. For example, the execution cycle of the setting change processing and the change amount of the value in the setting change processing may also be determined based on the change rate of the pressure value. That is, both the pressure change detection processing described with reference to FIG. 9 and the pressure change detection processing described with reference to FIG. 13 may be executed.

Second Embodiment

A second embodiment of the present disclosure is described with reference to FIGS. 17 and 18. Note that, since the basic configuration of the present embodiment is not different from the first embodiment, the overlapping descriptions are omitted and only differences are described.

Figure 17:
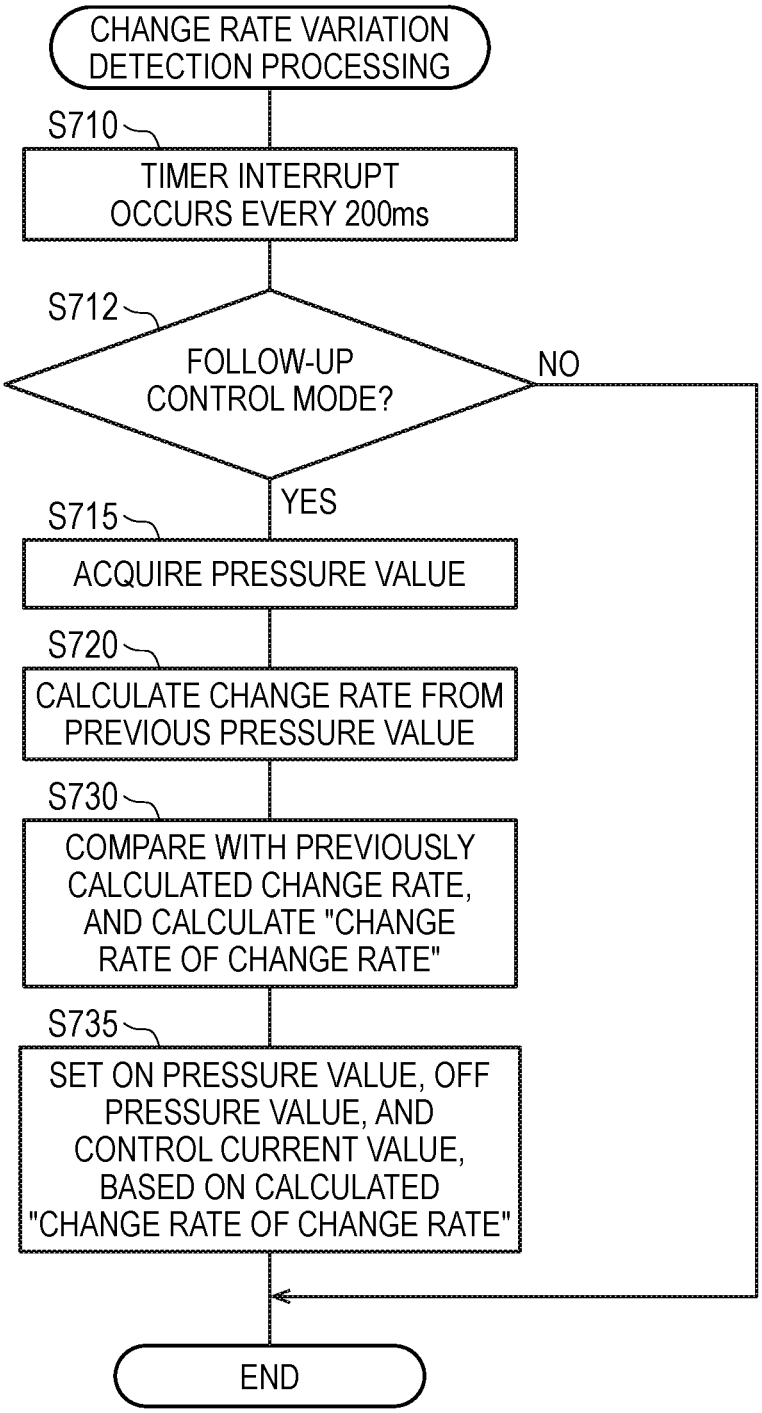
FIG. 17 is a flowchart of change rate variation detection processing of a second embodiment.

The present embodiment is characterized in that change rate variation detection processing shown in FIG. 17 is executed. The change rate variation detection processing may be executed instead of the pressure change detection processing described with reference to FIG. 9 or may be executed in addition to the pressure change detection processing described with reference to FIG. 9 (in parallel to the pressure change detection processing at the same time). The change rate variation detection processing is processing that is periodically called and executed by the timer interrupt that occurs every predetermined time (for example, 200 milliseconds).

As shown in step S710 of FIG. 17, the change rate variation detection processing is started as the timer interrupt occurs with a preset cycle (for example, every 200 milliseconds). The, the flow proceeds to step S712.

In step S712, it is checked whether the current operating mode is the follow-up control mode. When it is checked that the current operating mode is not the follow-up control mode, the pressure change detection processing is over. On the other hand, when it is checked that the current operating mode is the follow-up control mode, the flow proceeds to step S715.

In step S715, the controller 30 acquires the pressure value in the tank part 15 detected by the pressure sensor 33. Note that, the acquired pressure value is stored in the memory so that it can be referred to in at least next pressure change detection processing. Then, the flow proceeds to step S720.

In step S720, the pressure value acquired in step S715 and the pressure value (the pressure value stored in the memory) acquired in the previous change detection processing are compared, and a change rate of the pressure value in the tank part 15 is calculated. Note that, in the present modified embodiment, the change rate is calculated by the pressure values of the two pressure change detection processing. However, the method of calculating the change rate is not limited thereto, and any method may be selected. The calculated change rate is stored in the memory so that it can be referred to in at least next pressure change detection processing. Then, the flow proceeds to step S730.

In step S730, the pressure change rate calculated in step S720 and the pressure change rate (the pressure change rate stored in the memory) calculated in the previous pressure change detection processing are compared to calculate a "change rate of the change rate". In the present modified embodiment, the "change rate of the change rate" is calculated by the change rates of the two pressure change detection processing. However, the method of calculating the "change rate of the change rate" is not limited thereto, and any method may be selected. For example, since the pressure change rate (a speed of the pressure change) indicates a magnitude of a flow rate of air flowing out from the tank part 15, the calculation of the "change rate of the pressure change rate" has the same meaning as the detection of a "change in flow rate". For this reason, instead of implementing the above-described calculation method, a flow rate of air flowing out from the tank part 15 may be detected using a flowmeter to calculate a "change in flow rate", and the "change in flow rate" may be used as the "change rate of the pressure change rate". Then, the flow proceeds to step S735.

In step S735, when the "change rate of the change rate" calculated in step S730 satisfies a predetermined condition, the controller 30 changes at least one of the control current value, the ON pressure value and the OFF pressure value.

For example, as shown in FIG. 18, when the "change rate of the change rate" is smaller than a predetermined threshold value, i.e., when the change rate does not vary largely, or when the change rate varies in a minus direction, the control current value, the ON pressure value and the OFF pressure value may not be changed.

On the other hand, when the "change rate of the change rate" is larger than the predetermined threshold value, i.e., when the change rate varies largely (the air consumption rapidly increases), the control current value, the ON pressure value and the OFF pressure value may be changed to the initial values (however, when the original control current value, ON pressure value and OFF pressure value are larger than the initial values, the control current value, the ON pressure value and the OFF pressure value may not be changed).

By the above-described setting, even when the air consumption rapidly increases (after returning from the break, a tool where the air consumption is large is used, for example) from a state where the control current value, the ON pressure value and the OFF pressure value are reduced to the lowest values in the follow-up control mode (for example, a case where the air compressor 10 is left unused due to break time and the like), the "change rate of the change rate" is detected, so that the rapid increase in change rate can be detected. When the rapid increase in change rate is detected, the control current value, the ON pressure value and the OFF pressure value reduced to the lowest values are rapidly returned to the initial values, so that it is possible to prevent the deficiency of compressed air in advance.

As described above, the controller 30 of the second embodiment calculates the change rate of the pressure value in the tank part 15, compares the same with the previously calculated change rate of the pressure value in the tank part 15, and changes at least one of the ON pressure value, the OFF pressure value and the output of the motor 11 when the comparison results satisfies a predetermined condition.

According to the above configuration, when the change rate rapidly changes, the output of the motor 11 and the pressure in the tank part 15 can be set by control different from the usual control, so that it is possible to automatically set the output of the motor 11 and the pressure in the tank part 15 with higher followability than the related art.

For example, in the air compressor 10 of the related art, when the state where the compressed air is not consumed for a predetermined time due to the break time and the like continues, the ON pressure value, the OFF pressure value and the output of the motor 11 are reduced to the settable lowest values. When the operation is started in this state and the compressed air is thus rapidly used, the compressed air may be deficient due to the setting of suppressing the pressure in the tank part 15 low. That is, since the output of the motor 11, the ON pressure value and the OFF pressure value are gradually (stepwise) increased from a state where the setting values thereof are small, it takes time until a discharge amount suitable for the consumption is obtained. In this respect, according to the present embodiment, it is possible to change at least one of the ON pressure value, the OFF pressure value and the output of the motor 11, according to the variation in pressure change rate after the drive start.

Specifically, when the compressed air is rapidly used after return from the break, as described above, the change rate of the pressure value rapidly increases. By detecting the large variation in change rate and changing the ON pressure value, the OFF pressure value and the output of the motor 11, the output of the motor 11 and the pressure in the tank part 15 can be rapidly increased, so that the followability is improved, as compared to the related art.

Note that, in the present embodiment, the ON pressure value, the OFF pressure value and the output of the motor 11 are all changed based on the "change rate of the change rate". However, the present disclosure is not limited thereto. For example, at least one of the ON pressure value, the OFF pressure value and the output of the motor 11 may be changed.

In the present embodiment, the ON pressure value, the OFF pressure value and the output of the motor 11 are individually changed based on the "change rate of the change rate". However, the present disclosure is not limited thereto. For example, the ON pressure value, the OFF pressure value and the output of the motor 11 may be changed by switching the operating mode. That is, the ON pressure value, the OFF pressure value and the output of the motor 11 may be each stored associated with a plurality of operating modes prepared in advance, and the operating mode may be switched based on the "change rate of the change rate".

When the "change rate of the change rate" is larger than the predetermined threshold value, the ON pressure value, the OFF pressure value and the output of the motor 11 are changed to the initial values. However, the present disclosure is not limited thereto. For example, the ON pressure value, the OFF pressure value and the output of the motor 11 may be stepwise changed using a plurality of threshold values. In addition, the ON pressure value, the OFF pressure value and the output of the motor 11 are not necessarily required to be changed to the initial values, and may be changed to values larger or smaller than the initial values.

The second embodiment can be implemented separately from the first embodiment and the modified embodiments thereof and can also be implemented in combination with the first embodiment and the modified embodiments thereof.

Third Embodiment

A third embodiment of the present disclosure is described with reference to FIGS. 19 and 20. Note that, since the basic configuration of the present embodiment is not different from the first embodiment, the overlapping descriptions are omitted and only differences are described.

Figure 19:
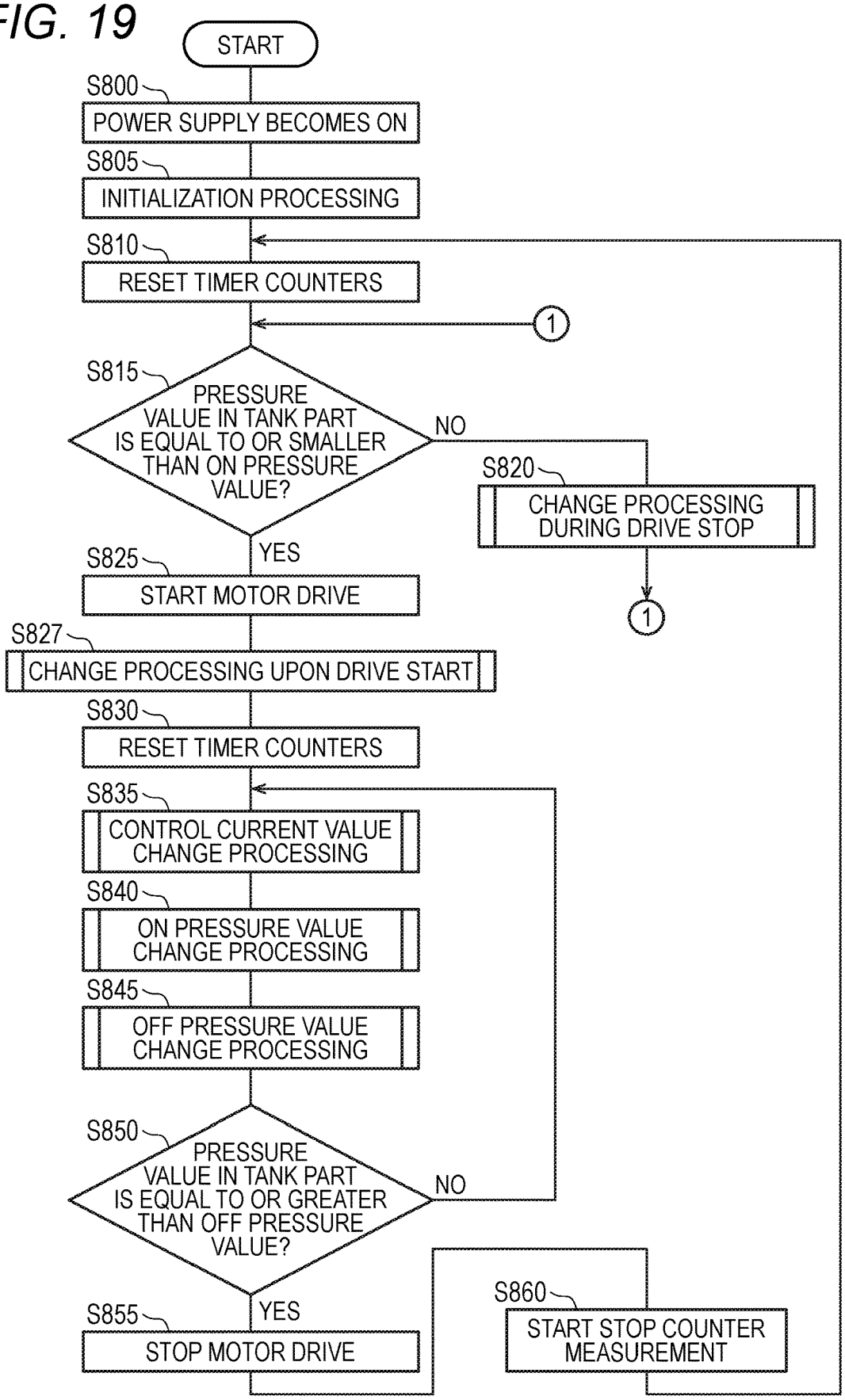
FIG. 19 is a main flowchart of an air compressor of a third embodiment.

In the present embodiment, a main flow shown in FIG. 19 is executed instead of the main flow described with reference to FIG. 3. The main flow shown in FIG. 19 is different from the main flow shown in FIG. 3, in that "change processing upon drive start" of step S827 and "stop counter measurement start" of step S860 are added.

That is, in step S800 of FIG. 19, the power supply switch 31 is operated, so that the power supply becomes on. Then, the main flow proceeds to step S805.

In step S805, the diverse parameters are initialized by the controller 30. Then, the main flow proceeds to step S810.

In step S810, the controller 30 resets the timer counters. Then, the main flow proceeds to step S815.

In step S815, the controller 30 acquires the pressure value in the tank part 15 detected by the pressure sensor 33, and checks whether the pressure value is equal to or smaller than the ON pressure value. When it is checked that the pressure value is equal to or smaller than the ON pressure value, the main flow proceeds to step S825. On the other hand, when it is checked that the pressure value is not equal to or smaller than the ON pressure value, the main flow proceeds to step S820.

When the main flow proceeds to step S820, the motor 11 is still in the stop state because the motor 11 is under stop and the pressure value in the tank part 15 is not equal to or smaller than the ON pressure value (the pressure in the tank part 15 is sufficient). In this case, change processing during drive stop, which will be described later, is executed. Thereafter, the main flow returns to step S815.

On the other hand, when the main flow proceeds to step S825, the controller 30 performs control of starting the drive of the motor 11 because the motor 11 is under stop and the pressure value in the tank part 15 is equal to or smaller than the ON pressure value (the pressure in the tank part 15 is insufficient). At this time, the output of the motor 11 is controlled by the set control current value. Then, the main flow proceeds to step S827.

In step S827, the change processing upon drive start, which will be described later, is executed. Then, the main flow proceeds to step S830.

In step S830, all the timer counters are reset. Then, the main flow proceeds to step S835.

In step S835, the control current value change processing is executed. Then, the main flow proceeds to step S840.

In step S840, the ON pressure value change processing is executed. Then, the main flow proceeds to step S845.

In step S845, the OFF pressure value change processing is executed. Then, the main flow proceeds to step S850.

In step S850, the controller 30 acquires the pressure value in the tank part 15 detected by the pressure sensor 33, and checks whether the pressure value is equal to or greater than the OFF pressure value. When it is checked that the pressure value is equal to or greater than the OFF pressure value, the main flow proceeds to step S855. On the other hand, when the pressure value is not equal to or greater than the OFF pressure value, the main flow returns to step S835.

When the main flow proceeds to step S855, the controller 30 stops the drive of the motor 11 because the pressure value in the tank part 15 has increased and reached a stop pressure due to the drive of the motor 11. Then, the main flow returns to step S860.

In step S860, the controller 30 resets a stop counter, and starts measurement by the stop counter. The stop counter is a timer counter for measuring a time after the drive of the motor 11 is stopped until the motor 11 is again driven. Then, the main flow returns to step S810.

Subsequently, the change processing upon drive start is described with reference to FIG. 20. The change processing upon drive start is processing for changing the control current value, the ON pressure value and the OFF pressure value when the motor 11 is continuously stopped for a predetermined time (for example, 30 minutes) or longer and is then again driven.

Figure 20:
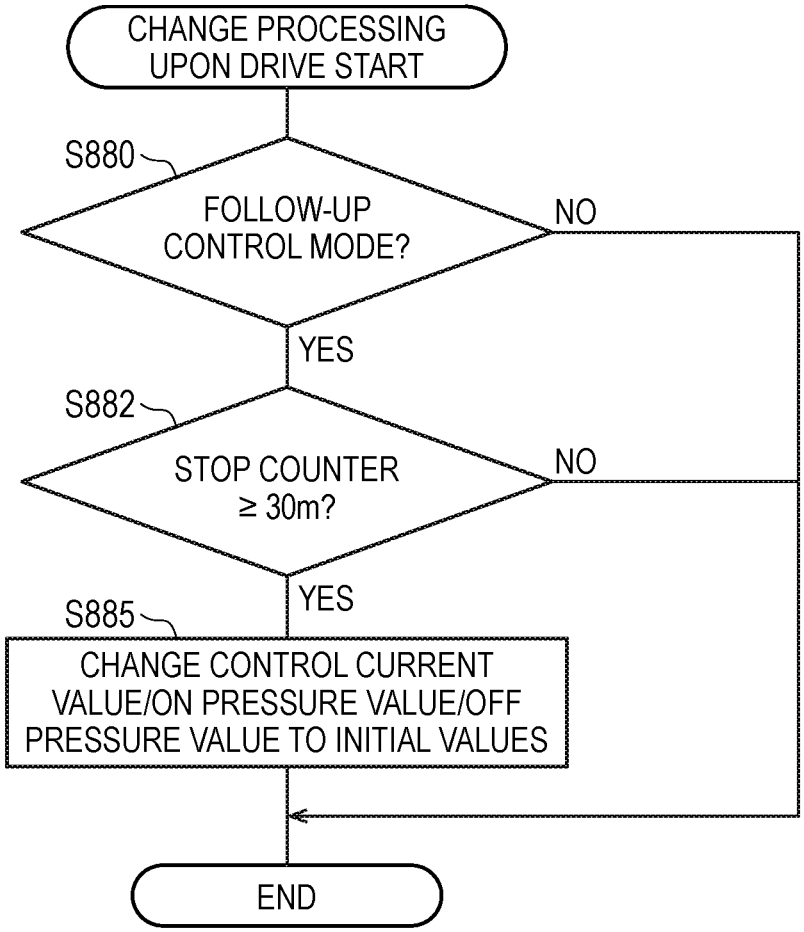
FIG. 20 is a flowchart of change processing upon drive start of the third embodiment.

In the change processing upon drive start, in step S880 of FIG. 20, it is checked whether the current operating mode is the follow-up control mode. When it is checked that the current operating mode is not the follow-up control mode, the change processing upon drive start is over. On the other hand, when it is checked that the current operating mode is the follow-up control mode, the flow proceeds to step S882.

In step S882, the controller 30 refers to the stop counter, and checks whether a value of the stop counter is a predetermined time (for example, 30 minutes) or longer. When it is checked that the value of the stop counter is not a predetermined time or longer, the change processing upon drive start is over. On the other hand, when it is checked that the value of the stop counter is a predetermined time or longer, the flow proceeds to step S885 because the predetermined time (30 minutes) has elapsed after the drive of the motor 11 is stopped until the motor 11 is again driven.

When the flow proceeds to step S885, the control current value, the ON pressure value and the OFF pressure value are changed to the initial value. Then, the change processing upon drive start is over.

By the above configuration, when the predetermined time (30 minutes) has elapsed after the drive of the motor 11 is stopped at last until the motor 11 is again driven, the control current value, the ON pressure value and the OFF pressure value are returned to the initial values although they are reduced to the lowest values. Therefore, even when a tool where the air consumption is large is used from a state where the motor 11 is not operated for a long time due to break time and the like, the control current value, the ON pressure value and the OFF pressure value reduced to the lowest values are rapidly returned to the initial values, so that it is possible to prevent the deficiency of compressed air in advance.

As describe above, the controller 30 of the third embodiment changes at least one of the ON pressure value, the OFF pressure value and the output of the motor 11 when the motor 11 is again driven after it is continuously stopped longer than the predetermined time.

According to the above configuration, even when the state where the compressed air is not consumed for a predetermined time due to break time and the like continues and the ON pressure value, the OFF pressure value and the output of the motor 11 are reduced to the settable lowest values, the ON pressure value, the OFF pressure value and the output of the motor 11 are changed upon resumption of the operation, so that the output of the motor 11 and the pressure in the tank part 15 can be rapidly increased. Therefore, it is possible to prevent the lowering in followability and the deficiency of compressed air when the operation is resumed.

Note that, in the present embodiment, the ON pressure value, the OFF pressure value and the output of the motor 11 are all changed when the motor 11 is again driven after it is continuously stopped longer than the predetermined time. However, the present disclosure is not limited thereto. For example, at least one of the ON pressure value, the OFF pressure value and the output of the motor 11 may be changed.

In the present embodiment, the ON pressure value, the OFF pressure value and the output of the motor 11 are individually changed when the motor 11 is again driven after it is continuously stopped longer than the predetermined time. However, the present disclosure is not limited thereto. For example, the ON pressure value, the OFF pressure value and the output of the motor 11 may be changed by switching the operating mode. That is, the ON pressure value, the OFF pressure value and the output of the motor 11 may be each stored associated with a plurality of operating modes prepared in advance, and the operating mode may be switched when the motor 11 is again driven after it is continuously stopped longer than the predetermined time.

The ON pressure value, the OFF pressure value and the output of the motor 11 are changed to the initial values when the motor 11 is again driven after it is continuously stopped longer than the predetermined time. However, the present disclosure is not limited thereto. For example, the ON pressure value, the OFF pressure value and the output of the motor 11 may be stepwise changed according to a length of the stop time. Also, the ON pressure value, the OFF pressure value and the output of the motor 11 are not necessarily required to be changed to the initial values, and may be changed to values larger or smaller than the initial values.

The third embodiment can be implemented separately from the first embodiment and the modified embodiments thereof and the second embodiment and can also be implemented in combination with the first embodiment and the modified embodiments thereof and the second embodiment.

(First Modified Embodiment of Third Embodiment)

In the third embodiment, when the motor 11 is again driven after it is continuously stopped longer than the predetermined time, it is determined that the break is over. However, the present disclosure is not limited thereto. For example, a break end receiver for receiving an input of information indicating that the break is over may be provided. The break end receiver is provided, so that it is possible to detect the end of the break and to cause the controller 30 to recognize the end of the break. The controller 30 may change the ON pressure value, the OFF pressure value and the output of the motor 11 when it is detected that the break is over.

In the below, a first modified embodiment of the third embodiment, in which the break end receiver is provided, is described with reference to FIG. 21. Note that, since the basic configuration of the present modified embodiment is not different from the first embodiment, the overlapping descriptions are omitted and only differences are described.

In the present modified embodiment, a main flow similar to FIG. 3 is executed. That is, the "change processing upon drive start" (refer to step S827 in FIG. 19) is not executed upon start of the motor 11. Instead, when the break end receiver receives an input of information indicating that the break is over, break end processing shown in FIG. 21 is executed.

Note that, the break end receiver may receive the input of information indicating that the break is over by receiving an operation from the operator. For example, an operation unit (a switch and the like) that can be operated by the operator may be provided, and when the operation unit is operated, the input of information indicating that the break is over may be received. When the operation unit is provided, the operator performs a predetermined operation (for example, a push operation on the switch) at the end of the break, so that it is possible to detect the end of the break.

The break end receiver may also be configured to operate in conjunction with time. That is, the break end receiver may receive the input of information indicating that the break is over by acquiring a time from a clock embedded in the air compressor 10. For example, when taking a break at a fixed time such as a lunch time, it may be determined that the break is over when it is a predetermined time preset by the operator or the like, and the end of the break may be thus detected.

In addition, when a predetermined time elapses since the break starts, the break end receiver may determine that the break is over, thereby detecting the end of the break. That is, the break end receiver may receive the input of information indicating that the break is over by acquiring an elapsed time from a clock embedded in the air compressor 10. In this case, a break start receiver (which will be described later) for receiving an input of information indicating that the break has started is required. When time measurement is enabled to start since the start of the break is detected by the break start receiver and a predetermined break time elapses, the break end receiver may determine that the break is over, thereby detecting the end of the break. Note that, a means for inputting a break time may be provided so that the user can set the break time to any time.

Further, when a rapid pressure variation is detected, the break end receiver may determine that the break is over, thereby detecting the end of the break. For example, the controller 30 may periodically detect the change amount of the pressure value in the tank part 15 by using the pressure sensor 33, and may determine that the break is over, when the change amount exceeds a reference value. In this way, the break end receiver may receive the input of information indicating that the break is over by acquiring the information of pressure variation from the controller 30.

Figure 21:
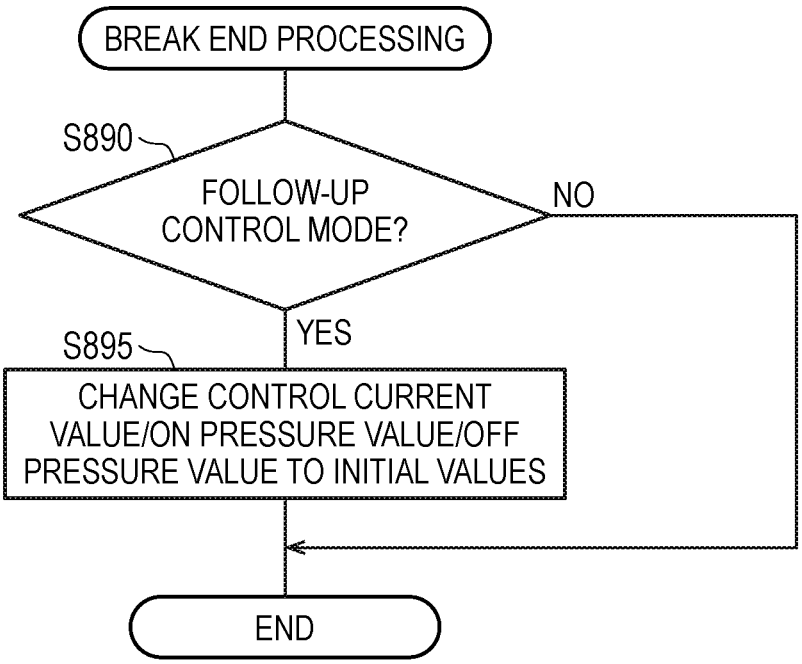
FIG. 21 is a flowchart of break end processing of a first modified embodiment of the third embodiment.

By the diverse methods as described above, when the break end receiver detects the end of the break, the controller 30 executes break end processing shown in FIG. 21.

In the break end processing, in step S890 of FIG. 21, it is checked whether the current operating mode is the follow-up control mode. When it is checked that the current operating mode is not the follow-up control mode, the change processing upon drive start is over. On the other hand, when it is checked that the current operating mode is the follow-up control mode, the flow proceeds to step S895.

When the flow proceeds to step S895, the control current value, the ON pressure value and the OFF pressure value are changed to the initial values. Then, the break end processing is over.

By the above configuration, it is possible to perceive the end of the break more clearly.

Note that, in the present modified embodiment, in step S895, the ON pressure value, the OFF pressure value and the output of the motor 11 are all changed. However, the present disclosure is not limited thereto. For example, at least one of the ON pressure value, the OFF pressure value and the output of the motor 11 may be changed.

In step S895, the ON pressure value, the OFF pressure value and the output of the motor 11 are changed to the initial values. However, the present disclosure is not limited thereto. For example, they may also be changed to values other than the initial values.

As described above, according to the present modified embodiment, the break end receiver for receiving the input of information indicating that the break is over is provided, and the controller 30 changes at least one of the ON pressure value, the OFF pressure value and the output of the motor when the break end receiver detects the end of the break.

According to the above configuration, even when the state where the compressed air is not consumed for a predetermined time due to the break time and the like continues and the ON pressure value, the OFF pressure value and the output of the motor 11 are reduced to the settable lowest values, it is possible to rapidly increase the output of the motor 11 and the pressure in the tank part 15 by changing the ON pressure value, the OFF pressure value and the output of the motor 11 upon resumption of the operation (upon the end of the break). Therefore, it is possible to prevent the lowering in followability and the deficiency of compressed air when the operation is resumed.

For example, when the break is over, the ON pressure value, the OFF pressure value and the output of the motor 11 may be returned to the initial values before the setting change processing is executed. In this way, it is possible to effectively prevent the problem that the compressed air becomes deficient upon return from the break.

(Second Modified Embodiment of Third Embodiment)

In the third embodiment, the start of the break is not detected. However, the start of the break may be detected. That is, a break start receiver for receiving an input of information indicating that the break has started may be provided.

In the below, a second modified embodiment of the third embodiment, in which the break start receiver is provided, is described with reference to FIGS. 22 to 24. Note that, since the basic configuration of the present modified embodiment is not different from the first embodiment, the overlapping descriptions are omitted and only differences are described.

In the present modified embodiment, a main flow similar to FIG. 3 is executed. That is, unlike the third embodiment, the "change processing upon drive start" (refer to step S827 in FIG. 19) is not executed upon start of the motor 11.

Figure 22:
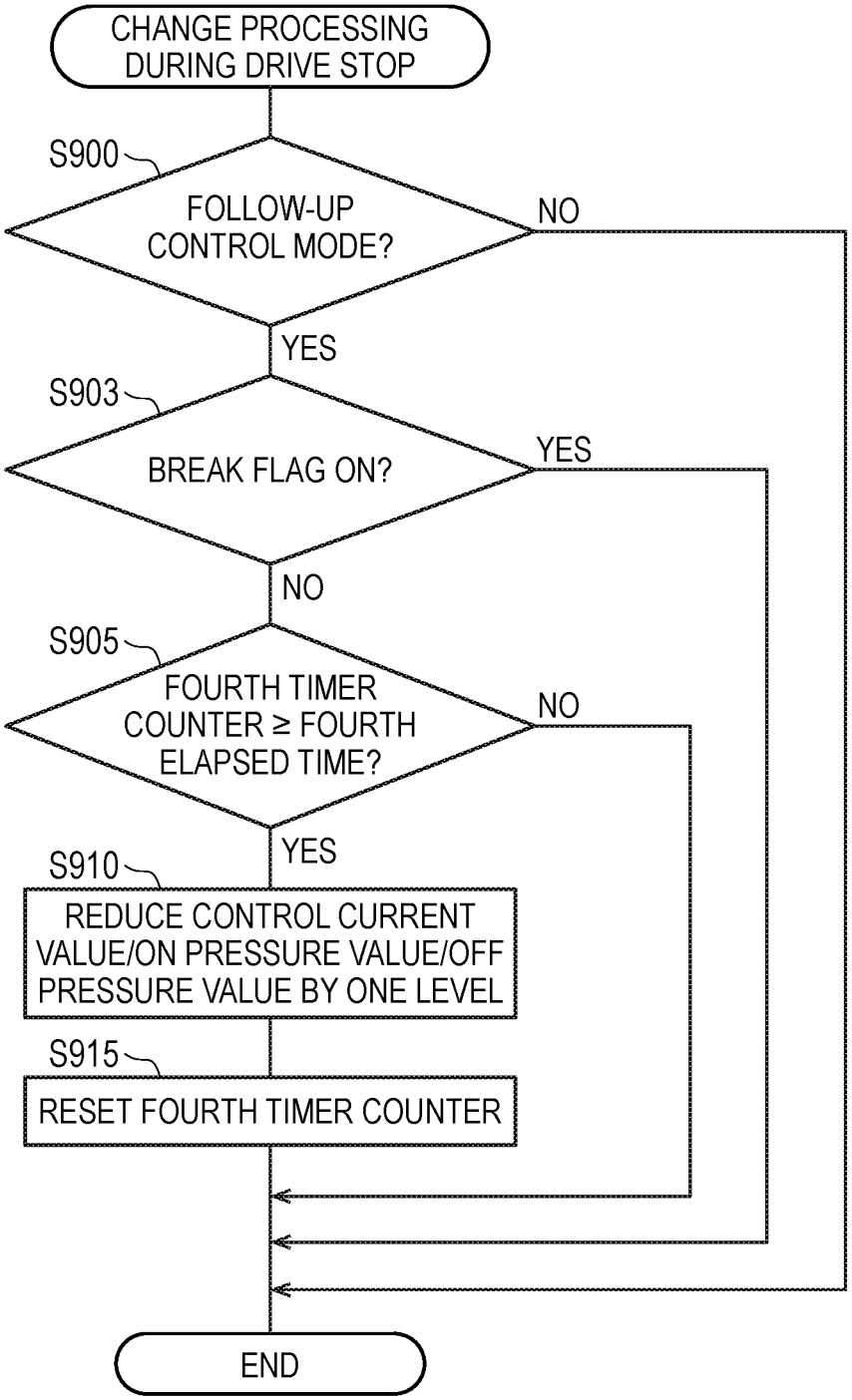
FIG. 22 is a flowchart of change processing during drive stop of a second modified embodiment of the third embodiment.

In the present modified embodiment, change processing during drive stop shown in FIG. 22 is executed instead of the change processing during drive stop shown in FIG. 7. In addition, break start processing is executed when the break start receiver receives an input of information indicating that the break has started. Further, break end processing shown in FIG. 24 is executed when the break end receiver receives the input of information indicating that the break is over.

The break start receiver may receive an input of information indicating that the break has started by receiving an operation from the operator. For example, an operation unit (a switch and the like) that can be operated by the operator may be provided, and when the operation unit is operated, the input of information indicating that the break has started may be received. When the operation unit is provided, the operator performs a predetermined operation (for example, a push operation on the switch) at the start of the break, so that it is possible to detect the start of the break.

The break start receiver may also be configured to operate in conjunction with time. That is, the break start receiver may receive the input of information indicating that the break has started by acquiring a time from a clock embedded in the air compressor 10. For example, when taking a break at a fixed time such as a lunch time, it may be determined that the break has started when it is a predetermined time preset by the operator or the like, and the start of the break may be thus detected.

The break end receiver may receive the input of information indicating that the break is over by the above-described methods. For example, the break end receiver may receive an input by an operation from the operator, may receive an input by acquiring a time from a clock embedded in the air compressor 10, may receive an input by acquiring an elapsed time from a clock embedded in the air compressor 10, or may receive an input by acquiring the information of pressure variation from the controller 30. Note that, when predicting the end of the break by the elapsed time, the time measurement may be enabled to start when the start of the break is detected by the break start receiver.

In the below, change processing during drive stop shown in FIG. 22 is described.

In the change processing during drive stop, in step S900 of FIG. 22, it is checked whether the current operating mode is the follow-up control mode. When it is checked that the current operating mode is not the follow-up control mode, the change processing upon drive start is over. On the other hand, when it is checked that the current operating mode is the follow-up control mode, the flow proceeds to step S903.

In step S903, it is checked whether a break flag is ON. The break flag is a flag indicating whether the air compressor 10 is in a break state, and is stored in a volatile memory of the controller 30. The break flag is set to OFF in an initial state such as when the power supply is turned on but is set to ON when the start of the break is detected by the break start receiver. When the break flag is ON, it is determined that it is under break, and the change processing during drive stop is over. On the other hand, when the break flag is OFF, the flow proceeds to step S905 because it is not under break.

In step S905, the controller 30 refers to the fourth timer counter, and checks whether a value of the fourth timer counter is equal to or greater than the fourth elapsed time. When it is checked that the value of the fourth timer counter is not equal to or greater than the fourth elapsed time, the change processing during drive stop is over. On the other hand, when it is checked that the value of the fourth timer counter is equal to or greater than the fourth elapsed time, it means that a time of a predetermined cycle (fourth elapsed time) has elapsed since the fourth timer counter was reset at last, and thus the flow proceeds to step S910.

When the flow proceeds to step S910, the controller 30 reduces the control current value, the ON pressure value and the OFF pressure value by one level, according to the predetermined "change amount of the control current value", "change amount of the ON pressure value" and "change amount of the OFF pressure value" (however, when the values have reached the preset lower limit values, they are not reduced beyond the lower limit values). Then, the flow proceeds to step S915.

Note that, in step S910 of the present embodiment, the control current value, the ON pressure value and the OFF pressure value are reduced at the same time by one level. However, the present disclosure is not limited thereto. For example, the control current value, the ON pressure value and the OFF pressure value may also be changed at different time intervals.

In step S915, the fourth timer counter is reset. Then, the change processing during drive stop is over.

Subsequently, the break start processing is described. The controller 30 executes the break start processing shown in FIG. 23 when the break start receiver detects the start of the break.

Figure 23:
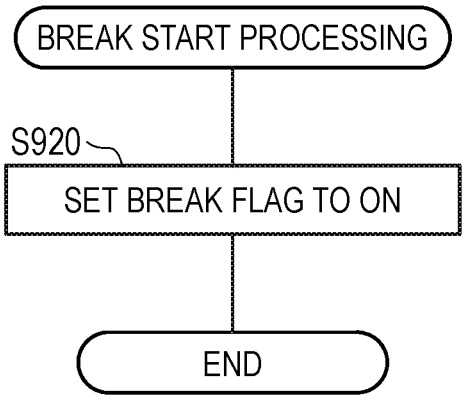
FIG. 23 is a flowchart of break start processing of the second modified embodiment of the third embodiment.

In the break start processing, in step S920 of FIG. 23, the break flag is set to ON. Then, the break start processing is over.

Subsequently, the break end processing is described. The controller 30 executes the break end processing shown in FIG. 24 when the break end receiver detects the end of the break.

Figure 24:
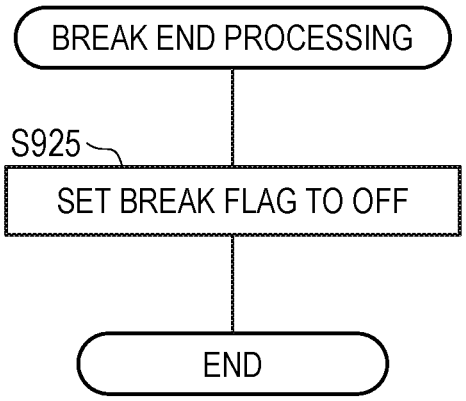
FIG. 24 is a flowchart of break end processing of the second modified embodiment of the third embodiment.

In the break end processing, in step S925 of FIG. 24, the break flag is set to OFF. Then, the break end processing is over.

According to the above configuration, the control of reducing the ON pressure value, the OFF pressure value and the output of the motor 11 is not executed during the break. Therefore, it is possible to solve the problem that the ON pressure value, the OFF pressure value and the output of the motor 11 are reduced during the break.

Note that, in the present modified embodiment, all of the ON pressure value, the OFF pressure value and the output of the motor 11 are not reduced during the break. However, the present disclosure is not limited thereto. For example, the control may be performed so that at least one of the ON pressure value, the OFF pressure value and the output of the motor 11 is not reduced during the break.

As described above, according to the present modified embodiment, the break start receiver for receiving the input of information indicating that the break has started, and the break end receiver for receiving the input of information indicating that the break is over are provided, and the controller 30 does not execute the control of reducing at least one of the ON pressure value, the OFF pressure value and the output of the motor 11 after the start of the break is detected by the break start receiver until the end of the break is detected by the break end receiver.

According to the above configuration, since it is possible to identify the break state by the break start receiver and the break end receiver, the ON pressure value, the OFF pressure value and the output of the motor 11 can be controlled not to be reduced during the break. Therefore, since it is possible to prevent the ON pressure value, the OFF pressure value and the output of the motor 11 from being reduced to the settable lowest values during the break, it is possible to prevent the problem that the compressed air becomes deficient upon return from the break.

Note that, in the present modified embodiment, although not particularly described, at least one of the ON pressure value, the OFF pressure value and the output of the motor 11 may be controlled to be constant during the break. That is, during the break, the operations of reducing and increasing the corresponding values may not be performed.

(Third Modified Embodiment of Third Embodiment)

In the present modified embodiment, similarly to the second modified embodiment of the third embodiment, the break start processing is executed when the break start receiver receives the input of information indicating that the break has started, and the break end processing is executed when the break end receiver receives the input of information indicating that the break is over.

In the below, a third modified embodiment of the third embodiment is described with reference to FIGS. 25 and 26. Note that, since the basic configuration of the present modified embodiment is not different from the first embodiment, the overlapping descriptions are omitted and only differences are described.

In the present modified embodiment, a main flow similar to FIG. 3 is executed. In addition, change processing during drive stop similar to FIG. 7 is executed.

Figure 25:
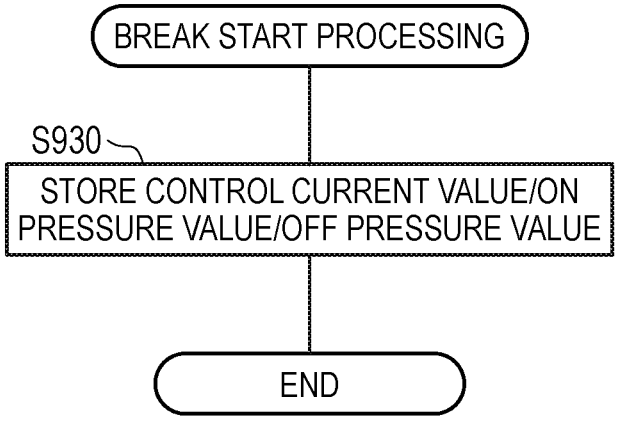
FIG. 25 is a flowchart of break start processing of a third modified embodiment of the third embodiment.

However, break start processing shown in FIG. 25 is executed when the break start receiver receives the input of information indicating that the break has started. In addition, break end processing shown in FIG. 26 is executed when the break end receiver receives the input of information indicating that the break is over.

In the break start processing, in step S930 of FIG. 25, the current control current value, the ON pressure value and the OFF pressure value are stored in the storage device (volatile memory) of the controller 30. Then, the break start processing is over.

Figure 26:
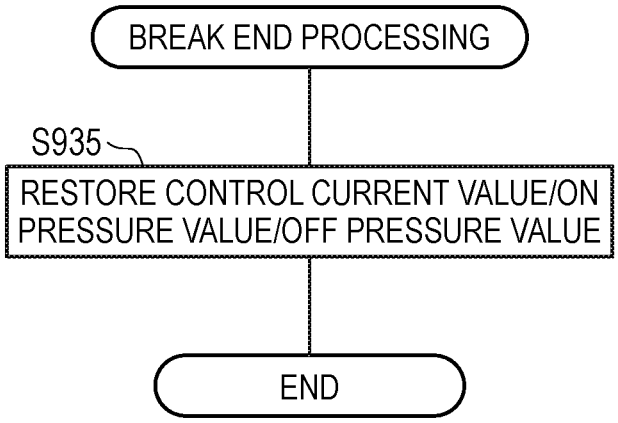
FIG. 26 is a flowchart of break end processing of the third modified embodiment of the third embodiment.

In the break end processing, in step S935 of FIG. 26, the control current value, the ON pressure value and the OFF pressure value stored in the break start processing are restored and reflected on the current setting. Then, the break end processing is over.

According to the above configuration, even when the ON pressure value, the OFF pressure value and the output of the motor 11 are reduced during the break, the control of returning the same to the state before the break is performed at the end of the break. Therefore, it is possible to prevent the lowering in followability and the deficiency of compressed air when the operation is resumed.

Note that, in the present modified embodiment, the control of returning all of the ON pressure value, the OFF pressure value and the output of the motor 11 to the state before the break is executed. However, the present disclosure is not limited thereto. For example, the control of returning at least one of the ON pressure value, the OFF pressure value and the output of the motor 11 to the state before the break may be executed.

As described above, according to the present modified embodiment, the break start receiver for receiving the input of information indicating that the break has started and the break end receiver for receiving the input of information indicating that the break is over are provided, and the controller 30 stores at least one of the ON pressure value, the OFF pressure value and the output of the motor 11 when the start of the break is detected by the break start receiver, and restores the stored values when the end of the break is detected by the break end receiver.

According to the above configuration, it is possible to restore the setting before the break, after the break. Therefore, it is possible to prevent the lowering in followability and the deficiency of compressed air when the operation is resumed.

Fourth Embodiment

A fourth embodiment of the present disclosure is described with reference to FIGS. 27 to 30. Note that, since the basic configuration of the present embodiment is not different from the first embodiment, the overlapping descriptions are omitted and only differences are described.

Figure 27:
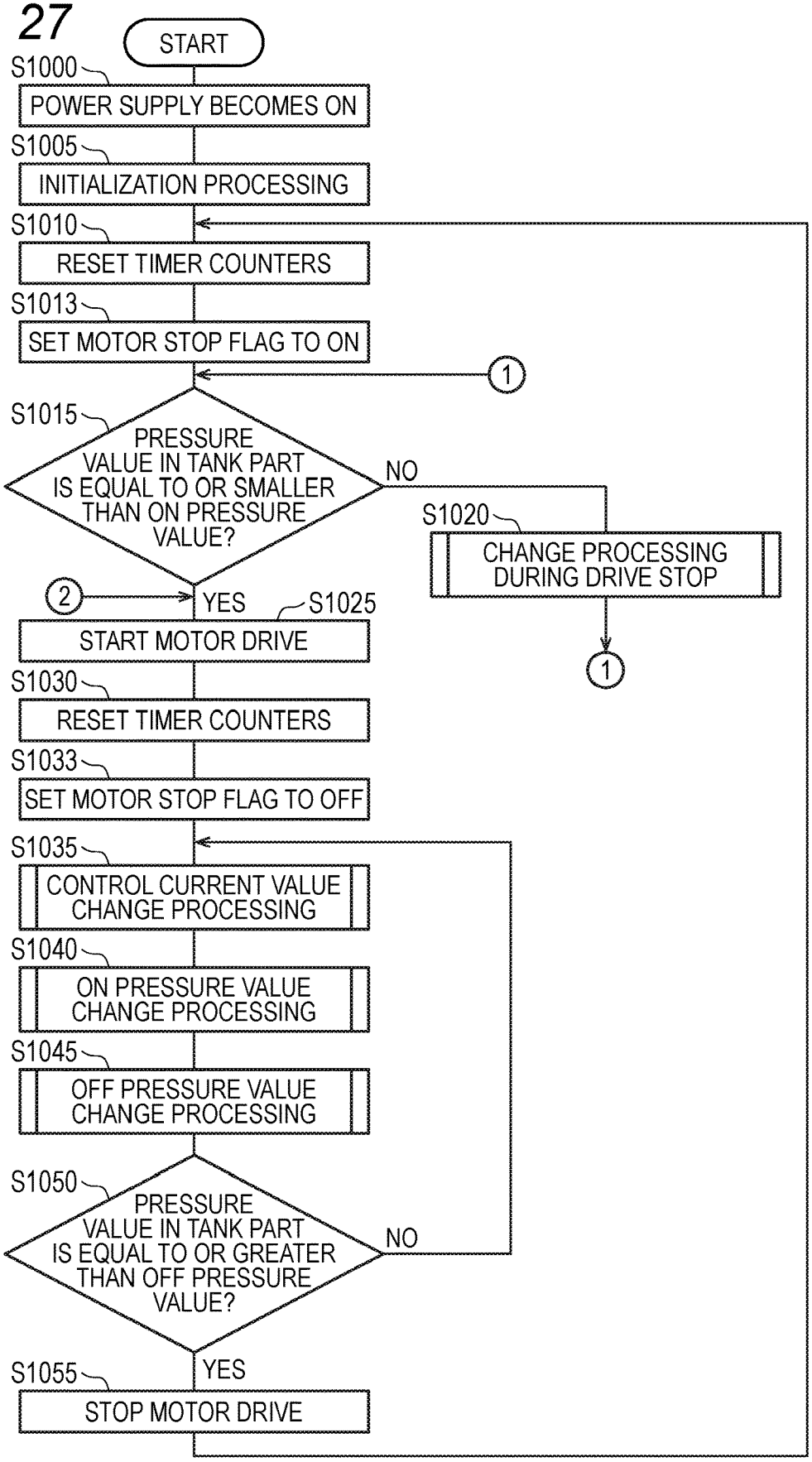
FIG. 27 is a main flowchart of an air compressor of a fourth embodiment.

In the present embodiment, a main flow shown in FIG. 27 is executed instead of the main flow described with reference to FIG. 3. The main flow shown in FIG. 27 is different from the main flow shown in FIG. 3, in that operations relating to a motor stop flag in step S1013 and step S1033 are added.

That is, in step S1000 of FIG. 27, the power supply switch 31 is operated, so that the power supply becomes on. Then, the main flow proceeds to step S1005.

In step S1005, the variety of parameters are initialized by the controller 30. Then, the main flow proceeds to step S1010.

In step S1010, the controller 30 resets the timer counters. Then, the main flow proceeds to step S1013.

In step S1013, the controller 30 sets a motor stop flag to ON. The motor stop flag is a flag indicating that the motor 11 is in a stop state. The flag is referred to in pressure detection processing during stop that will be described in detail later. Then, the main flow proceeds to step S1015.

In step S1015, the controller 30 acquires the pressure value in the tank part 15 detected by the pressure sensor 33, and checks whether the pressure value is equal to or smaller than the ON pressure value. When it is checked that the pressure value is equal to or smaller than the ON pressure value, the main flow proceeds to step S1025. On the other hand, when it is checked that the pressure value is not equal to or smaller than the ON pressure value, the main flow proceeds to step S1020.

When the main flow proceeds to step S1020, the motor 11 is still in the stop state because the motor 11 is under stop and the pressure value in the tank part 15 is not equal to or smaller than the ON pressure value (the pressure in the tank part 15 is sufficient). In this case, change processing during drive stop, which will be described later, is executed. Thereafter, the main flow returns to step S1015. However, in the change processing during drive stop, when temporary drive control processing is executed, the main flow proceeds to step S1025. This will be described in detail later.

On the other hand, when the main flow proceeds to step S1025, the controller 30 performs control of starting the drive of the motor 11 because the motor 11 is under stop and the pressure value in the tank part 15 is equal to or smaller than the ON pressure value (the pressure in the tank part 15 is insufficient). At this time, the output of the motor 11 is controlled by the set control current value. Then, the main flow proceeds to step S1030.

In step S1030, all the timer counters are reset. Then, the main flow proceeds to step S1033.

In step S1033, the controller 30 sets the motor stop flag to OFF. That is, the controller changes the setting of the flag so as to indicate that the motor 11 is in a drive state. Then, the main flow proceeds to step S1035.

In step S1035, the control current value change processing is executed. Then, the main flow proceeds to step S1040.

In step S1040, the ON pressure value change processing is executed. Then, the main flow proceeds to step S1045.

In step S1045, the OFF pressure value change processing is executed. Then, the main flow proceeds to step S1050.

In step S1050, the controller 30 acquires the pressure value in the tank part 15 detected by the pressure sensor 33, and checks whether the pressure value is equal to or greater than the OFF pressure value. When it is checked that the pressure value is equal to or greater than the OFF pressure value, the main flow proceeds to step S1055. On the other hand, when the pressure value is not equal to or greater than the OFF pressure value, the main flow returns to step S1035.

When the main flow proceeds to step S1055, the controller 30 stops the drive of the motor 11 because the pressure value in the tank part 15 has increased and reached a stop pressure due to the drive of the motor 11. Then, the main flow returns to step S1010.

Subsequently, the pressure detection processing during stop is described with reference to FIG. 28. The pressure detection processing during stop is processing for periodically detecting a change amount of the pressure value in the tank part 15 during stop of the motor 11, and checking whether the change amount exceeds a reference value. The pressure detection processing during stop is processing that is executed when a timer interrupt occurs, and is processing that is periodically called and executed by a timer interrupt that occurs every predetermined time (for example, 500 milliseconds).

Figure 28:
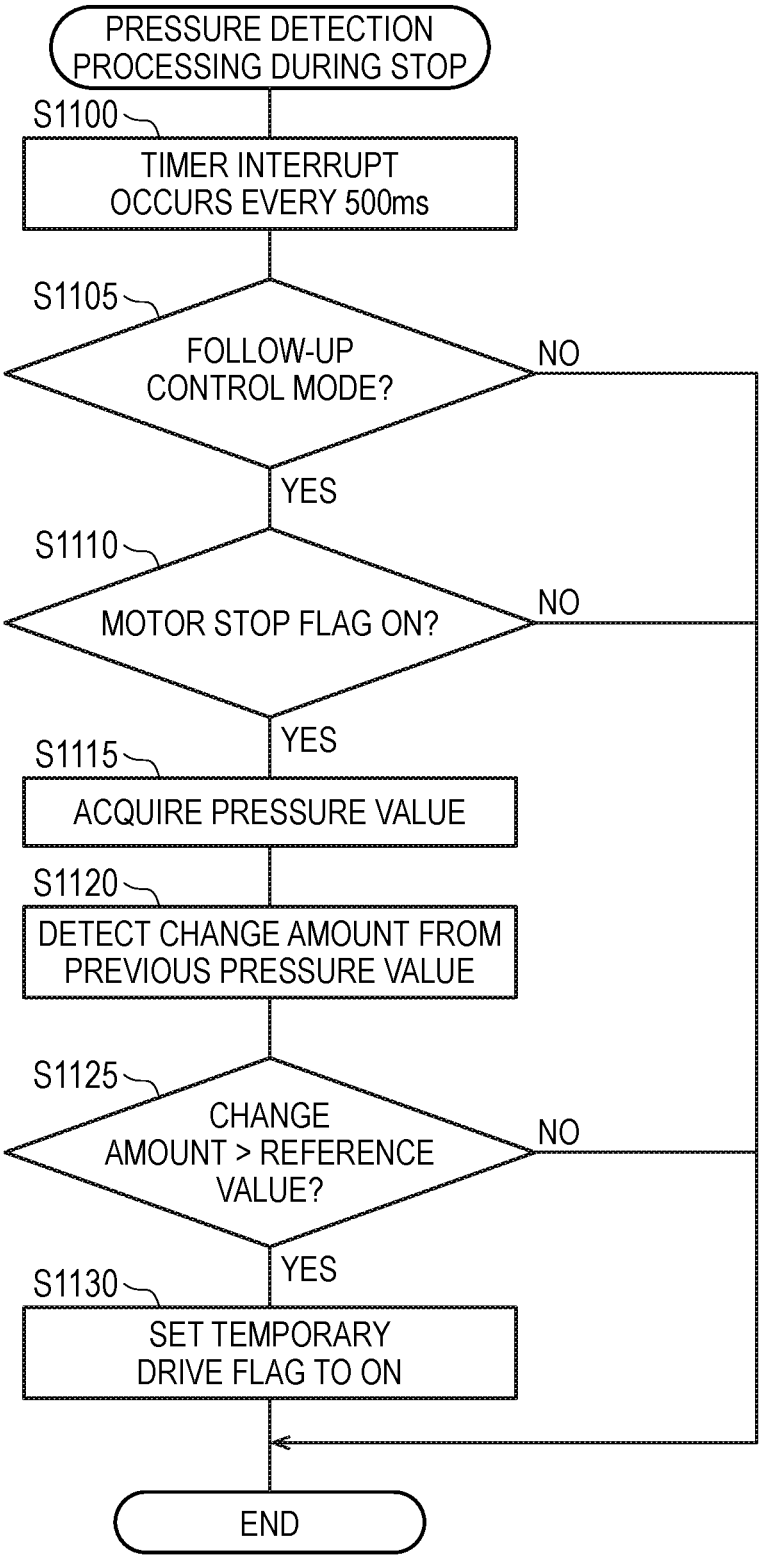
FIG. 28 is a flowchart of pressure detection processing during stop of the fourth embodiment.

That is, as shown in step S1100 of FIG. 28, the pressure detection processing during stop is enabled to start as a timer interrupt occurs with a preset cycle (for example, every 500 milliseconds). Then, the flow proceeds to step S1105.

In step S1105, it is checked whether the current operating mode is the follow-up control mode. When it is checked that the current operating mode is not the follow-up control mode, the pressure detection processing during stop is over. On the other hand, when it is checked that the current operating mode is the follow-up control mode, the flow proceeds to step S1110.

In step S1110, it is checked whether the motor stop flag is ON, i.e., the motor 11 is currently stopped. When it is checked that the motor stop flag is OFF, the pressure detection processing during stop is over. On the other hand, when it is checked that the motor stop flag is ON, the flow proceeds to step S1115.

In step S1115, the controller 30 acquires the pressure value in the tank part 15 detected by the pressure sensor 33. Note that, the acquired pressure value is stored in the memory so that it can be referred to in at least next pressure detection processing during stop. Then, the flow proceeds to step S1120.

In step S1120, the pressure value acquired in step S1115 and the pressure value (pressure value stored in the memory) acquired in the previous pressure detection processing during stop are compared to calculate a change amount of the pressure value in the tank part 15. Specifically, the current pressure value is subtracted from the previous pressure value to calculate a change amount where the pressure value is reduced. Then, the flow proceeds to step S1125.

In step S1125, it is checked whether the change amount of the pressure value calculated in step S1120 is larger than a predetermined reference value (whether reduction in pressure value exceeding the reference value due to rapid air consumption occurs). When it is checked that the change amount of the pressure value does not exceed the predetermined reference value, the pressure detection processing during stop is over. On the other hand, when it is checked that the change amount of the pressure value exceeds the predetermined reference value, the flow proceeds to step S1130.

In step S1130, a temporary drive flag is set to ON. The temporary drive flag is a flag for designating whether to execute temporary drive control processing, which will be described later. The temporary drive flag is referred in change processing during drive stop, which will be described later, and when the temporary drive flag is ON, the temporary drive control processing, which will be described later, is executed. Then, the pressure detection processing during stop is over.

Subsequently, the change processing during drive stop is described. In the present embodiment, the change processing during drive stop shown in FIG. 29 is executed instead of the change processing during drive stop shown in FIG. 7.

Figure 29:
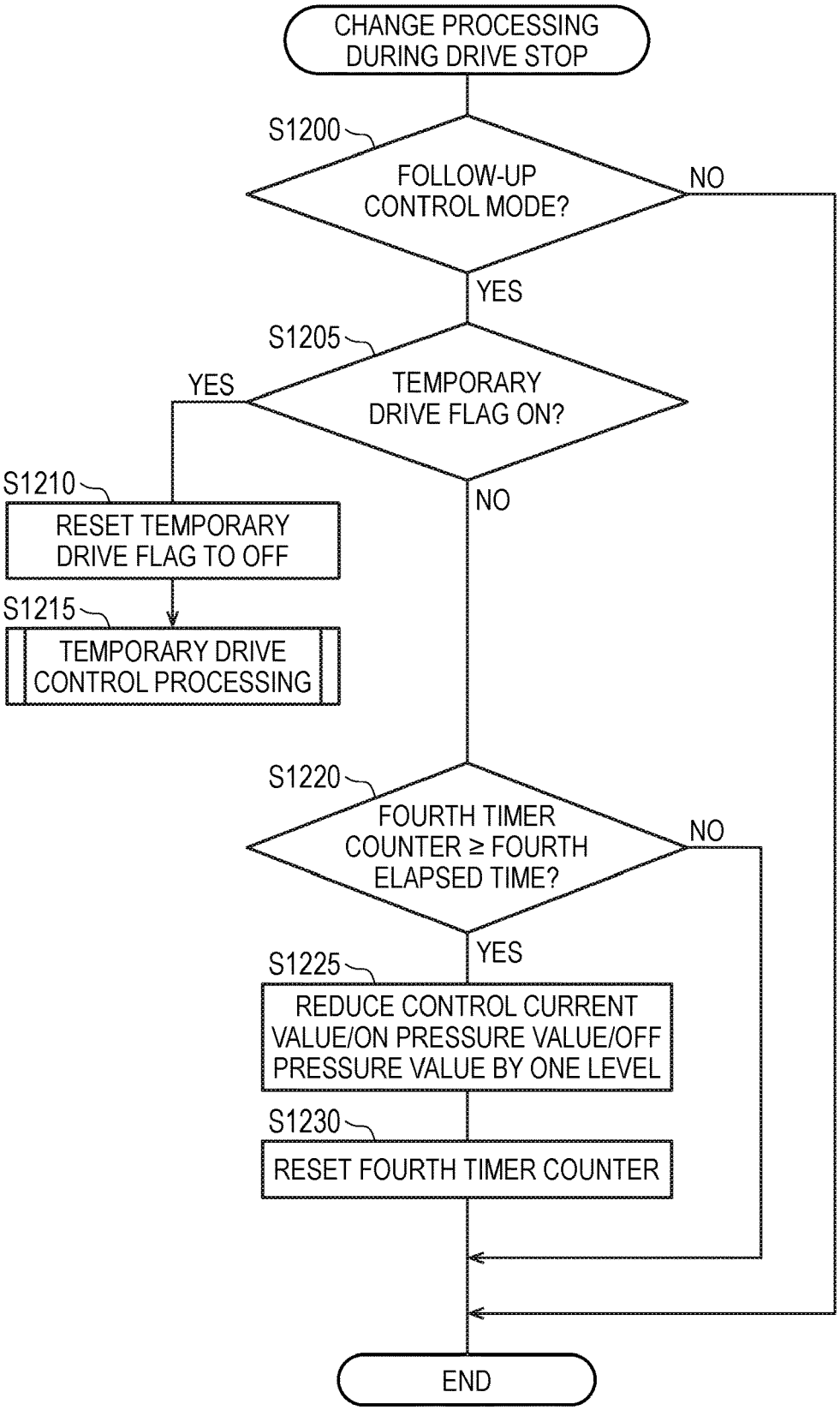
FIG. 29 is a flowchart of change processing during drive stop of the fourth embodiment.

In the change processing during drive stop, in step S1200 of FIG. 29, it is checked whether the current operating mode is the follow-up control mode. When it is checked that the current operating mode is not the follow-up control mode, the change processing during drive stop is over. On the other hand, when it is checked that the current operating mode is the follow-up control mode the follow-up control mode, the flow proceeds to step S1205.

In step S1205, it is checked whether the temporary drive flag is ON. When it is checked that the temporary drive flag is ON, it means a state where the air is rapidly consumed during stop of the motor 11 and thus the flow proceeds to step S1210 so as to execute temporary drive control. On the other hand, when it is checked that the temporary drive flag is OFF, the flow proceeds to step S1220.

When the flow proceeds to step S1210, the temporary drive flag is reset to OFF (the temporary drive flag is returned to an initial state). Then, the flow proceeds to step S1215. In step S1215, the temporary drive control processing, which will be described later, is executed.

On the other hand, when the flow proceeds to step S1220, the controller 30 refers to the fourth timer counter, and checks whether a value of the fourth timer counter is equal to or greater than the fourth elapsed time. When it is checked that the value of the fourth timer counter is not equal to or greater than the fourth elapsed time, the change processing during drive stop is over. On the other hand, when it is checked that the value of the fourth timer counter is equal to or greater than the fourth elapsed time, it means that a time of a predetermined cycle (fourth elapsed time) has elapsed since the fourth timer counter was reset at last, and thus the flow proceeds to step S1225.

When the flow proceeds to step S1225, the control current value, the ON pressure value and the OFF pressure value are reduced by one level according to the predetermined "change amount of the control current value", "change amount of the ON pressure value" and "change amount of the OFF pressure value" (however, when the values have reached the preset lower limit values, they are not reduced beyond the lower limit values). Then, the flow proceeds to step S1230.

Note that, in step S1225 of the present embodiment, the control current value, the ON pressure value and the OFF pressure value are reduced at the same time by one level. However, the present disclosure is not limited thereto. For example, the control current value, the ON pressure value and the OFF pressure value may also be changed at different time intervals.

In step S1230, the fourth timer counter is reset. Then, the change processing during drive stop is over.

Subsequently, the temporary drive control processing is described. The temporary drive control processing is processing for executing control (temporary drive control) of driving the motor 11 even before the pressure value in the tank part 15 reaches the ON pressure value, when the change amount of the pressure value in the tank part 15 during stop of the motor 11 exceeds the reference value.

Figure 30:
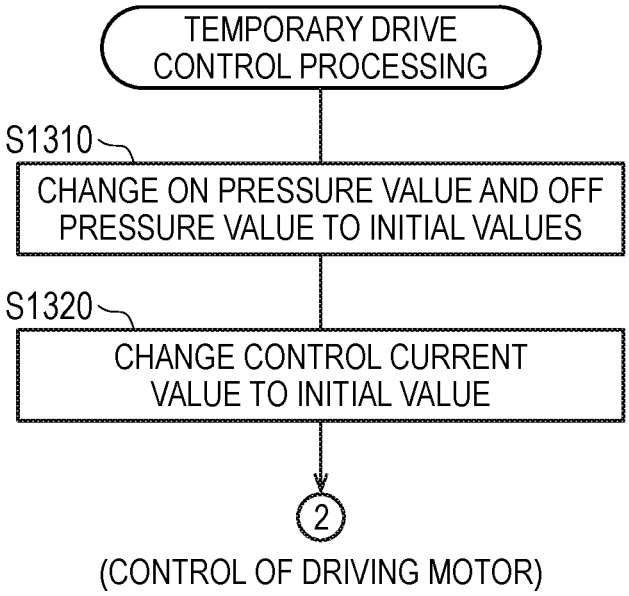
FIG. 30 is a flowchart of temporary drive control processing of the fourth embodiment.

In the temporary drive control processing, in step S1310 of FIG. 30, the ON pressure value and the OFF pressure value are changed to the initial values of the current operating mode (follow-up control mode). Then, the flow proceeds to step S1320.

In step S1320, the control current value is changed to the initial value of the follow-up control mode that is the current operating mode. Then, the flow proceeds to step S1025 in the main flow (FIG. 27).

In step S1025 of the main flow (FIG. 27), the drive of the motor 11 is enabled to start, and the compression mechanism is actuated until the pressure value in the tank part 15 reaches the OFF pressure value. Thereby, a sufficient amount of the compressed air is generated.

Note that, in the present embodiment, in step S1310, when executing the temporary drive control, the ON pressure value and the OFF pressure value are changed to the initial values. However, the present disclosure is not limited thereto. For example, the ON pressure value and the OFF pressure value may not be changed, or only one of the ON pressure value or the OFF pressure value may be changed. In addition, even when changing the ON pressure value and the OFF pressure value, they may be changed to values different from the initial values. For example, in order to keep the pressure value in the tank part 15 higher than the current situation, when changing the ON pressure value and the OFF pressure value, values where predetermined values are added to current values may be set.

In the present embodiment, in step S1310, when executing the temporary drive control, the control current value is changed to the initial value. However, the present disclosure is not limited thereto. For example, the control current value may not be changed. In addition, even when changing the control current value, it may be changed to a value different from the initial value. For example, in order to further increase the rotation number of the motor 11 than the current situation, when changing the control current value, a value where a predetermined value is added to a current value may be set.

In this way, the controller 30 of the present embodiment periodically detects the change amount of the pressure value in the tank part 15 during stop of the motor 11, and executes the control (temporary drive control) of, when the change amount exceeds the reference value, driving the motor 11 even before the pressure value in the tank part 15 reaches the ON pressure value.

According to the above configuration, in the situation where the state where the compressed air is not consumed for a predetermined time due to the break time and the like continues and the ON pressure value, the OFF pressure value and the output of the motor 11 are reduced to the settable lowest values, even when the air is rapidly consumed as the operation is resumed, the temporary drive control is executed to prevent the deficiency of compressed air.

That is, in a case where the air is not consumed due to the break time and the like and the pressure value in the tank part 15 is kept higher than the ON pressure value, the motor 11 is still in the stop state. When this state continues, the ON pressure value is reduced to the settable lowest value by the control in the follow-up control mode (refer to step S1225).

In the air compressor 10 of the related art, when the operation is resumed from this state and the air consumption rapidly increases, the motor 11 is not again driven until the pressure value in the tank part falls below the ON pressure value reduced to the lowest value. As a result, the compressed air is likely to be deficient.

However, according to the present embodiment, when the air consumption rapidly increases, the control (temporary drive control) of driving the motor 11 is executed even before the pressure value in the tank part 15 reaches the ON pressure value. Therefore, it is possible to prevent the deficiency of air in advance even in a state where the ON pressure value is reduced.

Note that, the fourth embodiment can be implemented separately from the first embodiment and the modified embodiments thereof, the second embodiment and the third embodiment and the modified embodiments, and can also be implemented in combination with the first embodiment and the modified embodiments thereof, the second embodiment and the third embodiment and the modified embodiments.

Fifth Embodiment

A fifth embodiment of the present disclosure is described with reference to FIGS. 31 to 33. Note that, since the basic configuration of the present embodiment is not different from the first embodiment, the overlapping descriptions are omitted and only differences are described.

Figure 31:
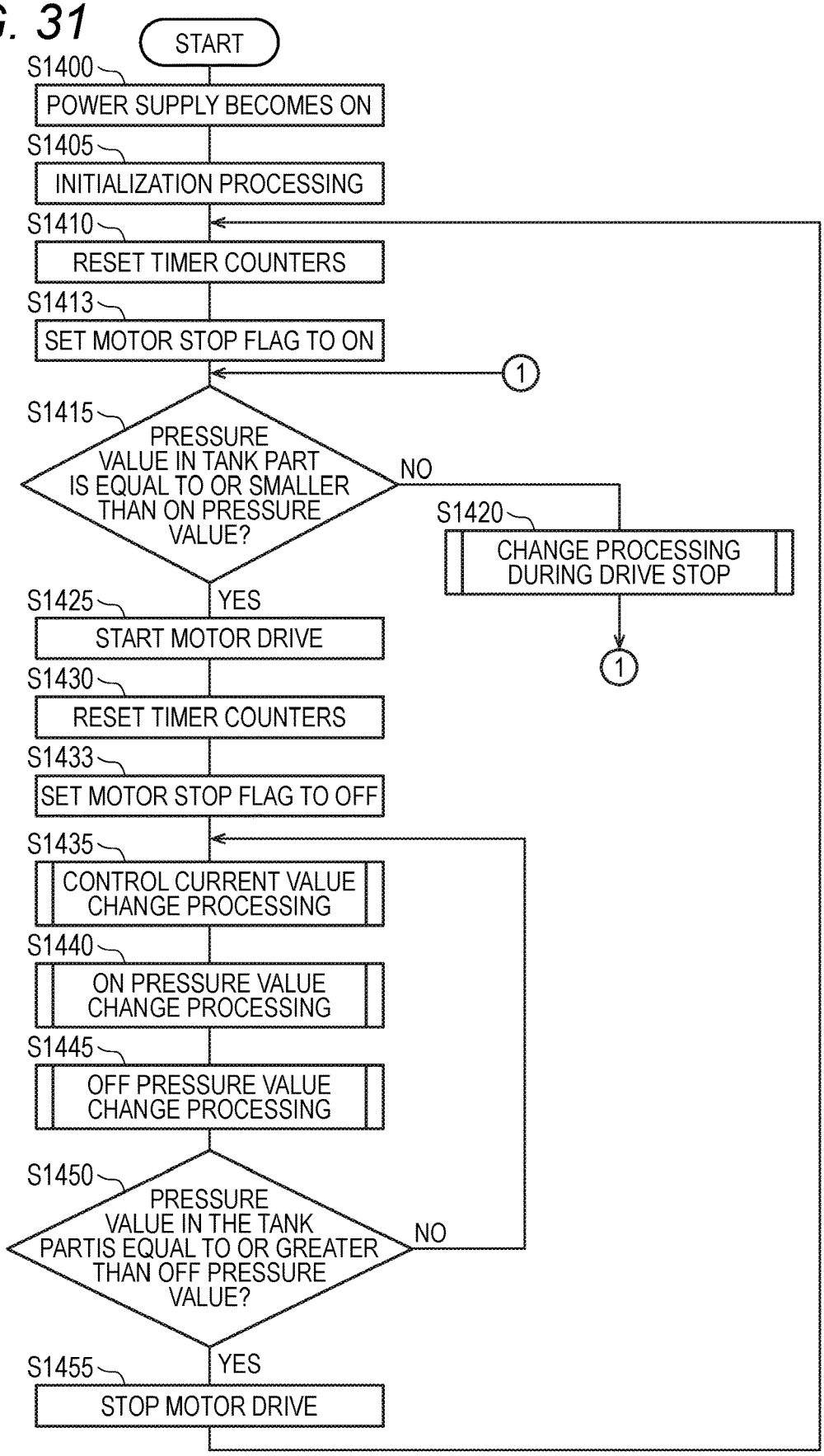
FIG. 31 is a main flowchart of an air compressor of a fifth embodiment.

In the present embodiment, a main flow shown in FIG. 31 is executed instead of the main flow described with reference to FIG. 3. The main flow shown in FIG. 31 is different from the main flow shown in FIG. 3, in that operations relating to a motor stop flag in step S1413 and step S1433 are added.

That is, in step S1400 of FIG. 31, the power supply switch 31 is operated, so that the power supply becomes on. Then, the main flow proceeds to step S1405.

In step S1405, the diverse parameters are initialized by the controller 30. Then, the main flow proceeds to step S1410.

In step S1410, the controller 30 resets the timer counters. Then, the main flow proceeds to step S1413.

In step S1413, the controller 30 sets a motor stop flag to ON. The motor stop flag is a flag indicating that the motor 11 is in a stop state. This flag is referred in the pressure detection processing during stop, which will be described in detail later. Then, the main flow proceeds to step S1415.

In step S1415, the controller 30 acquires the pressure value in the tank part 15 detected by the pressure sensor 33 and checks whether the pressure value is equal to or smaller than the ON pressure value. When it is checked that the pressure value is equal to or smaller than the ON pressure value, the main flow proceeds to step S1425. On the other hand, when it is checked that the pressure value is not equal to or smaller than the ON pressure value, the main flow proceeds to step S1420.

When the main flow proceeds to step S1420, the motor 11 is still in the stop state because the motor 11 is under stop and the pressure value in the tank part 15 is not equal to or smaller than the ON pressure value (the pressure in the tank part 15 is sufficient). In this case, the change processing during drive stop that will be described later is executed. Then, the main flow returns to step S1415.

On the other hand, when the main flow proceeds to step S1425, the controller 30 performs control of starting the drive of the motor 11 because the motor 11 is under stop and the pressure value in the tank part 15 is equal to or smaller than the ON pressure value (the pressure in the tank part 15 is insufficient). At this time, the output of the motor 11 is controlled by the set control current value. Then, the main flow proceeds to step S1430.

In step S1430, all the timer counters are reset. Then, the main flow proceeds to step S1433.

In step S1433, the controller 30 sets the motor stop flag to OFF. That is, the setting of the flag is changed so as to indicate that the motor 11 is in the drive state. Then, the main flow proceeds to step S1435.

In step S1435, the control current value change processing is executed. Then, the main flow proceeds to step S1440.

In step S1440, the ON pressure value change processing is executed. Then, the main flow proceeds to step S1445.

In step S1445, the OFF pressure value change processing is executed. Then, the main flow proceeds to step S1450.

In step S1450, the controller 30 acquires the pressure value in the tank part 15 detected by the pressure sensor 33, and checks whether the pressure value is equal to or greater than the OFF pressure value. When it is checked that the pressure value is equal to or greater than the OFF pressure value, the main flow proceeds to step S1455. On the other hand, when the pressure value is not equal to or greater than the OFF pressure value, the main flow returns to step S1435.

When the main flow proceeds to step S1455, the controller 30 stops the drive of the motor 11 because the pressure value in the tank part 15 has increased and reached a stop pressure due to the drive of the motor 11. Then, the main flow returns to step S1410.

Subsequently, the pressure detection processing during stop is described with reference to FIG. 32. The pressure detection processing during stop is processing for periodically detecting the change amount of the pressure value in the tank part 15 during stop of the motor 11, and checking whether the change amount exceeds the reference value. The pressure detection processing during stop is processing that is executed when a timer interrupt occurs, and is periodically called and executed by a timer interrupt that occurs every predetermined time (for example, 500 milliseconds).

Figure 32:
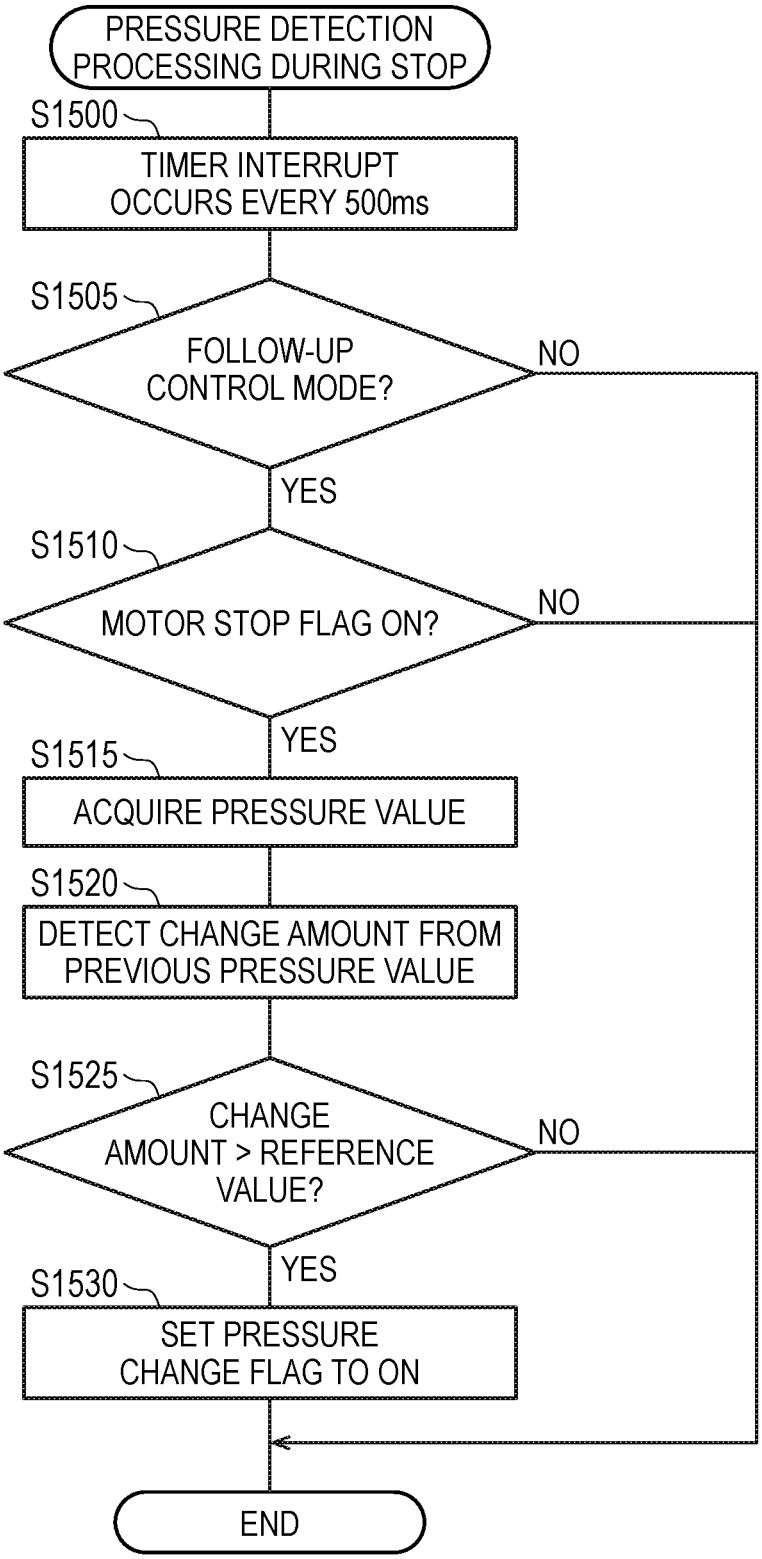
FIG. 32 is a flowchart of pressure detection processing during stop of the fifth embodiment.

That is, as shown in step S1500 of FIG. 32, the pressure detection processing during stop is enabled to start as a timer interrupt occurs with a preset cycle (for example, every 500 milliseconds). Then, the flow proceeds to step S1505.

In step S1505, it is checked whether the current operating mode is the follow-up control mode. When it is checked that the current operating mode is not the follow-up control mode, the pressure detection processing during stop is over. On the other hand, when it is checked that the current operating mode is the follow-up control mode, the flow proceeds to step S1510.

In step S1510, it is checked whether the motor stop flag is ON, i.e., the motor 11 is currently stopped. When it is checked that the motor stop flag is OFF, the pressure detection processing during stop is over. On the other hand, when it is checked that the motor stop flag is ON, the flow proceeds to step S1515.

In step S1515, the controller 30 acquires the pressure value in the tank part 15 detected by the pressure sensor 33. Note that, the acquired pressure value is stored in the memory so that it can be referred to in at least next pressure detection processing during stop. Then, the flow proceeds to step S1520.

In step S1520, the pressure value acquired in step S1515 and the pressure value (pressure value stored in the memory) acquired in the previous pressure detection processing during stop are compared to calculate a change amount of the pressure value in the tank part 15. Specifically, the current pressure value is subtracted from the previous pressure value to calculate a change amount where the pressure value is reduced. Then, the flow proceeds to step S1525.

In step S1525, it is checked whether the change amount of the pressure value calculated in step S1520 is larger than a predetermined reference value (whether reduction in pressure value exceeding the reference value due to rapid air consumption occurs). When it is checked that the change amount of the pressure value does not exceed the predetermined reference value, the pressure detection processing during stop is over. On the other hand, when it is checked that the change amount of the pressure value exceeds the predetermined reference value, the flow proceeds to step S1530.

In step S1530, a pressure change flag is set to ON. The pressure change flag is a flag indicating that the pressure change is rapid. The pressure change flag is referred to in the change processing during drive stop, which will be described later. Then, the pressure detection processing during stop is over.

Subsequently, the change processing during drive stop is described. In the present embodiment, the change processing during drive stop shown in FIG. 33 is executed instead of the change processing during drive stop shown in FIG. 7.

Figure 33:
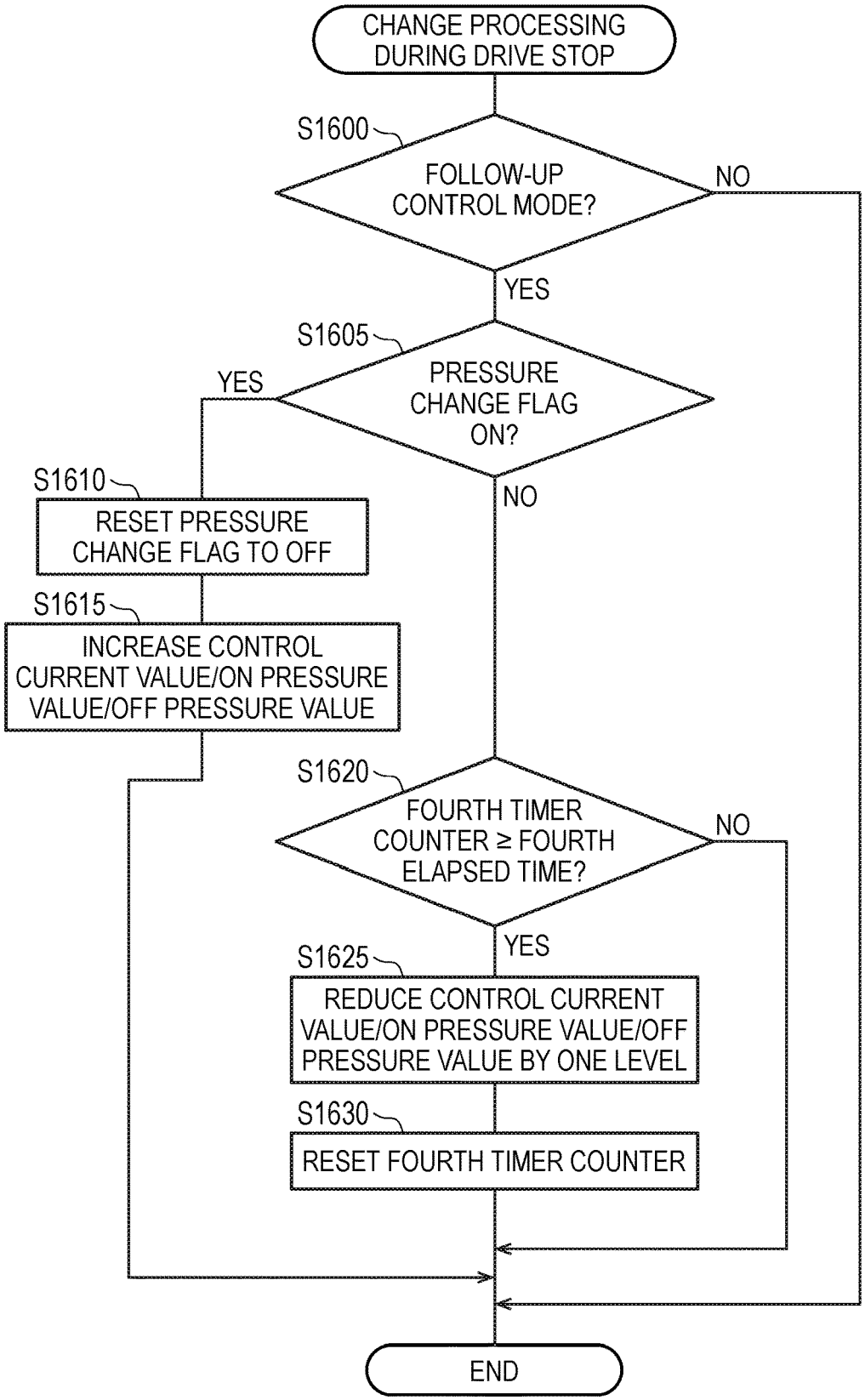
FIG. 33 is a flowchart of change processing during drive stop of the fifth embodiment.

In the change processing during drive stop, in step S1600 of FIG. 33, it is checked whether the current operating mode is the follow-up control mode. When it is checked that the current operating mode is not the follow-up control mode, the change processing during drive stop is over. On the other hand, when it is checked that the current operating mode is the follow-up control mode the follow-up control mode, the flow proceeds to step S1605.

In step S1605, it is checked whether the temporary drive flag is ON. When it is checked that the temporary drive flag is ON, it means a state where the air is rapidly consumed during stop of the motor 11 and thus the flow proceeds to step S1610. On the other hand, when it is checked that the temporary drive flag is OFF, the flow proceeds to step S1620.

When the flow proceeds to step S1610, the temporary drive flag is reset to OFF (the temporary drive flag is returned to an initial state). Then, the flow proceeds to step S1615.

In step S1615, processing for increasing the control current value, the ON pressure value and the OFF pressure value is executed. Note that, it is possible to arbitrarily set values to which the control current value, the ON pressure value and the OFF pressure value are increased. For example, the values may be increased to the initial values (upper limit values) in the current operating mode (follow-up control mode) or may be increased to values greater than the initial values. Then, the change processing during drive stop is over.

Note that, in step S1615 of the present embodiment, the control current value, the ON pressure value and the OFF pressure value are all increased. However, only some of the values may also be increased.

On the other hand, when the flow proceeds to step S1620, the controller 30 refers to the fourth timer counter, and checks whether a value of the fourth timer counter is equal to or greater than the fourth elapsed time. When it is checked that the value of the fourth timer counter is not equal to or greater than the fourth elapsed time, the change processing during drive stop is over. On the other hand, when it is checked that the value of the fourth timer counter is equal to or greater than the fourth elapsed time, it means that a time of a predetermined cycle (fourth elapsed time) has elapsed since the fourth timer counter was reset at last, and thus the flow proceeds to step S1625.

When the flow proceeds to step S1625, the control current value, the ON pressure value and the OFF pressure value are reduced by one level according to the predetermined "change amount of the control current value", "change amount of the ON pressure value" and "change amount of the OFF pressure value" (however, when the values have reached the preset lower limit values, they are not reduced beyond the lower limit values). Then, the flow proceeds to step S1630.

Note that, in step S1625 of the present embodiment, the control current value, the ON pressure value and the OFF pressure value are reduced at the same time by one level. However, the present disclosure is not limited thereto. For example, the control current value, the ON pressure value and the OFF pressure value may also be changed at different time intervals.

In step S1630, the fourth timer counter is reset. Then, the change processing during drive stop is over.

As described above, the controller 30 of the present embodiment periodically detects the change amount of the pressure value in the tank part 15 during stop of the motor 11, and changes any one of the ON pressure value and the OFF pressure value when the change amount exceeds the reference value.

According to the above configuration, in the situation where the state where the compressed air is not consumed for a predetermined time due to the break time and the like continues and the ON pressure value, the OFF pressure value and the output of the motor 11 are reduced to the settable lowest values, even when the air is rapidly consumed as the operation is resumed, it is possible to increase the followability.

That is, in a case where the air is not consumed due to the break time and the like and the pressure value in the tank part 15 is kept higher than the ON pressure value, the motor 11 is still in the stop state. When this state continues, the ON pressure value is reduced to the settable lowest value by the control in the follow-up control mode (refer to step S1625).

In the air compressor 10 of the related art, when the operation is resumed from this state and the air consumption rapidly increases, the motor 11 is not again driven until the pressure value in the tank part falls below the ON pressure value reduced to the lowest value. As a result, the compressed air is likely to be deficient.

However, according to the present embodiment, when the air consumption rapidly increases, at least one of the ON pressure value and the OFF pressure value is changed. For example, when the ON pressure value is changed to a large value, the motor 11 is rapidly again driven, so that it is possible to prevent the deficiency of air in advance. Also, when the OFF pressure value is changed to a large value, the pressure in the tank part 15 can be kept high, so that the deficiency of air is difficult to occur.

Note that, in the present embodiment, when the change amount of the pressure value exceeds the reference value, at least one of the ON pressure value and the OFF pressure value is individually changed. However, the present disclosure is not limited thereto. For example, the ON pressure value and the OFF pressure value may be changed by switching the operating mode. That is, the ON pressure value and the OFF pressure value may be each stored associated with a plurality of operating modes prepared in advance, and the operating mode may be switched when the change amount of the pressure value exceeds the reference value.

Note that, the fifth embodiment can be implemented separately from the first embodiment and the modified embodiments thereof, the second embodiment, the third embodiment and the modified embodiments and the fourth embodiment, and can also be implemented in combination with the first embodiment and the modified embodiments thereof, the second embodiment, the third embodiment and the modified embodiments and the fourth embodiment.

Sixth Embodiment

A sixth embodiment of the present disclosure is described with reference to FIGS. 34 and 35. Note that, since the basic configuration of the present embodiment is not different from the first embodiment, the overlapping descriptions are omitted and only differences are described.

The present embodiment includes at least one additional timer counter (fifth timer counter), in addition to the four timer counters. The fifth timer counter is to acquire the continuous stop time of the motor 11 with a span longer than the fourth timer counter.

Figure 34:
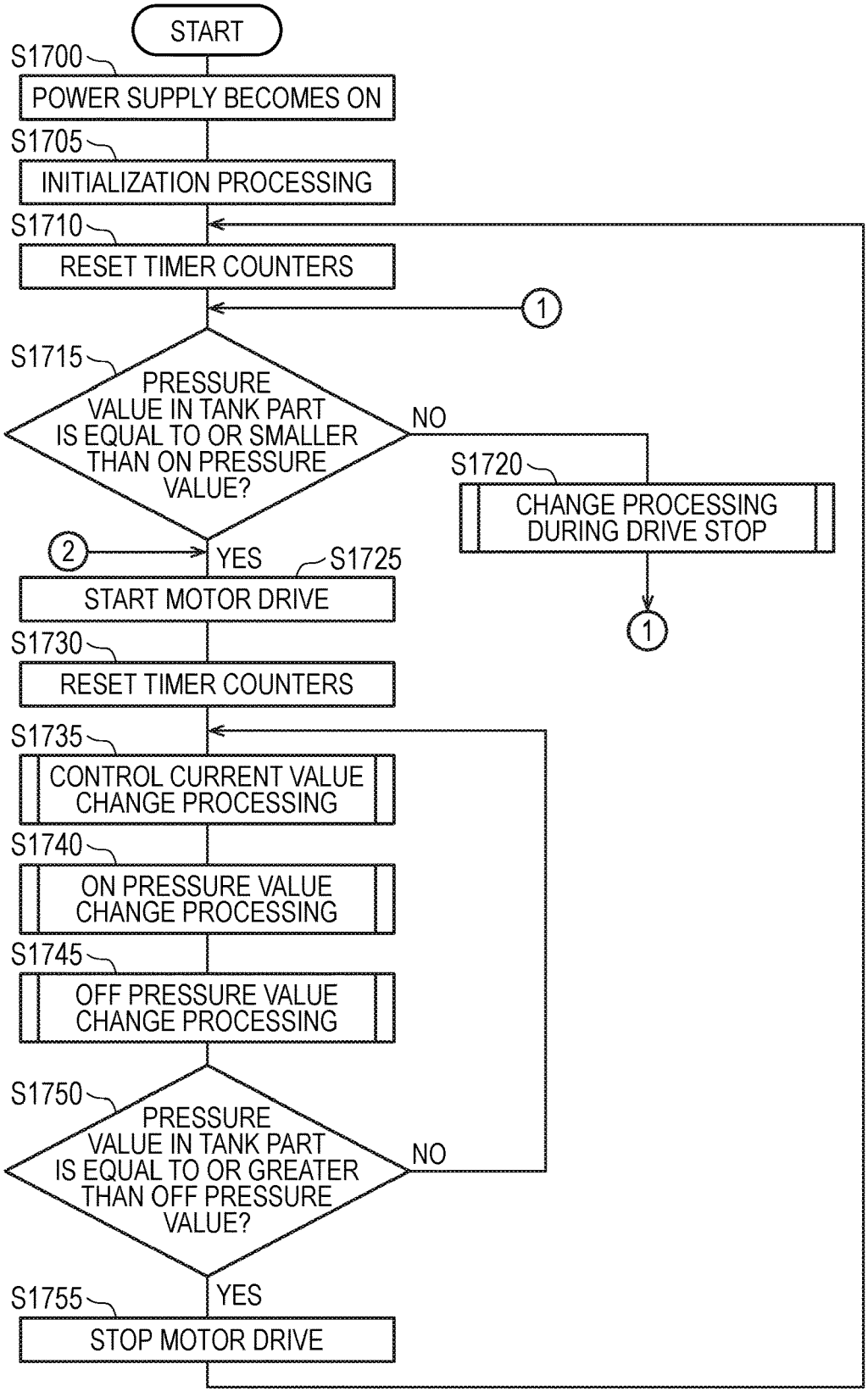
FIG. 34 is a main flowchart of an air compressor of a sixth embodiment.

In the present embodiment, a main flow shown in FIG. 34 is executed instead of the main flow describe with reference to FIG. 3.

That is, in step S1700 of FIG. 34, the power supply switch 31 is operated, so that the power supply becomes on. Then, the main flow proceeds to step S1705.

In step S1705, the diverse parameters are initialized by the controller 30. Then, the main flow proceeds to step S1710.

In step S1710, the controller 30 resets the timer counters. That is, the five timer counters including the fifth timer counter are reset. Then, the main flow proceeds to step S1715.

In step S1715, the controller 30 acquires the pressure value in the tank part 15 detected by the pressure sensor 33 and checks whether the pressure value is equal to or smaller than the ON pressure value. When it is checked that the pressure value is equal to or smaller than the ON pressure value, the main flow proceeds to step S1725. On the other hand, when it is checked that the pressure value is not equal to or smaller than the ON pressure value, the main flow proceeds to step S1720.

When the main flow proceeds to step S1720, the motor 11 is still in the stop state because the motor 11 is under stop and the pressure value in the tank part 15 is not equal to or smaller than the ON pressure value (the pressure in the tank part 15 is sufficient). In this case, the change processing during drive stop that will be described later is executed. Then, the main flow returns to step S1715. However, in the change processing during drive stop, when the temporary drive control processing is executed, the main flow proceeds to step S1725. This will be described in detail later.

On the other hand, when the main flow proceeds to step S1725, the controller 30 performs control of starting the drive of the motor 11 because the motor 11 is under stop and the pressure value in the tank part 15 is equal to or smaller than the ON pressure value (the pressure in the tank part 15 is insufficient). At this time, the output of the motor 11 is controlled by the set control current value. Then, the main flow proceeds to step S1730.

In step S1730, all the timer counters are reset. Then, the main flow proceeds to step S1735.

In step S1735, the control current value change processing is executed. Then, the main flow proceeds to step S1740.

In step S1740, the ON pressure value change processing is executed. Then, the main flow proceeds to step S1745.

In step S1745, the OFF pressure value change processing is executed. Then, the main flow proceeds to step S1750.

In step S1750, the controller 30 acquires the pressure value in the tank part 15 detected by the pressure sensor 33, and checks whether the pressure value is equal to or greater than the OFF pressure value. When it is checked that the pressure value is equal to or greater than the OFF pressure value, the main flow proceeds to step S1755. On the other hand, when the pressure value is not equal to or greater than the OFF pressure value, the main flow returns to step S1735.

When the main flow proceeds to step S1755, the controller 30 stops the drive of the motor 11 because the pressure value in the tank part 15 has increased and reached a stop pressure due to the drive of the motor 11. Then, the main flow returns to step S1710.

Subsequently, the change processing during drive stop is described. In the present embodiment, the change processing during drive stop shown in FIG. 35 is executed instead of the change processing during drive stop shown in FIG. 7.

Figure 35:
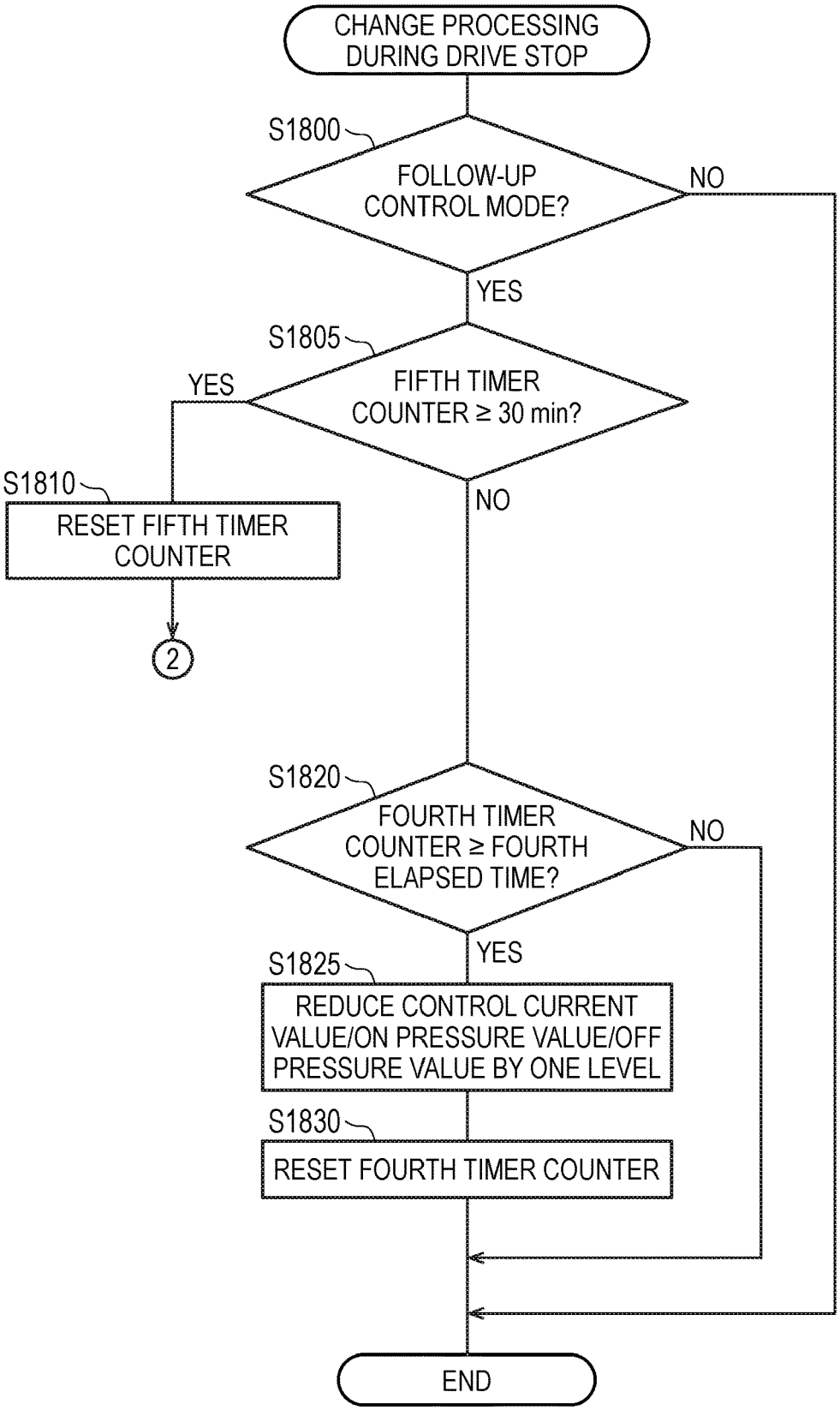
FIG. 35 is a flowchart of change processing during drive stop of the sixth embodiment.

In the change processing during drive stop, in step S1800 of FIG. 35, it is checked whether the current operating mode is the follow-up control mode. When it is checked that the current operating mode is not the follow-up control mode, the change processing during drive stop is over. On the other hand, when it is checked that the current operating mode is the follow-up control mode the follow-up control mode, the flow proceeds to step S1805.

In step S1805, the controller 30 refers to the fifth timer counter, and checks whether a value of the fifth timer counter exceeds a predetermined time. The predetermined time may be any value significantly greater than at least the fourth elapsed time, and may be arbitrarily set, for example 30 minutes, in the present embodiment. Thereby, in the present embodiment, when the stop time (the value of the fifth timer counter) of the motor 11 exceeds 30 minutes, it is determined that the operation is interrupted for a long time and the break is taken. When the value of the fifth timer counter exceeds 30 minutes, the flow proceeds to step S1810. On the other hand, when the value of the fifth timer counter does not exceed 30 minutes, the flow proceeds to step S1820.

When the flow proceeds to step S1810, the fifth timer counter is reset (the fifth timer counter is returned to the initial state). Then, the flow proceeds to step S1725 of the main flow (FIG. 34) so as to execute the control (temporary drive control) of driving the motor 11 even before the pressure value in the tank part 15 reaches the ON pressure value.

On the other hand, when the flow proceeds to step S1820, the controller 30 refers to the fourth timer counter, and checks whether a value of the fourth timer counter is equal to or greater than the fourth elapsed time. When it is checked that the value of the fourth timer counter is not equal to or greater than the fourth elapsed time, the change processing during drive stop is over. On the other hand, when it is checked that the value of the fourth timer counter is equal to or greater than the fourth elapsed time, it means that a time of a predetermined cycle (fourth elapsed time) has elapsed since the fourth timer counter was reset at last, and thus the flow proceeds to step S1825.

When the flow proceeds to step S1825, the control current value, the ON pressure value and the OFF pressure value are reduced by one level according to the predetermined "change amount of the control current value", "change amount of the ON pressure value" and "change amount of the OFF pressure value" (however, when the values have reached the preset lower limit values, they are not reduced beyond the lower limit values). Then, the flow proceeds to step S1830.

Note that, in step S1825 of the present embodiment, the control current value, the ON pressure value and the OFF pressure value are reduced at the same time by one level. However, the present disclosure is not limited thereto. For example, the control current value, the ON pressure value and the OFF pressure value may also be changed at different time intervals.

In step S1830, the fourth timer counter is reset. Then, the change processing during drive stop is over.

In this way, when the stop time of the motor 11 exceeds the predetermined time (30 minutes), the controller 30 of the present embodiment executes the control (temporary drive control) of driving the motor 11 even before the pressure value in the tank part 15 reaches the ON pressure value.

According to the above configuration, even in the situation where the state where the compressed air is not consumed for a predetermined time due to the break time and the like continues and the ON pressure value, the OFF pressure value and the output of the motor 11 are reduced to the settable lowest values, the temporary drive control is executed to prevent the deficiency of compressed air.

In the air compressor of the related art, when the air is not consumed due to the break time and the like and the pressure value in the tank part 15 is kept higher than the ON pressure value, the motor 11 is still in the stop state. When this state continues, the ON pressure value is reduced to the settable lowest value by the control in the follow-up control mode (refer to step S1825). When the operation is resumed from this state and the air consumption rapidly increases, the motor 11 is not again driven until the pressure value in the tank part falls below the ON pressure value reduced to the lowest value. As a result, the compressed air is likely to be deficient.

However, according to the present embodiment, when the stop time of the motor 11 is extended due to the break time and the like, the temporary drive control is automatically executed, so that the pressure in the tank part 15 is kept high. Therefore, it is possible to prevent the deficiency of air in advance.

Note that, the sixth embodiment can be implemented separately from the first embodiment and the modified embodiments thereof, the second embodiment, the third embodiment and the modified embodiments, the fourth embodiment and the fifth embodiment, and can also be implemented in combination with the first embodiment and the modified embodiments thereof, the second embodiment, the third embodiment and the modified embodiments, the fourth embodiment and the fifth embodiment.

The aforementioned embodiments are summarized as follows.

An air compressor of a first aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to calculate a change rate of the pressure value in the tank part, and to determine an execution cycle of the setting change processing or a change amount of a value in the setting change processing, based on the change rate.

An air compressor of a second aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to calculate a change rate of the pressure value in the tank part, to compare the change rate with a previously calculated change rate of the pressure value in the tank part, and to change at least one of the ON pressure value, the OFF pressure value and the output of the motor when a comparison result satisfies a predetermined condition.

An air compressor of a third aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to change at least one of the ON pressure value, the OFF pressure value and the output of the motor when the motor is again driven after the motor is continuously stopped longer than a predetermined time.

An air compressor of a fourth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and n output of the motor, based on the continuous drive time or the continuous stop time, and The controller is configured to periodically detect a change amount of the pressure value in the tank part during stop of the motor and to execute control (temporary drive control) of, when the change amount exceeds a reference value, driving the motor even before the pressure value in the tank part reaches the ON pressure value.

An air compressor of a fifth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to periodically detect a change amount of the pressure value in the tank part during stop of the motor, and to change at least one of the ON pressure value and the OFF pressure value when the change amount exceeds a reference value.

An air compressor of a sixth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, and the controller is configured to execute control (temporary drive control) of driving the motor when a stop time of the motor exceeds a predetermined time, even before the pressure value in the tank part reaches the ON pressure value.

An air compressor of a seventh aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, the air compressor further comprises a break end receiver for receiving an input of information indicating that a break is over, and the controller is configured to change at least one of the ON pressure value, the OFF pressure value and the output of the motor when an end of the break is detected by the break end receiver.

An air compressor of a eighth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, the air compressor further comprises a break start receiver for receiving an input of information indicating that a break has started and a break end receiver for receiving an input of information indicating that the break is over, and the controller is configured not to execute control of reducing at least one of the ON pressure value, the OFF pressure value and the output of the motor after a start of the break is detected by the break start receiver until an end of the break is detected by the break end receiver.

An air compressor of a ninth aspect of the present disclosure includes: a motor configured to actuate a compression mechanism to generate compressed air; a tank part in which the compressed air generated by the compression mechanism is stored; a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism). The controller is capable of executing setting change processing for detecting a continuous drive time or a continuous stop time of the motor and changing at least one of the ON pressure value, the OFF pressure value and an output of the motor, based on the continuous drive time or the continuous stop time, the air compressor further comprises a break start receiver for receiving an input of information indicating that a break has started and a break end receiver for receiving an input of information indicating that the break is over, and the controller is configured to store at least one of the ON pressure value, the OFF pressure value and the output of the motor when a start of the break is detected by the break start receiver, and to restore the stored value when an end of the break is detected by the break end receiver.

According to the first aspect as described above, the controller can execute the setting change processing for detecting the continuous drive time or the continuous stop time of the motor, and changing at least one of the ON pressure value, the OFF pressure value and the output of the motor, based on the continuous drive time or the continuous stop time, and the controller calculates the change rate of the pressure value in the tank part, and determines the execution cycle of the setting change processing or the change amount of the value in the setting change processing, based on the change rate.

According to the above configuration, since it is possible to change the execution cycle of the setting change processing or the change amount of the value in the setting change processing by consumption of the compressed air, it is possible to automatically set the output of the motor and the pressure in the tank part with higher followability than the related art.

For example, when the change in pressure in the tank part is large, it is possible to change the output of the motor and the pressure in the tank part, in sensitive response to the change in pressure in the tank part. In contrast, when the change in pressure in the tank part is small, it is possible to change the output of the motor and the pressure in the tank part, in gentle response to the change in pressure in the tank part.

Specifically, when the air compressor is used for a large-sized nailing machine in which the compressed air is instantaneously used or an impact wrench in which the compressed air is continuously used, for example, the pressure in the tank part is largely dropped. When a change rate of the pressure value in the tank part is large, it is possible to rapidly increase the output of the motor and the pressure in the tank part by shortening the execution cycle of the setting change processing or increasing the change amount of the value in the setting change processing. That is, it is possible to prevent deficiency of compressed air by higher followability than the related art.

In contrast, when the air compressor is used for a tool such as an air tacker in which the compressed air is not consumed so much, the lowering in pressure in the tank part is small. When the change rate of the pressure value in the tank part is small, it is possible to gently increase the output of the motor and the pressure in the tank part by prolonging the execution cycle of the setting change processing or reducing the change amount of the value in the setting change processing. The increases in the output of the motor and the pressure in the tank part are suppressed, so that it is possible to suppress the load from increasing. That is, it is possible to suppress the noise, the power consumption and the consumption of a component by the higher followability than the related art.

According to the second aspect as described above, the controller calculates the change rate of the pressure value in the tank part, compares the same with the previously calculated change rate of the pressure value in the tank part, and changes at least one of the ON pressure value, the OFF pressure value and the output of the motor when a comparison result satisfies the predetermined condition.

According to the above configuration, when the change rate rapidly changes, it is possible to set the output of the motor and the pressure in the tank part by control different from usual control, so that it is possible to implement the higher followability than the related art.

For example, according to the air compressor ("AI mode" as described above) of the related art, when a state where the compressed air is not consumed for a predetermined time due to a break time and the like continues, the ON pressure value, the OFF pressure value and the output of the motor are reduced to the settable lowest values. In this state, when an operation is started and the compressed air is rapidly used, the compressed air may be deficient due to the setting in which the pressure in the tank part is suppressed low. In this respect, according to the present disclosure, it is possible to change at least one of the ON pressure value, the OFF pressure value and the output of the motor, in response to variation in pressure change rate after the drive start.

Specifically, as described above, when the compressed air is rapidly used after returning from the break, the change rate of the pressure value rapidly increases. By detecting the large variation in change rate and changing the ON pressure value, the OFF pressure value and the output of the motor, it is possible to rapidly increase the output of the motor and the pressure in the tank part, so that the followability is improved, as compared to the related art.

According to the third aspect as described above, when the motor again starts drive after the motor is continuously stopped for a longer time than the predetermined time, the controller changes at least one of the ON pressure value, the OFF pressure value and the output of the motor.

According to the above configuration, even when the state where the compressed air is not consumed for a predetermined time due to the break time and the like continues and the ON pressure value, the OFF pressure value and the output of the motor are reduced to the settable lowest values, it is possible to rapidly increase the output of the motor and the pressure in the tank part by changing the ON pressure value, the OFF pressure value and the output of the motor upon resumption of the operation. Therefore, when the operation is resumed, it is possible to prevent the lowering in followability and the deficiency of compressed air.

For example, when the motor again starts drive after the motor is continuously stopped for a longer time than the predetermined time, it is determined that it is a return from the break, the ON pressure value, the OFF pressure value and the output of the motor may be returned to the initial values before the setting change processing is executed. In this way, it is possible to effectively prevent the deficiency of compressed air upon the return from the break.

According to the fourth aspect as described above, the controller periodically detects the change amount of the pressure value in the tank part during the stop of the motor, and executes the control (temporary drive control) of, when the change amount exceeds the reference value, driving the motor even before the pressure value in the tank part reaches the ON pressure value.

According to the above configuration, in a situation where the state where the compressed air is not consumed for a predetermined time due to the break time and the like continues and the ON pressure value, the OFF pressure value and the output of the motor are reduced to the settable lowest values, even when the air consumption rapidly increases as the operation is resumed, the temporary drive control is executed to prevent the deficiency of compressed air.

That is, in a case where a state where the air is not consumed due to the break time and the like and the pressure value in the tank part is higher than the ON pressure value is kept, the motor is still stopped. When the state continues, the ON pressure value is reduced to the settable lowest value by the control in the "AI mode".

According to the air compressor of the related art, when the operation is resumed from this state and the air consumption rapidly increases, the motor is not again driven until the pressure value in the tank part falls below the ON pressure value reduced to the lowest value. As a result, the compressed air is likely to be deficient.

However, according to the present disclosure, when the air consumption rapidly increases, the control (temporary drive control) of driving the motor is executed even before the pressure value in the tank part reaches the ON pressure value. Therefore, it is possible to prevent deficiency of air in advance even in a state where the ON pressure value is reduced.

According to the fifth aspect as described above, the controller periodically detects the change amount of the pressure value in the tank part during the stop of the motor, and changes at least one of the ON pressure value and the OFF pressure value when the change amount exceeds the reference value.

According to the above configuration, in the situation where the state where the compressed air is not consumed for a predetermined time due to the break time and the like continues and the ON pressure value, the OFF pressure value and the output of the motor are reduced to the settable lowest values, even though a situation where the air consumption rapidly increases as the operation is resumed occurs, it is possible to increase the followability.

That is, in a case where the state where the air is not consumed due to the break time and the like and the pressure value in the tank part is higher than the ON pressure value is kept, the motor is still stopped. When the state continues, the ON pressure value is reduced to the settable lowest value by the control in the "AI mode".

According to the air compressor of the related art, when the operation is resumed from this state and the air consumption rapidly increases, the motor is not again driven until the pressure value in the tank part falls below the ON pressure value reduced to the lowest value. As a result, the compressed air is likely to be deficient.

However, according to the present disclosure, when the air consumption rapidly increases, at least one of the ON pressure value and the OFF pressure value is changed. For example, when the ON pressure value is changed to a large value, the motor is again rapidly driven, so that it is possible to prevent the deficiency of air in advance. In addition, when the OFF pressure value is changed to a large value, the pressure in the tank part can be kept high, so that the deficiency of air is difficult to occur.

According to the sixth aspect as described above, the controller executes the control (temporary drive control) of driving the motor when the stop time of the motor exceeds the predetermined time, even before the pressure value in the tank part reaches the ON pressure value.

According to the above configuration, even in the situation where the state where the compressed air is not consumed for a predetermined time due to the break time and the like continues and the ON pressure value, the OFF pressure value and the output of the motor are reduced to the settable lowest values, the temporary drive control is executed to prevent the deficiency of compressed air.

That is, according to the air compressor of the related art, in a case where the state where the air is not consumed due to the break time and the like and the pressure value in the tank part is higher than the ON pressure value is kept, the motor is still stopped. When the state continues, the ON pressure value is reduced to the settable lowest value by the control in the "AI mode". When the operation is resumed from this state and the air consumption rapidly increases, the motor is not again driven until the pressure value in the tank part falls below the ON pressure value reduced to the lowest value. As a result, the compressed air is likely to be deficient.

However, according to the present disclosure, when the stop time of the motor is extended due to the break time and the like, the temporary drive control is automatically executed, so that the pressure in the tank part is kept high. Therefore, it is possible to prevent the deficiency of air in advance.

The seventh aspect as described above includes the break end receiver for receiving the input of the information indicating that a break is over, and when it is detected by the break end receiver that a break is over, the controller changes at least one of the ON pressure value, the OFF pressure value and the output of the motor.

According to the above configuration, even when the state where the compressed air is not consumed for a predetermined time due to the break time and the like continues and the ON pressure value, the OFF pressure value and the output of the motor are reduced to the settable lowest values, it is possible to rapidly increase the output of the motor and the pressure in the tank part by changing the ON pressure value, the OFF pressure value and the output of the motor upon resumption of the operation (upon end of the break). Therefore, it is possible to prevent the lowering in followability and the deficiency of compressed air when the operation is resumed.

For example, when the break is over, the ON pressure value, the OFF pressure value and the output of the motor may be returned to the initial values before the setting change processing is executed. In this way, it is possible to efficiently prevent the deficiency of compressed air upon return from the break.

The eighth aspect as described above includes the break start receiver for receiving the input of the information indicating that a break has started and the break end receiver for receiving the input of the information indicating that the break is over, and the controller does not execute the control of reducing at least one of the ON pressure value, the OFF pressure value and the output of the motor, after the start of the break is detected by the break start receiver until the end of the break is detected by the break end receiver.

According to the above configuration, since it is possible to identify the break by the break start receiver and the break end receiver, it is possible to prevent the ON pressure value, the OFF pressure value and the output of the motor from being reduced during the break. Therefore, since it is possible to prevent the ON pressure value, the OFF pressure value and the output of the motor from being reduced to the settable lowest values during the break, it is possible to prevent the deficiency of compressed air upon return from the break.

The ninth aspect as described above includes the break start receiver for receiving the input of the information indicating that a break has started and the break end receiver for receiving the input of the information indicating that the break is over, and the controller stores at least one value of the ON pressure value, the OFF pressure value and the output of the motor when it is detected by the break start receiver that the break has started, and restores the stored values when it is detected by the break end receiver that the break is over.

According to the above configuration, it is possible to restore the setting before the break, after the break. Therefore, it is possible to prevent the lowering in followability and the deficiency of compressed air when the operation is resumed.

The invention claimed is:

1. An air compressor comprising:

a motor configured to actuate a compression mechanism to generate compressed air;

a tank part in which the compressed air generated by the compression mechanism is stored;

a pressure detector configured to detect a pressure value in the tank part; and a controller configured to drive the motor when the pressure value in the tank part detected by the pressure detector is equal to or smaller than an ON pressure value (a pressure value for starting drive of the compression mechanism) and to stop drive of the motor when the pressure value in the tank part detected by the pressure detector is equal to or greater than an OFF pressure value (a pressure value for stopping drive of the compression mechanism), wherein the controller is capable of executing setting change processing for detecting a continuous drive time or a continuous stop time of the motor and changing at least one of the ON pressure value, the OFF pressure value and an output of the motor, based on the continuous drive time or the continuous stop time, and wherein the controller is configured to periodically detect a change amount of the pressure value in the tank part to provide a detected change amount of the pressure value, and based on the detected change amount of the pressure value, the controller is further configured to at least one of: (a) change a duration of an execution cycle to provide plural different execution cycle durations for the setting change processing, the plural different execution cycle durations being non-zero durations, or (b) determine an operating change amount value to change at least one of the ON pressure value, the OFF pressure value and the output of the motor, with plural operating change amount values provided corresponding to different detected change amounts of the pressure value, the plural operating change amount values being non-zero change amount values.

2. The air compressor according to claim 1, wherein the controller is configured to calculate a change rate of the pressure value in the tank part, and to determine the duration of the execution cycle of the setting change processing or the operating change amount value in the setting change processing, based on the change rate.

3. The air compressor according to claim 1, wherein the controller is configured to calculate a change rate of the pressure value in the tank part, to compare the change rate with a previously calculated change rate of the pressure value in the tank part, and to change at least one of the ON pressure value, the OFF pressure value and the output of the motor when a comparison result satisfies a predetermined condition.

4. The air compressor according to claim 1, wherein the controller is configured to periodically determine the detected change amount of the pressure value in the tank part during stop of the motor and, when the detected change amount exceeds a reference value, to execute a temporary control of the motor even before the pressure value in the tank part reaches the ON pressure value.

5. The air compressor according to claim 4, wherein the controller is configured to change at least one of the ON pressure value and the OFF pressure value when executing the temporary drive control.

6. The air compressor according to claim 4, wherein the controller is configured to change the output of the motor when executing the temporary drive control.

7. The air compressor according to claim 1, wherein the controller is configured to periodically determine the detected change amount of the pressure value in the tank part during stop of the motor, and to change at least one of the ON pressure value and the OFF pressure value when the detected change amount exceeds a reference value.

8. The air compressor according to claim 1, wherein the controller is configured to change the duration of the execution cycle based on the detected change amount of the pressure value.

9. The air compressor according to claim 8, where the controller is configured to provide a longer duration for a lower detected change amount of the pressure value and a shorter duration for a higher detected change amount of the pressure value.

10. The air compressor according to claim 9, wherein a plurality of the durations are stored, and the controller is configured to select one time duration from the plurality of time durations based on the detected change amount of the pressure value.

11. The air compressor of claim 1, wherein the controller is configured to determine an operating change amount value based on the detected change amount of the pressure value.

12. The air compressor according to claim 11, wherein the controller is configured to determine a lower operating change amount value for a lower detected change amount of the pressure value and a higher operating change amount value for a higher detected change amount of the pressure value.

13. The air compressor according to claim 12, wherein a plurality of operating change amount values are stored, and the controller is configured to select one operating change amount value from the plurality of operating change amount values based on the detected change amount of the pressure value.

* * * * *